US006558896B2

(12) United States Patent
Komatsu

(10) Patent No.: US 6,558,896 B2
(45) Date of Patent: May 6, 2003

(54) SILVER SALT PHOTOTHERMOGRAPHIC MATERIAL

(75) Inventor: Hideki Komatsu, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/978,438

(22) Filed: Oct. 16, 2001

(65) Prior Publication Data

US 2002/0086252 A1 Jul. 4, 2002

(30) Foreign Application Priority Data

Oct. 20, 2000 (JP) ..... 2000/321158

(51) Int. Cl.[7] ..... G03C 1/498

(52) U.S. Cl. ..... 430/619; 430/264; 430/350; 430/598; 430/600; 430/607

(58) Field of Search ..... 430/619, 264, 430/598, 350, 600, 607

(56) References Cited

U.S. PATENT DOCUMENTS

| | | | | | |
|---|---|---|---|---|---|
| 4,281,060 | A | * | 7/1981 | Usami et al. | 430/618 |
| 5,545,515 | A | * | 8/1996 | Murray et al. | 430/617 |
| 5,656,419 | A | * | 8/1997 | Toya et al. | 430/619 |
| 6,203,972 | B1 | * | 3/2001 | Katoh et al. | 430/619 |
| 6,297,001 | B1 | * | 10/2001 | Takiguchi et al. | 430/619 |
| 6,387,608 | B2 | * | 5/2002 | Morita | 430/536 |

* cited by examiner

*Primary Examiner*—Thorl Chea
(74) *Attorney, Agent, or Firm*—Muserlian, Lucas and Mercanti

(57) ABSTRACT

A silver salt photothermographic material is disclosed, comprising on a support (a) a light-insensitive organic silver salt, (b) light-sensitive silver halide and (c) a reducing agent capable of reducing a silver ion of the organic silver salt to silver upon heating, wherein when the exposed and thermally processed photothermographic material having a density of 3.0 have been kept at 50° C. and 50% RH for 120 hr., the photothermographic material exhibits a variation of density from 3.0 being within ±0.2.

15 Claims, No Drawings

SILVER SALT PHOTOTHERMOGRAPHIC MATERIAL

FIELD OF THE INVENTION

The present invention relates to thermally developable photographic light sensitive materials (silver salt photothermographic materials) and in particular to silver salt photothermographic materials used in the field of lithographic printing plates or medical treatment.

BACKGROUND OF THE INVENTION

In the field of graphic arts and medical treatment, there have been concerns in processing of photographic film with respect to effluent produced from wet-processing of image forming materials, and recently, reduction of the processing effluent is strongly demanded in terms of environmental protection and space saving. There has been desired a photothermographic dry imaging material for photographic use, capable of forming distinct black images exhibiting high sharpness, enabling efficient exposure by means of a laser imager or a laser image setter. Known as such a technique are silver salt photothermographic dry imaging materials forming photographic images through thermal processing, as described in U.S. Pat. Nos. 3,152,904 and 3,487,075, and D. H. Klosterboer, "Thermally Processed Silver Systems" in IMAGING PROCESSES and MATERIALS, Neblette's Eighth Edition, edited by J. M. Sturge, V. Walworth, and A. Shepp (1969) page 279.

Such a silver salt photothermographic material comprises a reducible silver source (such as light-insensitive organic silver salts), a catalytic active-amount of a photocatalyst (such as silver halide) and a reducing agent, which are dispersed in an organic binder matrix. The silver salt photothermographic material is stable at ordinary temperature but, when heated at a relative high temperature after exposure, forms metallic silver upon oxidation reduction reaction between the reducible silver source (which acts as an oxidant) and the reducing agent. Recently, studies of silver salt photothermographic materials have proceeded rapidly and photothermographic material satisfying basic performance are commercially available. However, there have arisen new problems, specifically those which concern systems including exposure and processing. Unevenness in density caused in development produces many problems. In the case of use for medical treatment, for example, when diagnosis is made employing a slight density difference, such problems can become quite critical. With regard to a technique for improving unevenness in developed density, a few techniques employing instruments have been reported but an improvements are still desired. Further, in silver salt photothermographic material is pointed out deteriorated image tone due to its development mechanism. Active studies have been made with respect to such problems and many techniques have been reported. However, an acceptable level has not been reached as yet and there is desired a technique for improving unevenness in development.

SUMMARY OF THE INVENTION

Accordingly, new problems have arisen with a system including exposure and development. In addition to the unevenness in density caused during development, unevenness in density caused by density variation after development is also a major problem. Specifically in medical use, when diagnosis is made employing a slight difference in density, the foregoing problems often lead to serious results.

With regard to a technique for improving such density unevenness in development, a few techniques employing instruments have been reported but sufficient improvement has not yet been achieved, and prompt improvement is desired.

Deteriorated image tone which is contemplated to be due to the development mechanism is also pointed out.

Accordingly, it is an object of the present invention to provide a silver salt photothermographic material overcoming the foregoing problems.

The foregoing problems can be solved by the following constitution:

A silver salt photothermographic material comprising on a support (a) a light-insensitive organic silver salt, (b) silver halide and (c) a reducing agent capable of reducing a silver ion of the organic silver salt to silver upon heating, wherein when the photothermographic material having been exposed and thermally processed and having a density of 3.0 is kept at 50° C. and 50% RH for 120 hr., the photothermographic material exhibits a variation of density from 3.0 being within the range of ±0.2.

Furthermore, preferred effects can be achieved by the following embodiments.

(a) The photothermographic material described above, wherein the photothermographic material further comprises a compound represented by formula (1) and the reducing agent capable of reducing a silver ion of the organic silver salt is represented by formula (2) and contained in an amount of 35 to 100 mol %, based on the total organic silver salt, and a molar ratio of the compound represented by formula (2) to the compound represented by formula (1) being 10 to 50:

$$X{=}C{=}N{-}L{-}(N{=}C{=}X)_v \qquad \text{formula (1)}$$

wherein v is 1 or 2; L is a bivalent linkage group having an alkylene group, an alkenylene group, arylene group or an alkylarylenes group; and X is an oxygen atom or a sulfur atom;

formula (2)

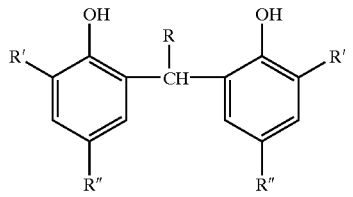

wherein R is a hydrogen atom or an alkyl group having 1 to 10 carbon atoms (such as butyl or 2,4,4-trimethylpentyl); R' and R" are each an alkyl group having 1 to 5 carbon atoms (such as methyl, ethyl or t-butyl).

(b) The photothermographic material described above, wherein the photothermographic material further comprises a compound represented by formula (3) and a compound represented by formula (4):

$$Q\text{-}(Y)_n{-}C(X1)(X2)(X3) \qquad \text{formula (3)}$$

wherein Q is an aryl group or a heterocyclic group; Y is a bivalent linkage group including SO, $SO_2$ or CO; n is 0 or 1; X1, X2 and X3 are each a halogen atom;

$$Q'\text{-}(Y')_n{-}C(X'1)(X'2)(X'3) \qquad \text{formula (4)}$$

wherein Q' is an aryl group or a heterocyclic group; Y' is a bivalent linkage group including SO, $SO_2$ or CO; n is 0 or 1; X'1, X'2 and X'3 are each a hydrogen atom, a halogen atom, a haloalkyl group, an acyl group, an alkoxycarbonyl group, an aryloxycarbonyl group, a carbamoyl group, a sulfamoyl group, a sulfonyl group, or a heterocyclic group, provided that at least one of X'1, X'2 and X'3 is a halogen atom but all of them are not halogen atoms;

(c) The photothermographic material described above, wherein the photothermographic material further comprises a compound represented by formula (5) and a compound represented by formula (6):

$$Q''\text{-}(Y'')_n\text{—}C(X''1)(X''2)(X''3) \qquad \text{formula (5)}$$

wherein Q" is an aryl group or a heterocyclic group; Y" is a bivalent linkage group including SO, $SO_2$ or CO; n is 0 or 1; X"1, X"2 and X"3 are each a hydrogen atom, a bromine atom, a haloalkyl group, an acyl group, an alkoxycarbonyl group, an aryloxycarbonyl group, a carbamoyl group, a sulfamoyl group, a sulfonyl group, or a heterocyclic group, provided that at least one of X"1, X"2 and X"3 is a bromine atom;

$$Q'''\text{-}(Y''')_n\text{—}C(X'''1)(X'''2)(X'''3) \qquad \text{formula (6)}$$

wherein Q"' is an aryl group or a heterocyclic group; Y"' is a bivalent linkage group including SO, $SO_2$ or CO; n is 0 or 1; X"'1, X"'2 and X"'3 are each a chlorine atom, a haloalkyl group, an acyl group, an alkoxycarbonyl group, an aryloxycarbonyl group, a carbamoyl group, a sulfamoyl group, a sulfonyl group, or a heterocyclic group, provided that at least one of X"'1, X"'2 and X"'3 is a chlorine atom.

(d) The photothermographic material described above, wherein the photothermographic material further comprises a silver-saving agent.

(e) The photothermographic material described above, wherein the photothermographic material comprises on the support at least two light-sensitive layers.

(f) An image recording method, wherein when recording an image on the photothermographic material described above, exposure is conducted using a laser light scanning exposure machine of longitudinal multiple laser scanning light.

(g) The photothermographic material, wherein the developed photothermographic material meets the requirement of $190° < h_{ab} < 260°$, in which $h_{ab}$ is a hue angle (as defined in JIS-Z 8729).

(h) The foregoing photothermographic material comprising on a support a) a light-insensitive organic silver salt, b) silver halide and c) a reducing agent capable of reducing a silver ion of the organic silver salt to silver upon heating, wherein the light-sensitive layer is formed by coating a coating solution containing at least 30% by weight of water.

(i) The foregoing photothermographic material comprising on a support a) a light-insensitive organic silver salt, b) silver halide and c) a reducing agent capable of reducing a silver ion of the organic silver salt to silver upon heating, wherein the photothermographic material is allowed to stand at a temperature of not less than 30° C. for 60 to 400 days prior to exposure.

DETAILED DESCRIPTIONS OF THE INVENTION

In the invention, the silver salt photothermographic material comprising on a support a light-insensitive organic silver salt, silver halide and a reducing agent capable of reducing a silver ion of the organic silver salt to silver upon heating. One aspect of the invention is that when the photothermographic material having been exposed and thermally processed and having a density of 3.0 is kept at 50° C. and 50% RH for 120 hrs., the photothermographic material exhibits a variation of density from 3.0 being within the range of ±0.2. Thus, when the photographic material which was exposed to any light source at any intensity so as to give an optical density of 3.0 and thermally processed (i.e., thermally developed), has been kept in an atmosphere of 50° C. and 50% RH for a period of 120 hrs., in a non-contact state (for example, hanging the photographic material by a thread, without contact, in a conditioning room maintained at 50° C. and 50% RH) and when the photothermographic material is subjected to densitometry before and after being kept, the variation in density between before and after being kept is within ±0.2. In other words, after the exposed and processed photothermographic material including a portion having a density of 3.0 have been in an atmosphere of 50° C. and 50% RH for 120 hrs., after being kept, the photothermographic material shows a density within the range of 2.8(=3.0−0.2) to 3.2(=3.0+0.2). Thus, the variation is also represented as the difference in density between before and after being kept (which is represented in term of ΔD), as below:

$$\Delta D = D_1 - D_0, \text{ and } -0.2 \leqq \Delta D \leqq +0.2$$

where the photothermographic material having a density of $D_0$ (=3.0) has been in an atmosphere of 50° C. and 50% RH, and after 50 hrs., the photothermographic material exhibits a density of $D_1$.

To determine the optical density, conventional methods are applicable, such as a method using a commercially available densitometer, e.g., PDA-65 (available from Konica Corp.). Exposure methods including a light source and light intensity and thermal processing methods including temperature are optional and not specifically limited. Exposure using laser light is preferred, and the exposure wavelength is preferably near to the maximum absorption wavelength, and the wavelength region having at least 50% of absorbance at the maximum absorption wavelength is more preferred. The exposure amount is that necessary for sensitivity of the photothermographic material.

Thermal development is preferably conducted at a temperature of 80 to 200° C. over a period of 1 to 120 sec., but it is not necessarily limited to these and can be similarly determined taking account of the foregoing function of temperature and time.

To achieve a silver salt photothermographic material which exhibits a variation at a density of 3.0 being within ±0.2 after being kept under the foregoing condition, various techniques are cited, including addition of a bleaching agent, enhancement of miscibility of an organic acid with a binder, lowering diffusibility of material taking part in development and controlling diffusion of material with a binder.

It is preferred to incorporate a compound represented by the following formula (1):

$$X{=}C{=}N\text{—}L\text{—}(N{=}C{=}X)v \qquad \text{formula (1)}$$

wherein v is 1 or 2; L is a bivalent linkage group having an alkylene, alkenylene, arylene or alkylarylene group; and X is an oxygen atom or a sulfur atom, and L is preferably an alkylene, alkenylene, arylenes, alkylarylene or their combination. An arylene ring of the arylene group may be substituted. Preferred substituents include a halogen atom (e.g., bromine atom, chlorine atom), hydroxy, amino, carboxy, alkyl and alkoxy.

The compound represented by formula (1) is preferably an isocyanate compound and more preferably an isocyanate compound containing at least two isocyanate group and its adduct. Examples thereof include aliphatic isocyanates, alicyclic isocyanates, benzeneisocyanates, naphthalenediisocyanates, biphenyldiisocyanates, diphenylmethandiisocyanates, triphenylmethanediisocyanates, triisocyanates, tetraisocyanates, their adducts and adducts of these isocyanates and bivalent or trivalent polyhydric alcohols. Exemplary examples are isocyanate compounds described in JP-A 56-5535 at pages 10–12, including: ethanediisocyanate, butanediisocyanate, hexanediisocyanate, 2,2-dimetylpentanediisocyanate, 2,2,4-trimethylpentanediisocyanate, decanediisocyanate, ω,ω'-diisocyanate-1,3-dimethylbenzole, ω,ω'-diisocyanate-1,2-dimethylcyclohexane, ω,ω'-diisocyanate-1,4-diethylbenzole, ω,ω'-diisocyanate-1,5-dimethylnaphthalene, ωω'-diisocyanate-n-propypbiphenyl, 1,3-phenylenediisocyanate, 1-methylbenzole-2,4-diisocyanate, 1,3-dimethylbenzole-2,6-diisocyanate, naphthalene-1,4-diisocyanate, 1,1'-naphthyl-2,2'-diisocyanate, biphenyl-2,4'-diisocyanate, 3,3'-dimethylbiphenyl-4,4'-diisocyanate, diphenylmethane-4,4'-diisocyanate, 2,2'-dimethyldiphenylmethane-4,4'-diisocyanate, 3,3'-dimethoxydiphenylmethane-4,4'-diisocyanate, 4,4'-diethoxydiphenylmethane-4,4'-diisocyanate, 1-methylbenzole-2,4,6-triisocyanate, 1,3,5-trimethylbenzene-2,4,6-triisocyanate, diphenylmethane-2,4,4'-triisocyanate, triphenylmethane-4,4',4'-triisocyanate, tolylenediisocyanate, 1,5-naphthylenediisocyanate; dimmer or trimer adducts of these isocyanate compounds (e.g., adduct of 2-mole hexamethylenediisocyanate, adduct of 3 mole hexamethylenediisicyanate, adduct of 2 mole 2,4-tolylenediisocyanate, adduct of 3 mole 2,4-tolylenediisocyanate); adducts of two different isocyanates selected from these isocyanate compounds described above; and adducts of these isocyanate compounds and bivalent or trivalent polyhydric alcohol, (i.e., diol and triol, preferably having up to 20 carbon atoms, such as ethylene glycol, propylene glycol, pinacol, and trimethylol propane), such as adduct of tolylenediisocyanate and trimethylolpropane, or adduct of hexamethylenediisocyanate and trimethylolpropane. Of these, adduct of isocyanate and polyhydric alcohol improves adhesion between layers, exhibiting high capability of preventing layer peeling, image slippage or production of bubbles.

Examples of commercially available isocyanate compounds are shown below, including aliphatic isocyanates, aromatic isocyanates and polymeric isocyanates but are by no means limited to these:

IC-1 Desmodur N100, aliphatic isocyanate, available from Movey Corp.

IC-2 Desmodur N3300, aliphatic isocyanate, available from Movey Corp.

IC-3 Mondur TD-80, aromatic isocyanate, available from Movey Corp.

IC-4 Mondur M, aromatic isocyanate, available from Movey Corp.

IC-5 Mondur MRS, aromatic isocyanate, available from Movey Corp.

IC-6 Desmodur W, aliphatic isocyanate, available from Movey Corp.

IC-7 Papi 27 polymeric isocyanate, available from Movey Corp.

IC-8 Isocyanate Y1890 aliphatic isocyanate, available from Huels.

IC-9 Octadecylisocyanate, aliphatic isocyanate, available from Aldrich Corp.

These polyisocyanate compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus it may be incorporated into one or plurality of these layers.

As a compound represented by formula (1) is also usable in the invention a compound having a thioisocyanate structure, corresponding to the isocyanates described above.

The compound represented by formula (1) is used preferably in an amount of 0.005 to 0.1 mol, and more preferably 0.01 to 0.05 mol per mol of light-insensitive organic silver salt. The compounds may be used in combination within these amounts.

Next, the compound represented by formula (2) will be further described.

formula (2)

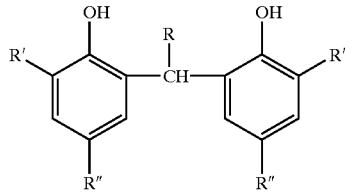

wherein R represents a hydrogen atom or an alkyl group having 1 to 10 carbon atoms (for example, butyl, 2,4,4-trimethylpentyl), and R' and R" each represent an alkyl group having 1 to 5 carbon atoms (for example, methyl, ethyl, t-butyl).

Exemplary examples of the compound represented by formula (2) are shown below but are by no means limited to these examples.

2-1

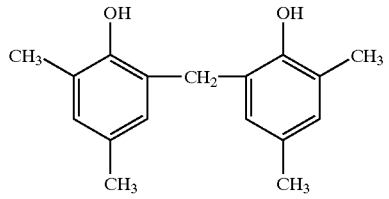

2-2

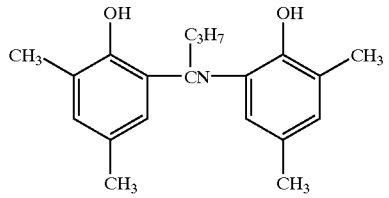

2-3

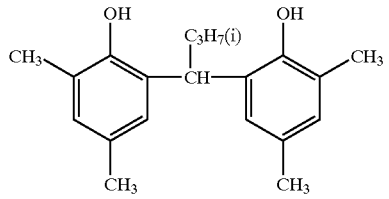

-continued
2-4
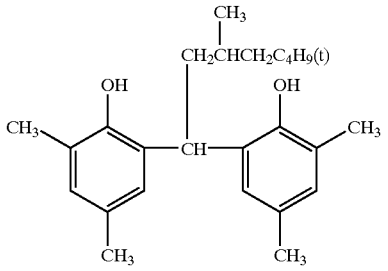
2-5
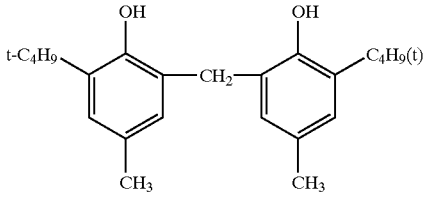
2-6
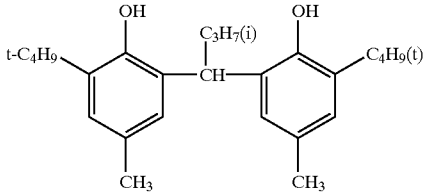
2-7
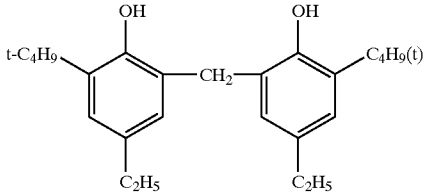
2-8
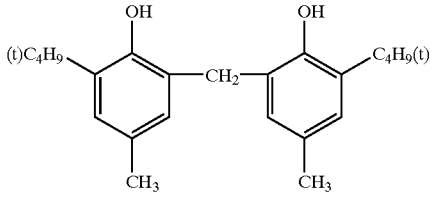
2-9
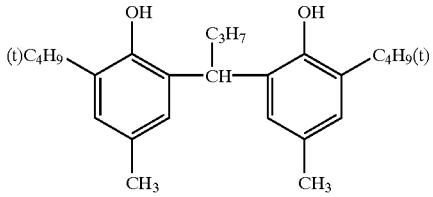
2-10
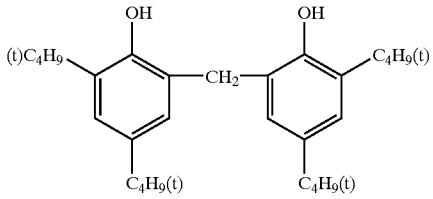
-continued
2-11
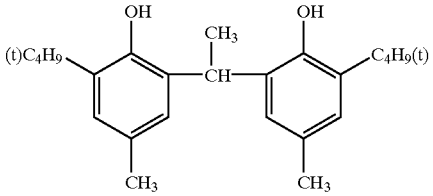
2-12
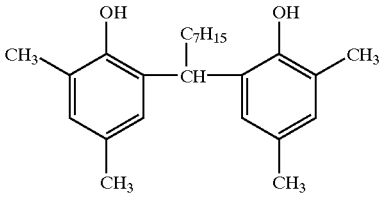
2-13
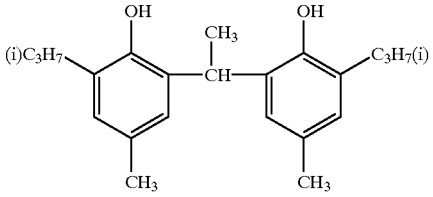
2-14
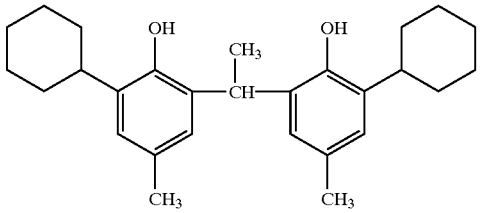
2-15
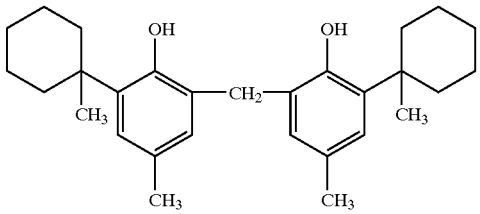
2-16
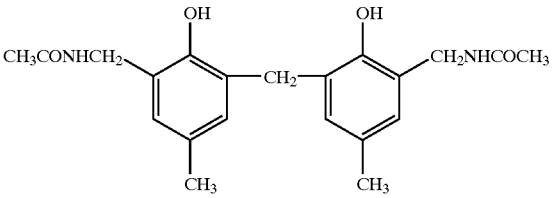
2-17
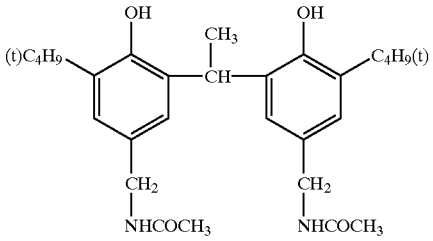

-continued 2-18

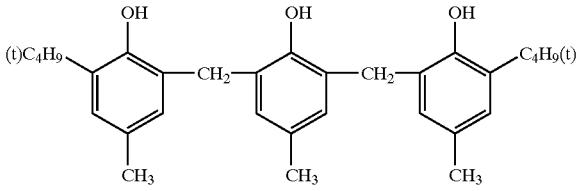

2-19

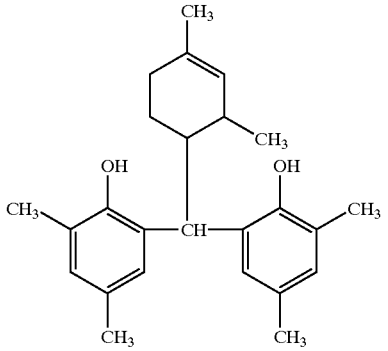

2-20

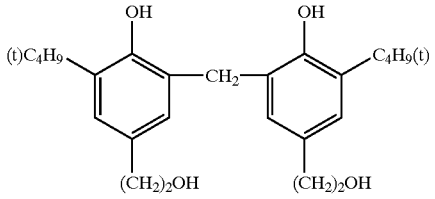

The compound represented by formula (2) is used preferably in an amount of 35 to 100 mol %, and more preferably 40 to 60 mol % of the total amount of the light-insensitive organic silver salt contained in the photothermographic material. Further, the molar ratio of the compound of formula (2) to the compound of formula (1) is preferably 10 to 50, and more preferably 15 to 30.

The compounds of formula (2) may be used in combination within the foregoing amounts. It is preferred to add the compound to a light-sensitive emulsion containing light-sensitive silver halide, organic silver salt particles and a solvent immediately before coating, in terms of less variation due to standing time. These compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus, it may be incorporated into one or plurality of these layers.

The compound represented by formula (3) is shown below:

$$Q\text{-}(Y)_n\text{—}C(X1)(X2)(X3) \qquad \text{formula (3)}$$

wherein Q is an aryl group or a heterocyclic group; X1, X2 and X3 are each a halogen atom; Y is a bivalent linkage group having —C(=O)—, —SO— or —$SO_2$—, preferably —C(=O)—, —SO— or —$SO_2$—, and more preferably —$SO_2$—; n is 0 or 1, and preferably 1.

The aryl group represented by Q may be a monocyclic ring or a condensed ring, and preferably a monocyclic or dicyclic aryl group having 6 to 30 carbon atoms (such as phenyl or naphthyl), more preferably phenyl or naphthyl group, and still more preferably a phenyl group.

The heterocyclic group represented by formula Q is a saturated or unsaturated, 3- to 10-membered heterocyclic group containing at least one of N, O and S, which may be a monocyclic ring or may form a condensed ring with another ring. The heterocyclic ring is preferably a 5- or 6-membered unsaturated heterocyclic group, which may be condensed; more preferably a 5- or 6-membered, aromatic heterocyclic group, which may be condensed; still more preferably a 5- or 6-membered, nitrogen-containing aromatic heterocyclic group, which may be condensed; and most preferably a 5- or 6-membered, 1 to 4 nitrogen atom-containing aromatic heterocyclic group, which may be condensed. Preferred examples of such a heterocyclic group include imidazole, pyrazole, pyridine, pyrimidine, pyrazine, pyridazine, triazole, triazine, indole, indazole, purine, thiadiazole, oxadiazole, quinoline, phthalazine, naphthylizine, quinoxaline, quinazilone, cinnoline, pteridine, acridine, phenathroline, phenazine, tetrazole, thiazole, oxazole, benzimidazole, benzoxazole, benzthiazole, indolenine and tetrazaindene. Of these, imidazole, pyridine, pyrimidine, pyrazine, pyridazine, triazole, triazine, thiadiazole, oxadiazole, quinoline, phthalazine, naphthylizine, quinoxaline, quinazoline, cinnoline, tetrazole, thiazole, oxazole, benzimidazole, benzoxazole, benzthiazole, indolenine and tetrazaindene are more preferred; imidazole, pyridine, pyrimidine, pyrazine, pyridazine, triazole, triazine, thiadiazole, quinoline, phthalazine, naphthylizine, quinoxaline, quinazoline, cinnoline, tetrazole, thiazole, oxazole, benzimidazole, and benzthiazole are still more preferred; and pyridine, thiadiazole, quinoline and benzthiazole are specifically preferred. The aryl group or heterocyclic group represented by Q may be substituted by a substituent group, other than —Y—C(X1)(X2)(X3). Preferred examples of the substituent group include an alkyl group, alkenyl group, aryl group, alkoxy group, aryloxy group, acyl group, alkoxycarbonyl group, aryloxycarbonyl group, acyloxy group, acylamino group, alkoxycarbonylamino group, aryloxycarbonylamino group, sulfonylamino group, sulfamoyl group, carbamoyl group, sulfonyl group, ureido group, phosphoric acid amide group, halogen atom, cyano group, sulfo group, carboxyl group, nitro group, and heterocyclic group. Of these, an alkyl group, aryl group, alkoxy group, aryloxy group, acyl group, acylamino group, alkoxycarbonylamino group, aryloxycarbonylamino group, sulfonylamino group, sulfamoyl group, carbamoyl group, sulfonyl group, ureido group, phosphoric acid amide group, halogen atom, cyano group, nitro group, and heterocyclic group are more preferred; and an alkyl group, aryl group, alkoxy group, aryloxy group, acyl group, acylamino group, sulfonylamino group, sulfamoyl group, carbamoyl group, halogen atom, cyano group, nitro group, and heterocyclic group are still more preferred; an alkyl group, aryl group and a halogen atom are specifically preferred.

X1, X2 and X3 each represent a halogen atom, preferably a chlorine, bromine, or iodine atom, and more preferably chlorine or bromine atom, and still more preferably a bromine atom.

Exemplary examples of the compound represented by formula (3) are shown below, but are not limited to these examples.

3-1
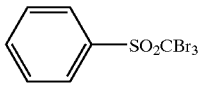
3-2
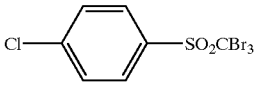
3-3
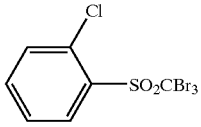
3-4
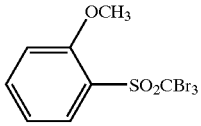
3-5
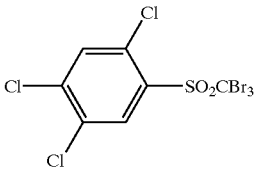
3-6
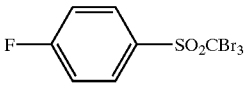
3-7
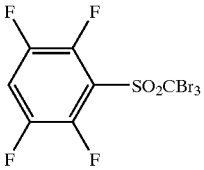
3-8
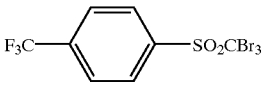
3-9
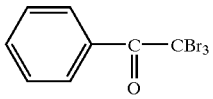
3-10
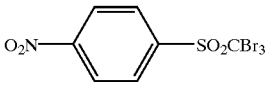
3-11
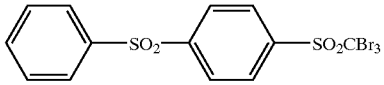
3-12
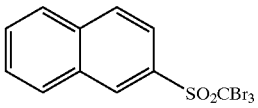
3-13
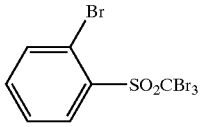
-continued
3-14
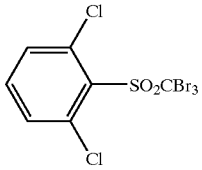
3-15
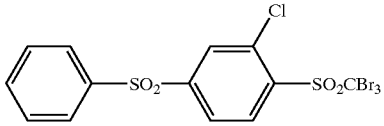
3-16
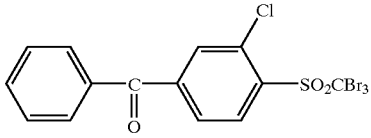
3-17
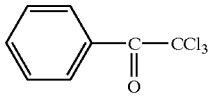
3-18
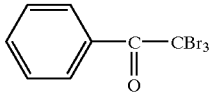
3-19
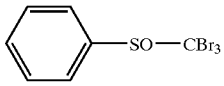
3-20
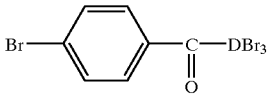
3-21
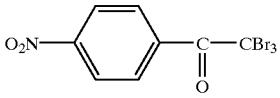
3-22
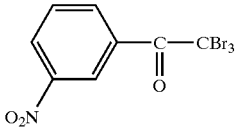
3-23
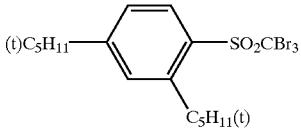
3-24
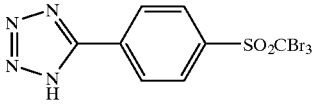
3-25
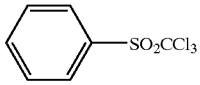
3-26
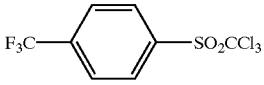

-continued
3-27
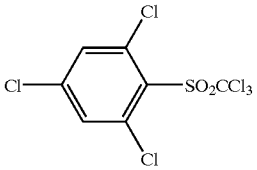
3-28
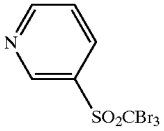
3-29
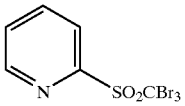
3-30
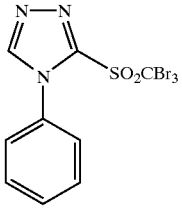
3-31
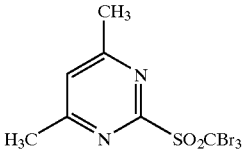
3-32
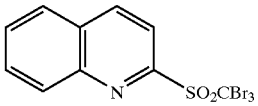
3-33
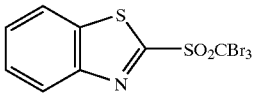
3-34
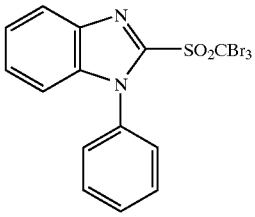
3-35
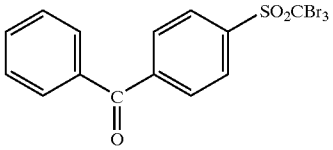
3-36
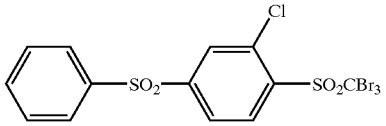
-continued
3-37
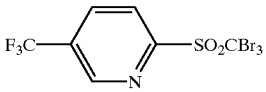
3-38
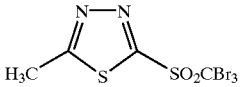
3-39
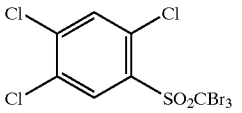
3-40
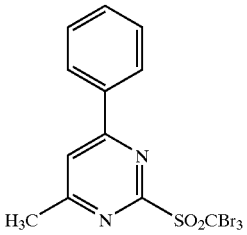
3-41
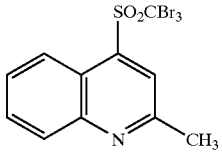
3-42
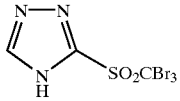
3-43
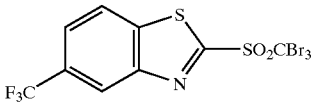
3-44
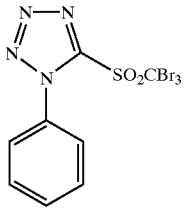
3-45
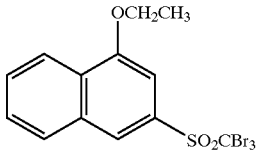
3-46
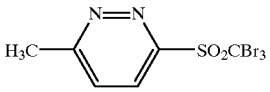
3-47
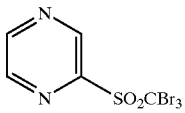

-continued 3-48

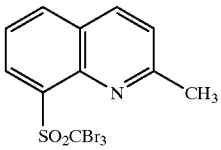

3-49

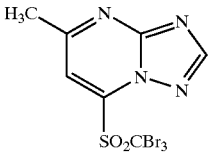

3-50

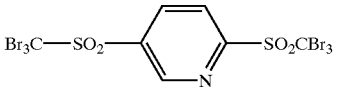

3-51

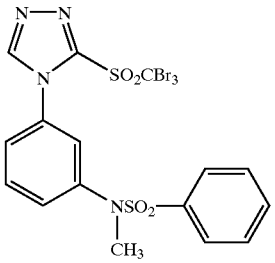

3-52

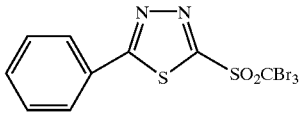

3-53

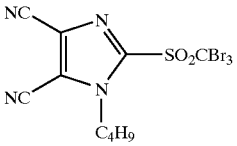

These compounds may be incorporated alone or in combination. The compound is preferably incorporated in an amount of 0.001 to 0.1 mol, and more preferably 0.01 to 0.07 mol per mol of light-insensitive organic silver salt. These compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus, it may be incorporated into one or plurality of these layers.

Next, the compound represented by formula (4) will be described:

$$Q'\text{-}(Y')_n\text{—}C(X'1)(X'2)(X'3) \qquad \text{formula (4)}$$

wherein Q' is an aryl group or a heterocyclic group; Y' is a bivalent linkage group including SO, $SO_2$ or CO, preferably —SO—, —$SO_2$— or —CO—, and more preferably —CO—; n is 0 or 1, and preferably 1; X'1, X'2 and X'3 are each a hydrogen atom, a halogen atom, a haloalkyl group, an acyl group, an alkoxycarbonyl group, an aryloxycarbonyl group, a carbamoyl group, a sulfamoyl group, a sulfonyl group, or a heterocyclic group, provided that at least one of X'1, X'2 and X'3 is a halogen atom but all of them are not halogen atoms at the same time. Of halogen atoms, chlorine, bromine or iodine atom is preferred, chlorine or bromine atom is more preferred and a bromine atom is still more preferred.

Q' and Y' of formula (4) are the same as defined in Q and Y of formula (3) described earlier.

Exemplary examples of the compound represented by formula (4) are shown below, but are not limited to these examples.

4-1

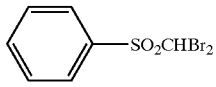

4-2

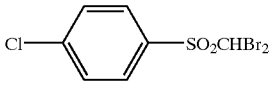

4-3

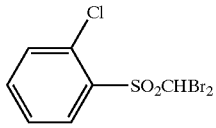

4-4

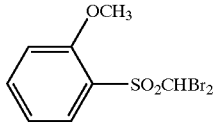

4-5

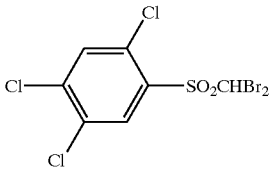

4-6

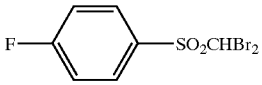

4-7

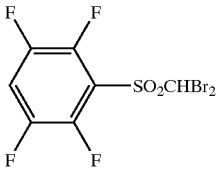

4-8

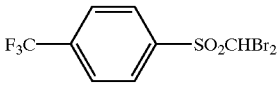

4-9

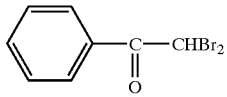

4-10

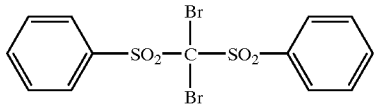

4-11

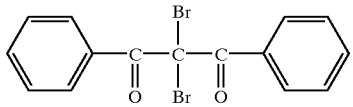

4-12

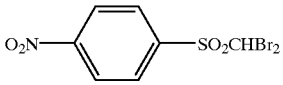

-continued
4-13
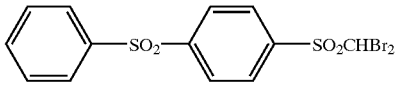
4-14
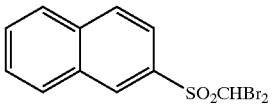
4-15
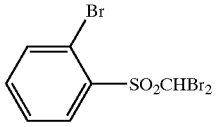
4-16
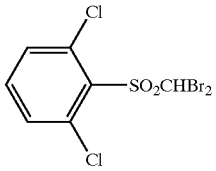
4-17
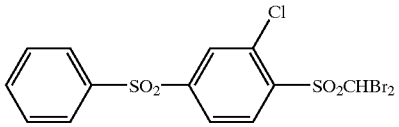
4-18
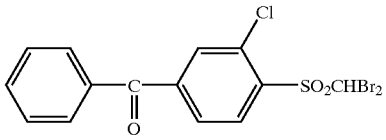
4-19
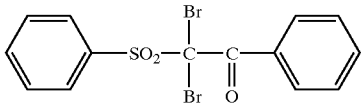
4-20
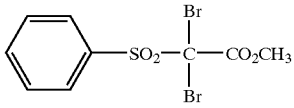
4-21
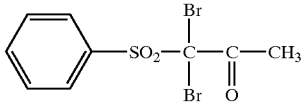
4-22
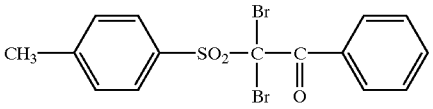
4-23
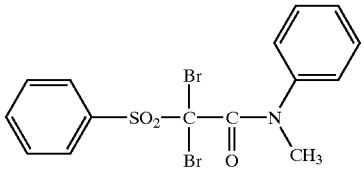
4-24
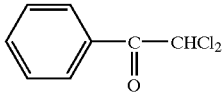
-continued
4-25
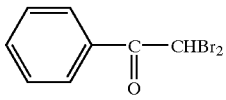
4-26
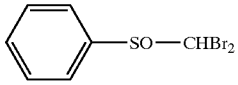
4-27
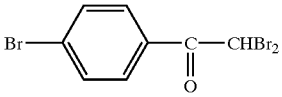
4-28
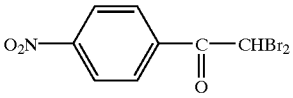
4-29
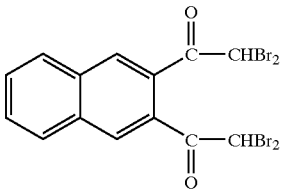
4-30
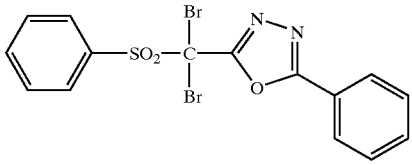
4-31
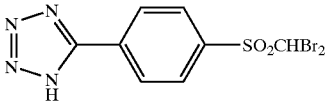
4-32
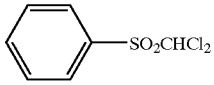
4-33
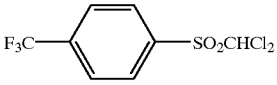
4-34
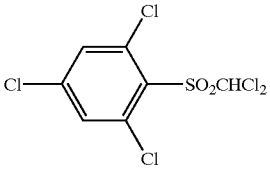
4-35
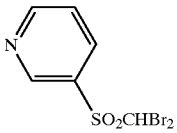
4-36
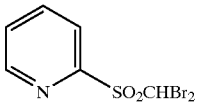

-continued
4-37
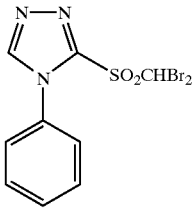
4-38
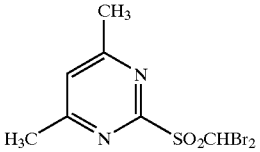
4-39
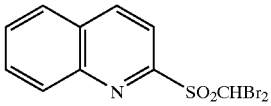
4-40
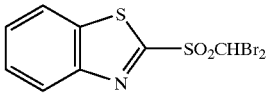
4-41
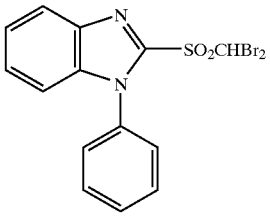
4-42
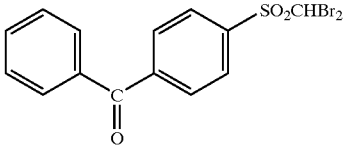
4-43
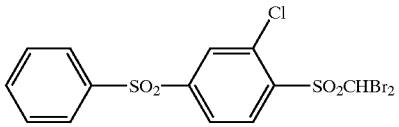
4-44
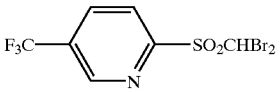
4-45
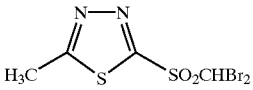
4-46
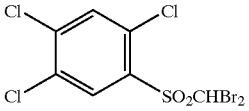
-continued
4-47
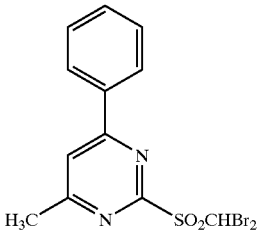
4-48
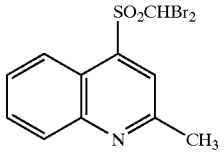
4-49
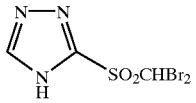
4-50
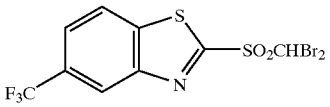
4-51
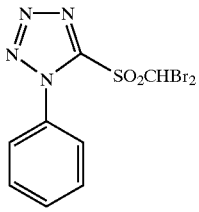
4-52
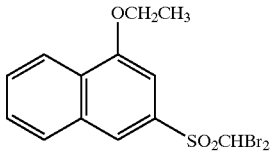
4-53
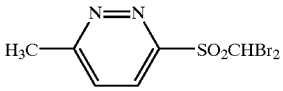
4-54
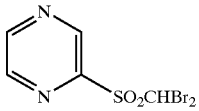
4-55
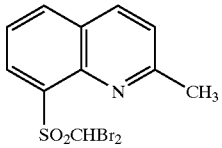
4-56
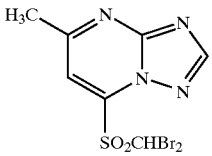

-continued 4-57

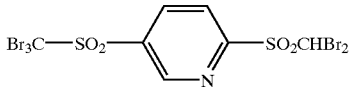

4-58

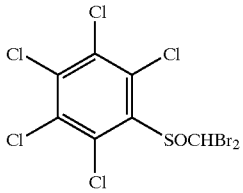

4-59

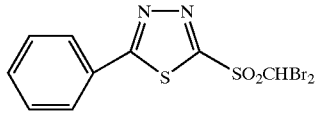

These compounds may be incorporated alone or in combination. The compound is preferably incorporated in an amount of 0.001 to 0.1 mol, and more preferably 0.01 to 0.07 mol per mol of light-insensitive organic silver salt. These compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus, it may be incorporated into one or plurality of these layers.

Next, the compound represented by the following formula (5) will be described:

$$Q''\text{-}(Y'')_n\text{—}C(X''1)(X''2)(X''3) \qquad \text{formula (5)}$$

wherein Q" is an aryl group or a heterocyclic group; Y" is a bivalent linkage group including SO, $SO_2$ or CO, and preferably —SO—, —$SO_2$— or —CO—; n is 0 or 1 and preferably 1; X"1, X"2 and X"3 are each a hydrogen atom, a bromine atom, a haloalkyl group, an acyl group, an alkoxycarbonyl group, an aryloxycarbonyl group, a carbamoyl group, a sulfamoyl group, a sulfonyl group, or a heterocyclic group, provided that at least one of X"1, X"2 and X"3 is a bromine atom.

Q" and Y" of formula (5) are the same as defined in Q and Y of formula (3) described earlier.

Exemplary examples of the compound represented by formula (5) are shown below, but are not limited to these examples.

5-1

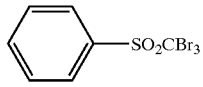

5-2

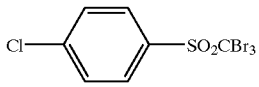

-continued 5-3

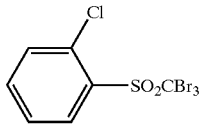

5-4

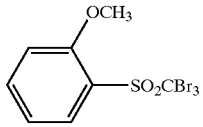

5-5

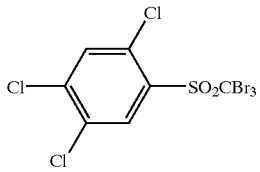

5-6

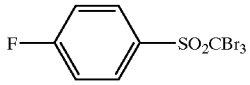

5-7

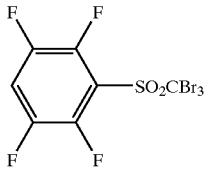

5-8

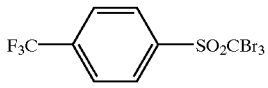

5-9

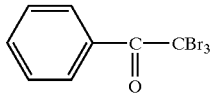

5-10

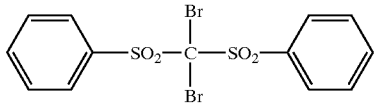

5-11

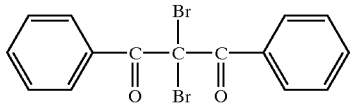

5-12

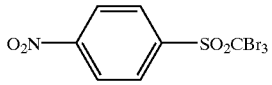

5-13

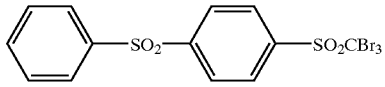

5-14

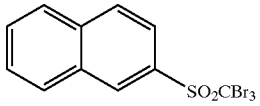

-continued
5-15
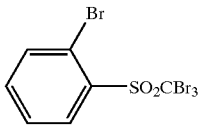
5-16
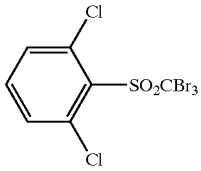
5-17
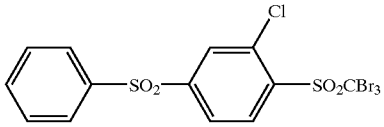
5-18
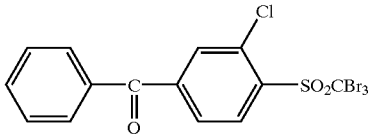
5-19
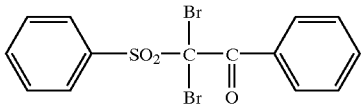
5-20
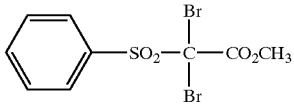
5-21
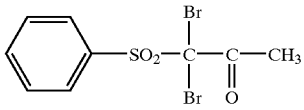
5-22
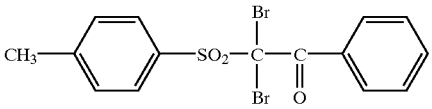
5-23
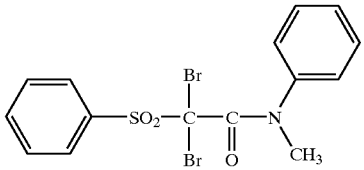
5-24
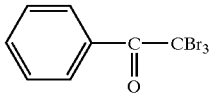
5-25
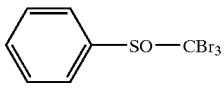
5-26
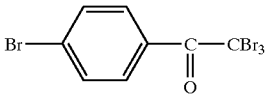
-continued
5-27
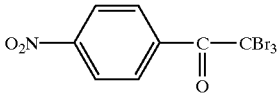
5-28
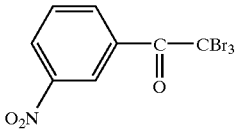
5-29
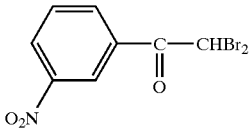
5-30
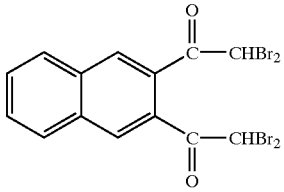
5-31
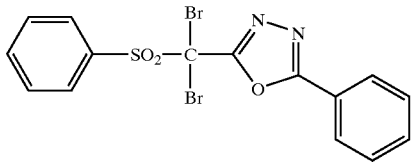
5-32
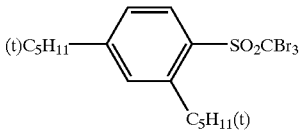
5-33
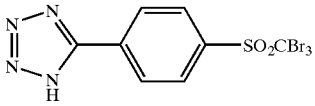
5-34
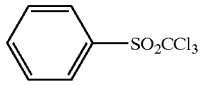
5-35
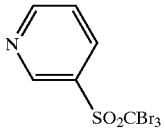
5-36
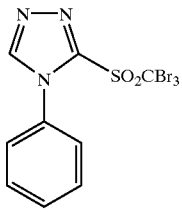

-continued
5-37
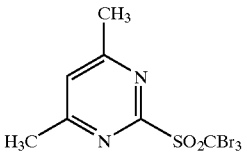
5-38
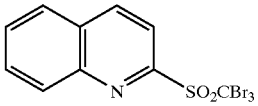
5-39
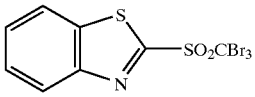
5-40
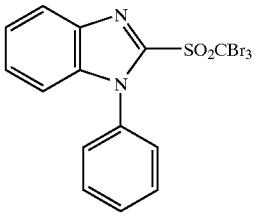
5-41
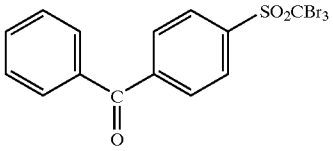
5-42
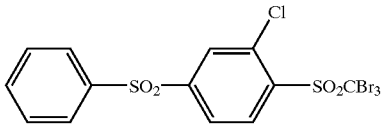
5-43
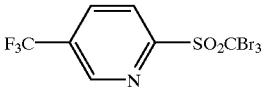
5-44
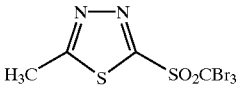
5-45
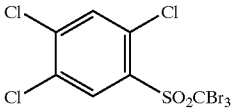
5-46
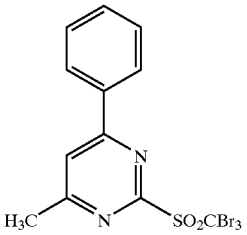
-continued
5-47
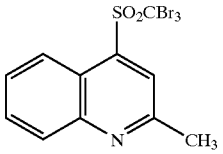
5-48
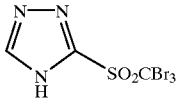
5-49
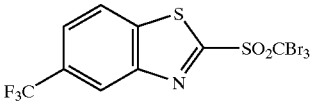
5-50
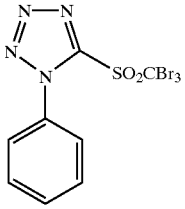
5-51
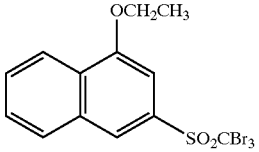
5-52
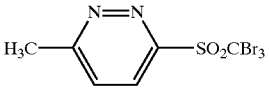
5-53
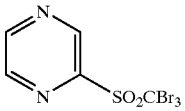
5-54
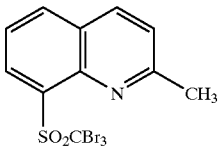
5-55
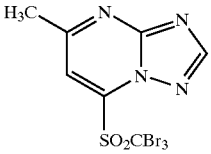
5-56
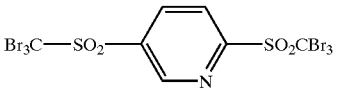

-continued 5-57

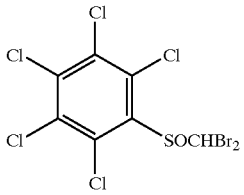

5-58

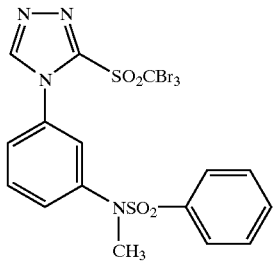

5-59

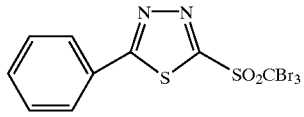

5-60

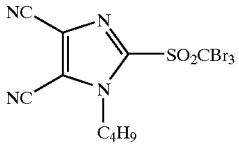

5-61

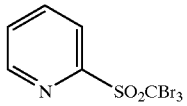

These compounds may be incorporated alone or in combination. The compound is preferably incorporated in an amount of 0.001 to 0.1 mol, and more preferably 0.01 to 0.07 mol per mol of light-insensitive organic silver salt. These compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus, it may be incorporated into one or plurality of these layers.

Next, the compound represented by the following formula (6) will be described:

$$Q'''\text{-}(Y''')_n\text{—}C(X'''1)(X'''2)(X'''3) \qquad \text{formula (6)}$$

wherein Q''' is an aryl group or a heterocyclic group; Y''' is a bivalent linkage group including SO, $SO_2$ or CO, and preferably —SO—, —$SO_2$— or —CO—; n is 0 or 1, and preferably 1; X'''1, X'''2 and X'''3 are each a chlorine atom, a haloalkyl group, an acyl group, an alkoxycarbonyl group, an aryloxycarbonyl group, a carbamoyl group, a sulfamoyl group, a sulfonyl group, or a heterocyclic group, provided that at least one of X'''1, X'''2 and X'''3 is a chlorine atom. Q''' and Y''' of formula (6) are the same as defined in Q and Y of formula (3), as described earlier.

Exemplary examples of the compound represented by formula (5) are shown below, but are not limited to these examples.

6-1

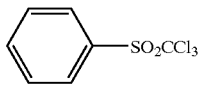

6-2

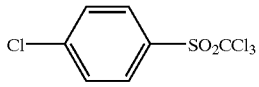

6-3

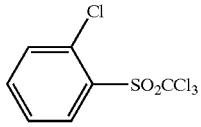

6-4

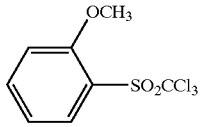

6-5

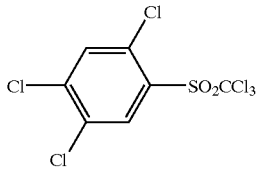

6-6

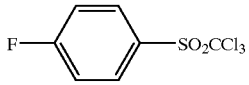

6-7

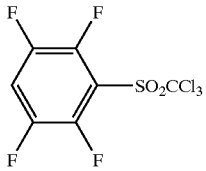

6-8

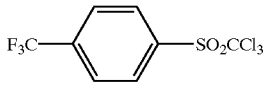

6-9

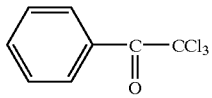

6-10

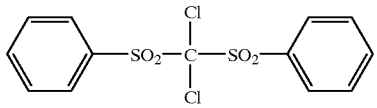

6-11

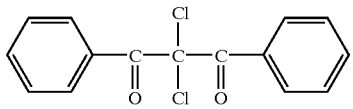

6-12

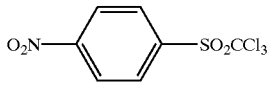

6-13

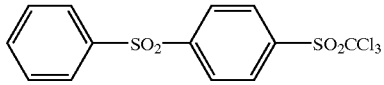

-continued
6-14
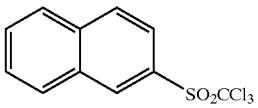
6-15
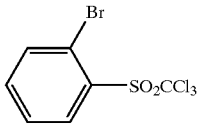
6-16
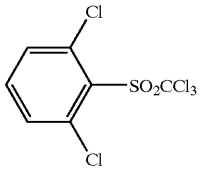
6-17
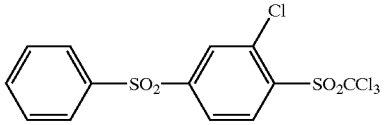
6-18
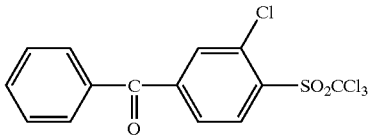
6-19
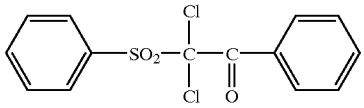
6-20
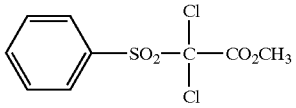
6-21
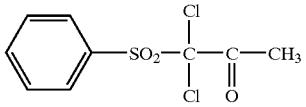
6-22
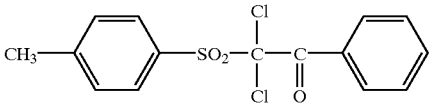
6-23
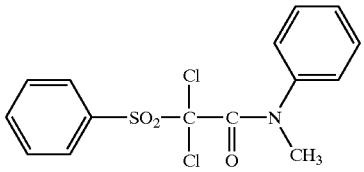
6-24
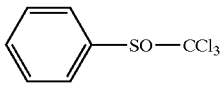
6-25
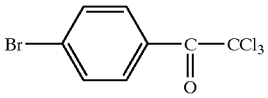
-continued
6-26
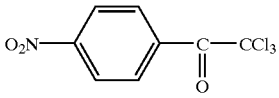
6-27
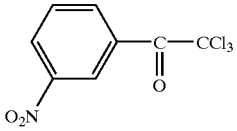
6-28
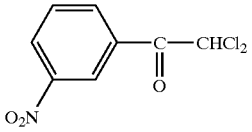
6-29
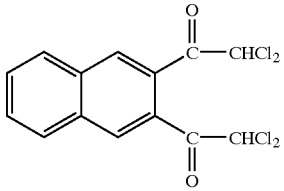
6-30
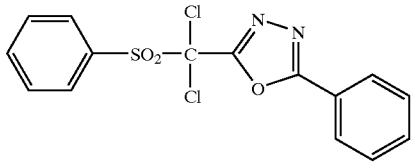
6-31
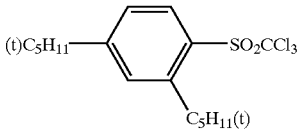
6-32
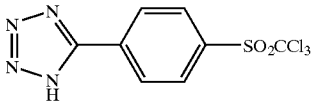
6-33
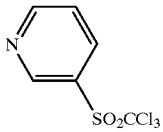
6-34
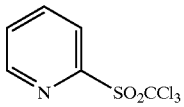
6-35
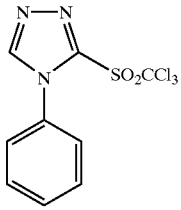

-continued
6-36
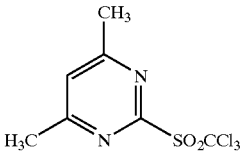
6-37
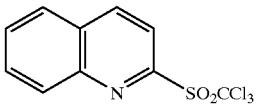
6-38
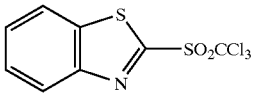
6-39
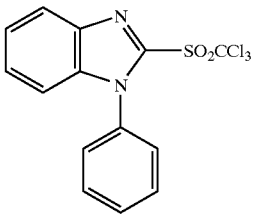
6-40
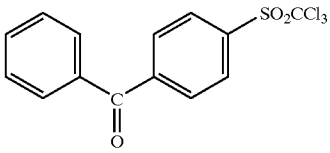
6-41
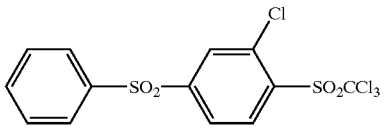
6-42
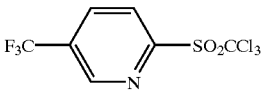
6-43
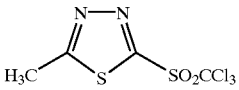
6-44
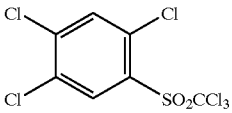
6-45
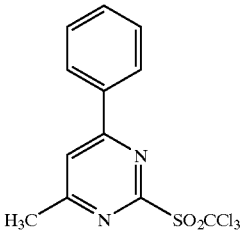
-continued
6-46
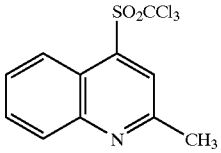
6-47
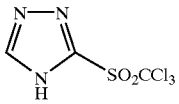
6-48
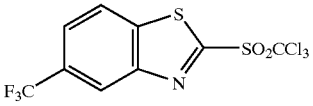
6-49
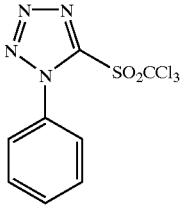
6-50
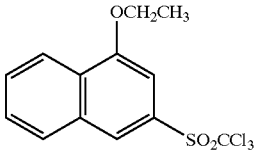
6-51
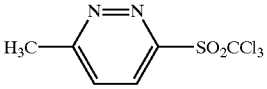
6-52
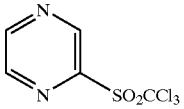
6-53
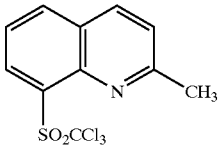
6-54
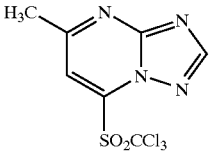
6-55
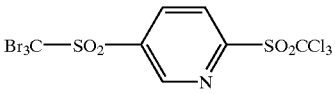

-continued 6-56

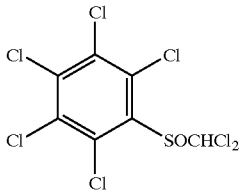

6-57

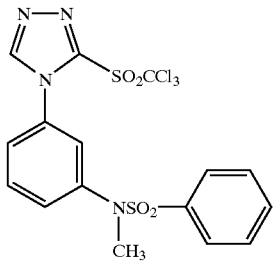

6-58

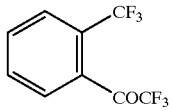

6-59

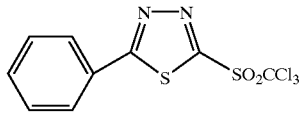

6-60

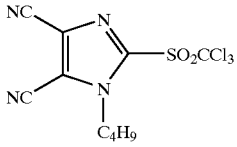

These compounds may be incorporated alone or in combination. The compound is preferably incorporated in an amount of 0.001 to 0.1 mol, and more preferably 0.01 to 0.07 mol per mol of light-insensitive organic silver salt. These compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus, it may be incorporated into one or plurality of these layers.

Aging Prior to Exposure

Allowing the photothermographic material relating to the invention to age at 30° C. for a period of 60 to 400 days prior to exposure leads to improvements in unevenness in development and enhanced stability or superiority of image tone. The foregoing aging condition is preferably not more than 20° C. and preferably 150 to 350 days.

Silver-Saving Agent

The silver-saving agent used in the invention refers to a compound capable of reducing the silver amount necessary to obtain a prescribed silver density. The action mechanism for the reducing function has been variously supposed and compounds having a function of enhancing covering power of developed silver are preferred. Herein the covering power of developed silver refers to an optical density per unit amount of silver. Examples of the preferred silver-saving agent include hydrazine derivative compounds represented by the following formula [H], vinyl compounds represented by formula (G) and quaternary onium compounds represented by formula (P):

formula [H]

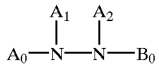

In formula [H], $A_0$ is an aliphatic group, aromatic group, heterocyclic group, each of which may be substituted, or $-G_0-D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, $—C(=NG_1D_1)—$, —SO—, $—SO_2—$ or $—P(O)(G_1D_1)—$ group, in which $G_1$ is a bond, or a —O—, —S— or $—N(D_1)—$ group, in which $D_1$ is a hydrogen atom, or an aliphatic group, aromatic group or heterocyclic group, provided that when a plural number of $D_1$ are present, they may be the same with or different from each other and $D_0$ is a hydrogen atom, an aliphatic group, aromatic group, heterocyclic group, amino group, alkoxy group, aryloxy group, alkylthio group or arylthio group; and $D_0$ is preferably a hydrogen atom, an alkyl group, an alkoxy group or an amino group.

In formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfo-oxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ is preferably a monocyclic or condensed-polycyclic one containing at least one heteroatom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. The aromatic group, heterocyclic group or $-G_0-D_0$ group represented by $A_0$ each may be substituted. Specifically preferred $A_0$ is an aryl group or $-G_0-D_0$ group.

$A_0$ contains preferably a non-diffusible group or a group for promoting adsorption to silver halide. The non-diffusible group preferably is a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert.

The group for promoting adsorption to silver halide includes a thioureido group, thiourethane, mercapto group, thioether group, thione group, heterocyclic group, thioamido group, mercapto-heterocyclic group or a adsorption group as described in JP A 64-90439.

In Formula (H), $B_0$ is a blocking group, and preferably $-G_0-D_0$, wherein $G_0$ is a —CO—, —COCO—, —CS—, $—C(=NG_1D_1)—$, —SO—, $—SO_2—$ or $—P(O)(G_1D_1)—$ group, and preferred $G_0$ is a —CO—, —COCOA—, in which $G_1$ is a linkage, or a —O—, —S— or $—N(D_1)—$ group, in which $D_1$ represents a hydrogen atom, or an aliphatic group, aromatic group or heterocyclic group, provided that when a plural number of $D_1$ are present, they may be the same with or different from each other. $D_0$ is an aliphatic group, aromatic group, heterocyclic group, amino group, alkoxy group or mercapto group, and preferably, a hydrogen atom, or an alkyl, alkoxy or amino group. $A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxaly).

More preferred hydrazine compounds are represented by the following formulas (H-1), (H-2), (H-3) and (H-4): formula (H-1)

formula (H-1)

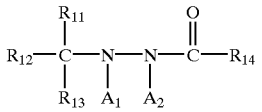

formula (H-2)

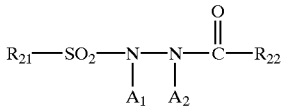

formula (H-3)

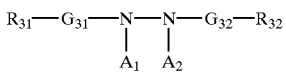

formula (H-4)

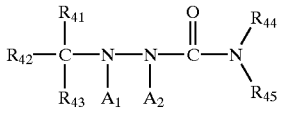

In formula (H-1), $R_{11}$, $R_{12}$ and $R_{13}$ are each a substituted or unsubstituted aryl group or substituted or unsubstituted heteroaryl group (i.e., an aromatic heterocyclic group). Examples of the aryl group represented by $R_{11}$, $R_{12}$ or $R_{13}$ include phenyl, p-methylphenyl and naphthyl and examples of the heteroaryl group include a triazole residue, imidazole residue, pyridine residue, furan residue and thiophene residue. $R_{11}$, $R_{12}$ or $R_{13}$ may combine together with each other through a linkage group. Substituents which $R_{11}$, $R_{12}$ or $R_{13}$ each may have include, for example, an alkyl group, an alkenyl group, an alkynyl group, an aryl group, a heterocyclic group, a quaternary nitrogen containing heterocyclic group, hydroxy, an alkoxy group (including containing a repeating unit of ethyleneoxy or propyleneoxy), an aryloxy group, an acyloxy group, an acyl group, an alkoxycarbonyl group, an aryloxycarbonyl group, a carbamoyl group, a urethane group, carboxy, an imido group, an amino group, a carbonamido group, a sulfonamido group, a ureido group, a thioureido group, a sulfamoylamino group, semicarbazido group, thiosemicarbazido group, hydrazine group, a quaternary ammonio group, an alkyl-, aryl- or heterocyclic-thio group, mercapto group, an alkyl- or aryl-sufonyl group, an alkyl- or aryl-sulfinyl group, sulfo group, sulfamoyl group, an acylsufamoyl group, an alkyl or aryl-sulfonylureido group, an alkyl- or aryl-sulfonylcarbamoyl group, a halogen atom, cyano, nitro, and phosphoric acid amide group. All of $R_{11}$, $R_{12}$ and $R_{13}$ are preferably phenyl groups and more preferably unsubstituted phenyl groups.

$R_{14}$ is heterocyclic-oxy group or a heteroarylthio group. Examples of the heteroaryl group represented by $R_{14}$ include a pyridyloxy group, benzimidazolyl group, benzothiazolyl group, benzimidazolyloxy group, furyloxy group, thienyloxy group, pyrazolyloxy group, and imidazolyloxy group; and examples of the the heteroarylthio group include a pyridylthio group, pyrimidylthio group, indolylthio group, benzothiazolylthio, benzoimidazolylthio group, furylthio group, thienylthio group, pyrazolylthio group, and imidazolylthio group. $R_{14}$ is preferably a pyridyloxy or thienyloxy group.

$A_1$ and $A_2$ are both hydrogen atoms, or one of them is a hydrogen atom and the other is an acyl group (e.g., acetyl, trifluoroacetyl, benzoyl, etc.), a sulfonyl (e.g., methanesulfonyl, toluenesulfonyl, etc.), or oxalyl group (e.g., ethoxalyl, etc.). $A_1$ and $A_2$ are both preferably hydrogen atoms.

In formula (H-2), $R_{21}$ is a substituted or unsubstituted alkyl group, aryl group or heteroaryl group. Examples of the alkyl group represented by $R_{21}$ include methyl, ethyl, t-butyl, 2-octyl, cyclohexyl, benzyl, and diphenylmethyl; the aryl group, the heteroaryl group and the substituent groups are the same as defined in $R_{11}$, $R_{12}$ and $R_{13}$. In cases where $R_{21}$ is substituted, the substituent groups are the same as defined in $R_{11}$, $R_{12}$ and $R_{13}$. $R_{21}$ is preferably an aryl group or a heterocyclic group, and more preferably a phenyl group.

$R_{22}$ is a hydrogen atom, an alkylamino group, an arylamino group, or heteroarylamino group. Examples thereof includemethylamino, ethylamino, propylamino, butylamino, dimethylamino, diethylamino, and ethylmethylamino. Examples of the arylamino group include an anilino group; examples of the heteroaryl group include thiazolylamino, benzimidazolylamino and benzthiazolylamino. $R_{22}$ is preferably dimethylamino or diethylamino. $A_1$ and $A_2$ are the same as defined in formula (H-1).

In formula (H-3), $R_{31}$ and $R_{32}$ are each a univalent substituent group and the univalent substituent groups represented by $R_{31}$ and $R_{32}$ are the same as defined in $R_{11}$, $R_{12}$, and $R_{13}$ of formula (H-1), preferably an alkyl group, an aryl group, a heteroaryl group, an alkoxy group and an amino group, more preferably an aryl group or an alkoxy group, and specifically preferably, at least one of $R_{31}$ and $R_{32}$ t-butoxy and another preferred structure is that when $R_{31}$ is phenyl, $R_{32}$ is t-butoxycarbonyl. $G_{31}$ and $G_{32}$ are each a —(CO)p— or —C(=S)— group, a sulfonyl group, a sulfoxy group, a —P(=O)$R_{33}$— group, or an iminomethylene group, in which $R_{33}$ is an alkyl group, an alkenyl group, an alkynyl group, an aryl group, an alkoxy group, an alkenyloxy group, an alkynyloxy group, an arylamino group or an amino group, provided that when $G_{31}$ is a sulfonyl group, $G_{32}$ is not a carbonyl group. $G_{31}$ and $G_{32}$ are preferably —CO—, —COCO—, a sulfonyl group or —CS—, and more preferably —CO— or a sulfonyl group. $A_1$ and $A_2$ are the same as defined in $A_1$ and $A_2$ of formula (H-1).

In formula (H-4), $R_{41}$, $R_{42}$ and $R_{43}$ are the same as defined in $R_{11}$, $R_{12}$ and $R_{13}$. $R_{41}$, $R_{42}$ and $R_{43}$ are preferably substituted or unsubstituted phenyl group, and more preferably all of $R_{41}$, $R_{42}$ and $R_{43}$ are an unsubstituted phenyl group. $R_{44}$ and $R_{45}$ are each an unsubstituted alkyl group and examples thereof include methyl, ethyl, t-butyl, 2-octyl, cyclohexyl, benzyl, and diphenylmethyl. $R_{44}$ and $R_{45}$ are preferably ethyl. $A_1$ and $A_2$ are the same as defined in $A_1$ and $A_2$ of formula (H-1).

The compounds of formulas (H-1) through (H-4) can be readily synthesized in accordance with methods known in the art, as described in, for example, U.S. Pat. Nos. 5,467,738 and 5,496,695.

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11. These hydrazine derivatives can be synthesized in accordance with commonly known methods.

h-1

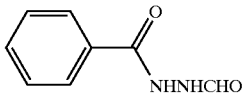

h-2

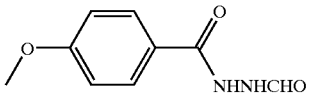

h-3

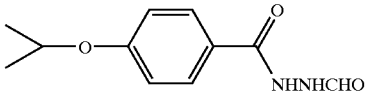

h-4

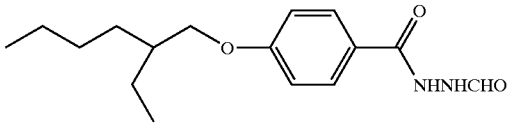

h-5

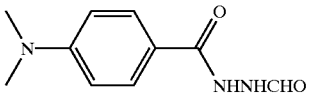

h-6

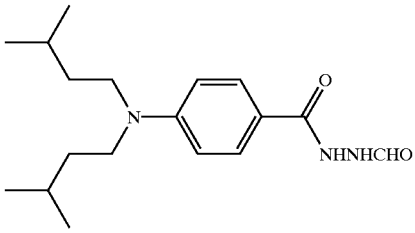

Next, the compound represented by the following formula (G) will be described:

formula (G)

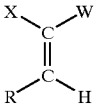

In formula (G), X and R may be either cis-form or trans-form. The structure of its exemplary compounds is also similarly included.

In formula (G), X is an electron-with drawing group; W is a hydrogen atom, an alkyl group, alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfamoyl group, a thiosulfamoyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group.

R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group (e.g., sodium salt, potassium salt, silver salt, etc.), an amino group, a cyclic amino group (e.g., pyrrolidine), an acylamino group, an oxycarbonylamino group, a heterocyclic group (5- or 6-membered nitrogen containing heterocyclic group such as benztriazolyl, imidazolyl, triazolyl, or tetrazolyl), a ureido group, or a sulfonamido group. X and W, or X and R may combine together with each other to form a ring. Examples of the ring formed by X and W include pyrazolone, pyrazolidinone, cyclopentadione, β-ketolactone, and β-ketolactam.

In formula (G), the electron-withdrawing group represented by X refers to a substituent group exhibiting a negative Hammett's substituent constant σp. Examples thereof include a substituted alkyl group (e.g., halogen-substituted alkyl, etc.), a substituted alkenyl group (e.g., cyanoalkenyl, etc.), a substituted or unsubstituted alkynyl group (e.g., trifluoromethylacetylenyl, cyanoacetylenyl, etc.), a substituted or unsubstituted heterocyclic group (e.g., pyridyl, triazyl, benzoxazolyl, etc.), a halogen atom, an acyl group (e.g., acetyl, trifluoroacetyl, formyl, etc.), thioacetyl group (e.g., thioacetyl, thioformyl, etc.), an oxalyl group (e.g., methyloxalyl, etc.), an oxyoxalyl group (e.g., ethoxalyl, etc.), a thiooxalyl group (e.g., ethylthiooxalyl, etc.), an oxamoyl group (e.g., methyloxamoyl, etc.), an oxycarbonyl group (e.g., ethoxycarbonyl, etc.), carboxy group, a thiocarbonyl group (e.g., ethylthiocarbonyl, etc.), a carbamoyl group, a thiocarbamoyl group, a sulfonyl group, a sulfinyl group, an oxysulfonyl group (e.g., ethoxysulfonyl), a thiosulfonyl group (e.g., ethylthiosulfonyl, etc.), a sulfamoyl group, an oxysulfinyl group (e.g., methoxysulfinyl, etc.), a thiosulfinyl (e.g., methylthiosulfinyl, etc.), a sulfinamoyl group, phosphoryl group, a nitro group, an imino group, N-carbonylimino group (e.g., N-acetylimino, etc.), a N-sulfonylimino group (e.g., N-methanesufonylimono, etc.), a dicynoethylene group, an ammonium group, a sulfonium group, a phophonium group, pyrilium group and inmonium group, and further including a group of a heterocyclic ring formed by an ammonium group, sulfonium group, phosphonium group or immonium group. Of these groups, groups exhibiting σp of 0.3 or more are specifically preferred.

Examples of the alkyl group represented by W include methyl, ethyl and trifluoromethyl; examples of the alkenyl include vinyl, halogen-substituted vinyl and cyanovinyl; examples of the aryl group include nitrophenyl, cyanophenyl, and pentafluorophenyl; and examples of the heterocyclic group include pyridyl, pyrimidyl, triazinyl, succinimido, tetrazolyl, triazolyl, imidazolyl, and benzoxazolyl. The group, as W, exhibiting positive σp is preferred and the group exhibiting σp of 0.3 or more is specifically preferred.

Of the groups represented by R, a hydroxy group, a mercapto group, an alkoxy group, an alkylthio group, a halogen atom, an organic or inorganic salt of a hydroxy or mercapto group and a heterocyclic group are preferred, and a hydroxy group, a mercapto group and an organic or inorganic salt of a hydroxy or mercapto group are more preferred.

Of the groups of X and W, the group having a thioether bond is preferred.

Next, the compound represented by the following formula (P) will be described:

formula (P)

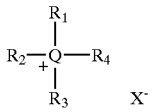

In formula (P), Q is a nitrogen atom or a phosphorus atom; $R_1$, $R_2$, $R_3$ and $R_4$ each are a hydrogen atom or a substituent, provided that $R_1$, $R_2$, $R_3$ and $R_4$ may combine together with each other to form a ring; and $X^-$ is an anion.

Examples of the substituent represented by $R_1$, $R_2$, $R_3$ and $R_4$ include an alkyl group (e.g., methyl, ethyl, propyl, butyl, hexyl, cyclohexyl), alkenyl group (e.g., allyl, butenyl), alkynyl group (e.g., propargyl, butynyl), aryl group (e.g., phenyl, naphthyl), heterocyclic group (e.g., piperidyl, piperazinyl, morpholinyl, pyridyl, furyl, thienyl, tetrahydrofuryl, tetrahydrothienyl, sulforanyl), and amino group. Examples of the ring formed by $R_1$, $R_2$, $R_3$ and $R_4$ include a piperidine ring, morpholine ring, piperazine ring, pyrimidine ring, pyrrole ring, imidazole ring, triazole ring and tetrazole ring. The group represented by $R_1$, $R_2$, $R_3$ and $R_4$ may be further substituted by a hydroxy group, alkoxy group, aryloxy group, carboxy group, sulfo group, alkyl group or aryl group. Of these, $R_1$, $R_2$, $R_3$ and $R_4$ are each preferably a hydrogen atom or an alkyl group. Examples of the anion of $X^-$ include a halide ion, sulfate ion, nitrate ion, acetate ion and p-toluenesulfonic acid ion.

Further, quaternary onium salt compounds usable in the invention include compounds represented by formulas (Pa), (Pb) and (Pc), or formula (T):

formula (Pa)

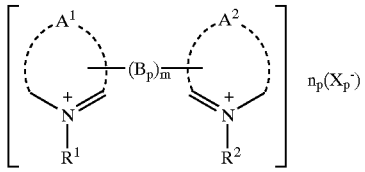

formula (Pb)

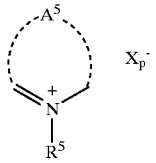

formula (Pc)

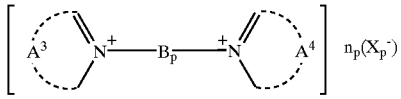

wherein $A^1$, $A^2$, $A^3$, $A^4$ and $A^5$ are each a nonmetallic atom group necessary to form a nitrogen containing heterocyclic ring, which may further contain an oxygen atom, nitrogen atom and a sulfur atom and which may condense with a benzene ring. The heterocyclic ring formed by $A^1$, $A^2$, $A^3$, $A^4$ or $A^5$ may be substituted by a substituent. Examples of the substituent include an alkyl group, an aryl group, an aralkyl group, alkenyl group, alkynyl group, a halogen atom, an acyl group, an alkoxycarbonyl group, an aryloxycarbonyl group, a sulfo group, hydroxy, an alkoxyl group, an aryloxy group, an amido group, a sulfamoyl group, a carbamoyl group, a ureido group, an amino group, a sulfonamido group, cyano, nitro, a mercapto group, an alkylthio group, and an arylthio group. Exemplary preferred $A^1$, $A^2$, $A^3$, $A^4$ and $A^5$ include a 5- or 6-membered ring (e.g., pyridine, imidazole, thiazole, oxazole, pyrazine, pyrimidine) and more preferred is a pyridine ring.

Bp is a divalent linkage group, and m is 0 or 1. Examples of the divalent linkage group include an alkylene group, arylene group, alkenylene group, —$SO_2$—, —SO—, —O—, —S—, —CO—, —N($R^6$)—, in which $R^6$ is a hydrogen atom, an alkyl group or aryl group. These groups may be included alone or in combination. Of these, Bp is preferably an alkylene group or alkenylene group.

$R^1$, $R^2$ and $R^5$ are each an alkyl group having 1 to 20 carbon atoms, and $R^1$ and $R^2$ may be the same. The alkyl group may be substituted and substituents thereof are the same as defined in $A^1$, $A^2$, $A^3$, $A^4$ and $A^5$. Preferred $R^1$, $R^2$ and $R^5$ are each an alkyl group having 4 to 10 carbon atoms, and more preferably an aryl-substituted alkyl group, which may be substituted. $X_p^-$ is a counter ion necessary to counterbalance overall charge of the molecule, such as chloride ion, bromide ion, iodide ion, sulfate ion, nitrate ion and p-toluenesulfonate ion; $n_p$ is a counter ion necessary to counterbalance overall charge of the molecule and in the case of an intramolecular salt, $n_p$ is 0.

Formula (T)

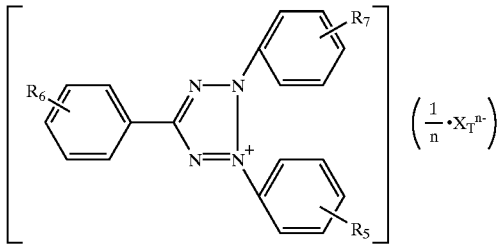

In formula (T), substituent groups $R_5$, $R_6$ and $R_7$, substituted on the phenyl group are preferably a hydrogen atom or a group exhibiting a negative Hammett's σ-value. The Hammett's σ-value represents electron-attractivity.

The σ values of the substituent on the phenyl group are disclosed in lots of reference books. For example, a report by C. Hansch in "The Journal of Medical Chemistry", vol. 20, on page 304 (1977), etc. can be mentioned. Groups showing particularly preferable negative σ-values include, for example, methyl group ($\sigma_p$=−0.17, and in the following, values in the parentheses are in terms of $\sigma_p$ value), ethyl group (−0.15), cyclopropyl group (−0.21), n-propyl group (−0.13), iso-propyl group (−0.15), cyclobutyl group (−0.15), n-butyl group (−0.16), iso-butyl group (−0.20), n-pentyl group (−0.15), n-butyl group (−0.16), iso-butyl group (−0.20), n-pentyl group (−0.15), cyclohexyl group (−0.22), hydroxyl group (−0.37), amino group (−0.66), acetylamino group (−0.15), butoxy group (−0.32), pentoxy group (−0.34), etc. can be mentioned. All of these groups are useful as the substituent for the compound represented by the formula T according to the present invention;

n is 1 or 2, and as anions represented by $X_T^{n-}$ for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, including lower alkyl benzenesulfonic acid anions such as p-toluenesulfonic acid anion, etc.; higher alkylbenzene sulfonic acid anions such as p-dodecyl benzenesulfonic acid anion, etc.; higher alkyl sulfate anions such as lauryl sulfate anion, etc.; Boric acid-type anions such as tetraphenyl borone, etc.; dialkylsulfo succinate anions such as di-2-ethylhexylsulfo succinate anion, etc.; higher fatty acid anions such as cetyl polyethenoxysulfate anion, etc.; and those in which an acid radical is attached to a polymer, such as polyacrylic acid anion, etc. can be mentioned.
Exemplary examples of the quaternary onium compounds are shown below, but are not limited to these.
P-1
$C_{16}H_{33}\overset{+}{N}(CH_3)_3\ Br^-$
P-2
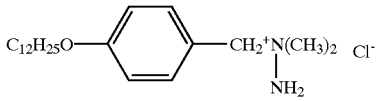
P-3
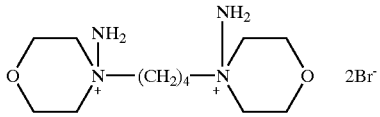
P-4
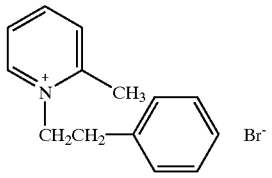
P-5
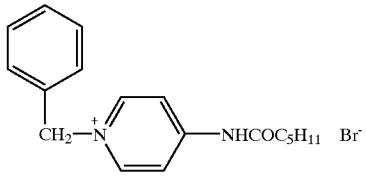
P-6
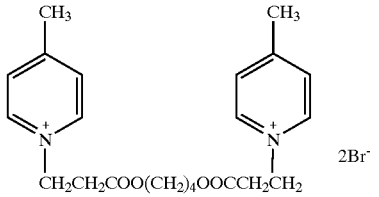
P-7
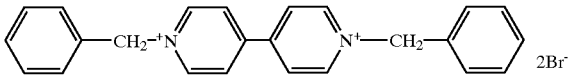
P-8
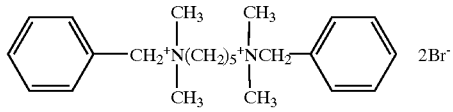
P-9
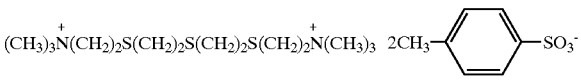
P-10
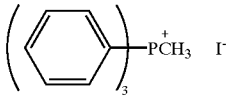
P-11
$(C_4H_9)_3\overset{+}{P}C_{16}H_{33}\ Br^-$
-continued
P-12
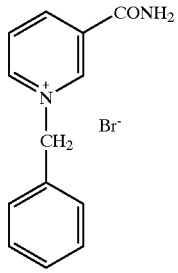
P-13
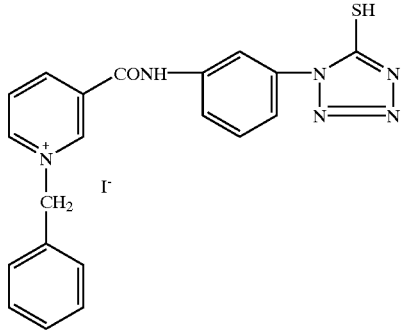
P-14
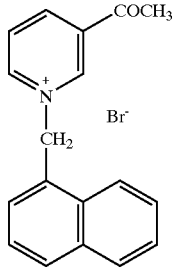
P-15
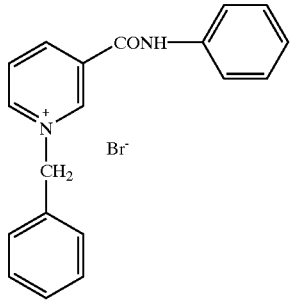
P-16
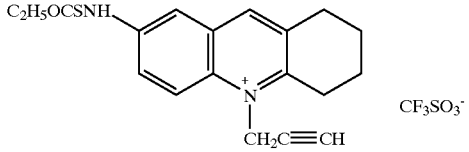
P-17
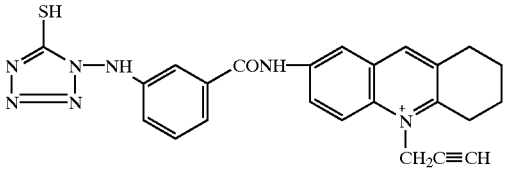

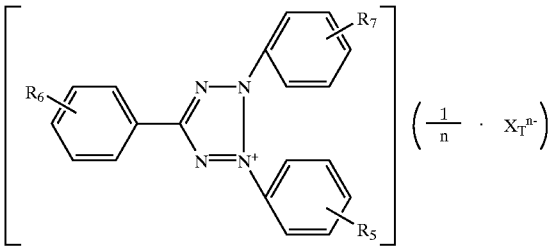

| Compound No. | $R_5$ | $R_6$ | $R_7$ | $X_T^{n-}$ |
|---|---|---|---|---|
| T-1 | H | H | p-$CH_3$ | — |
| T-2 | p-$OCH_3$ | p-$CH_3$ | p-$CH_3$ | — |
| T-3 | p-$OCH_3$ | H | p-$CH_3$ | — |
| T-4 | p-$OCH_3$ | H | p-$OCH_3$ | — |
| T-5 | p-$C_3H_7$ | H | p-$C_3H_7$ | — |
| T-6 | p-n$C_{12}H_{25}$ | H | p-n$C_{12}H_{25}$ | — |
| T-7 | p-$NH_2$ | H | H | — |

The quaternary onium salt compounds described above can be readily synthesized according to the methods commonly known in the art. For example, the tetrazolium compounds described above may be referred to Chemical Review 55, page 335–483.

Layer Arrangement

A photothermographic material relating to the invention preferably comprises at least two light-sensitive layers. In one preferred embodiment of the invention, the photothermographic material comprises on a support having thereon two image forming layer and an interlayer. These layers may be simultaneously coated, or the image forming layer and interlayer may be coated on each of both sides of the support.

As a method for providing plural functional layers described above on a support is cited sequential multi-layer coating system in which coating and drying are repeated for respective layers, including a roll coating system such as reverse roll coating or gravure roll coating, blade coating, wire-bar coating, and die coating. Alternatively, using plural coaters and before drying a coated layer, the next layer is coated and plural coated layers are simultaneously dried. Using slide coating or curtain coating described in Stephen F. Kistler & Petert M. Schweizer, "LIQUID FILM COATING" (CHAPMAN & HALL, 1997) at pages 399–536, a simultaneous multi-layer coating system is also applicable, in which plural coating solutions are layers on the slide surface to be coated. The most preferred coating method in the invention is extrusion coating. The extrusion coating is suitable for accurate coating or organic solvent coating since no evaporation occur on the slide surface, as in a slide coating system. Simultaneous multi-layer coating is detailed in JP-A No. 2000015173.

Hue Angle

With regard to image tone of the outputted image used for medical diagnosis, it has been supposed that more exact diagnostic observation results can be easily achieved with cold image tone. The cold image tone refers to pure black tone or bluish black tone and the warm image tone refers to a brownish black image exhibiting a warm tone. The expression regarding to the tone, i.e., "colder tone" or "warmer tone can be determined based on a hue angle, $h_{ab}$ at a density of 1.0, as defined in JIS Z 8729. The hue angle, $h_{ab}$ can be represented as $h_{ab}=\tan^{-1}(b^*/a^*)$ obtained from a XYZ color system, or tristimulus values X, Y and Z or $X_{10}$, $Y_{10}$ and $Z_{10}$ defined in JIS Z 8701, using color coordinates a* and b* in L*a*b* color system defined in JIS Z 8729. In the invention the range of the $h_{ab}$ is preferably $180°<h_{ab}<270°$, more preferably $200°<h_{ab}<270°$, and still more preferably $220°<h_{ab}<260°$. Such a photothermographic material meeting the foregoing values can be achieved by the invention and it is preferred to incorporate image toning agents such as phthalazines and 4-methylphthalic acid.

Reducing Agent

Reducing agents are incorporated into the photothermographic material of the present invention. Examples of suitable reducing agents are described in U.S. Pat. Nos. 3,770,448, 3,773,512, and 3,593,863, and Research Disclosure Items 17029 and 29963, and an optimum reducing agent can be used by the selection from those commonly known in the art. The compounds represented by formula (2) described earlier are also usable.

Organic Silver Salt

The organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (e.g., salts of gallic acid, oxalic acid, behenic acid, stearic acid, palmitic acid, lauric acid, etc.); carboxyalkylthiourea salts (e.g., 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (e.g., aldehydes such as formaldehyde, acetaldehyde, butylaldehyde), hydroxy-substituted acids (e.g., salicylic acid, benzoic acid, 3,5-dihydroxybenzoic acid, 5,5-thiodisalicylic acid, silver salts or complexes of thiones (e.g., 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidic acid and/or stearic acid are specifically preferred. A mixture of two or more kinds of organic silver salts is preferably used, enhancing developability and forming silver images exhibiting relatively high density and high contrast. For example, preparation by adding a silver ion solution to a mixture of two or more kinds of organic acids is preferable.

The organic silver salt compound can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form organic silver salt crystals. In this case, silver halide grains may be concurrently present.

Organic silver salt grains may be of almost any shape but are preferably tabular grains. Tabular organic silver salt grains are specifically preferred, exhibiting an aspect ratio of 3 or more and a needle form ratio of not less than 1.1 and less than 10.0 of a needle form ratio measured from the major face direction, thereby lessen anisotropy in shape of substantially parallel, two faces having the largest area (so-called major faces). The more preferred needle form ratio is not less than 1.1 and less than 5.0.

The expression "comprises tabular organic silver salt grains exhibiting an aspect ratio of 3 or more" means that at least 50% by number of the total organic silver salt grains is accounted for by such tabular grains having an aspect ratio of 3 or more. The organic silver salt grains having an aspect ratio of 3 or more accounts for more preferably at least 60% by number, still more preferably at least 70% by number, and specifically preferably at least 80% by number. The tabular organic silver salt particle having an aspect ratio of 3 or more refers to an organic salt grain exhibiting a ratio of grain diameter to grain thickness, a so-called aspect ratio (also denoted as AR) of 3 or more, which is defined as below:

$$AR = \text{diameter } (\mu m)/\text{thickness } (\mu m)$$

wherein when an organic silver salt grain is approximated to be a rectangular parallelepiped, the diameter is the maximum edge length (also denoted as MX LNG) and the thickness is the minimum edge length (also denoted as MN LNG).

The aspect ratio of the tabular organic silver salt grain is preferably within the range of 3 to 20, and more preferably 3 to 10. In the case of an aspect ratio of less than 3, the organic salt particles easily form closest packing and in the case of the aspect ratio being excessively high, organic silver salt grains are easily superposed and dispersed in a coating layer in the form of being brought into contact with each other, easily causing light scattering and leading to deterioration in transparency of the photothermographic material.

The grain diameter was determined in the following manner. An organic silver salt dispersion was diluted, dispersed on the grid provided with a carbon support membrane, and then photographed at a direct magnification of 5,000 times using a transmission type electron microscope (TEM, 2000 FX type, available from Nihon Denshi Co., Ltd.). The thus obtained negative electron micrographic images were read as a digital image by a scanner to determine the diameter (circular equivalent diameter) using appropriate software. At least 300 grains were so measured to determine an averkeptiameter.

The grain thickness is determined using a transmission type electron microscope in the following manner. First, a light sensitive layer, coated onto a support, is pasted onto a suitable holder employing an adhesive and is cut perpendicular to the support surface employing a diamond knife to prepare an ultra-thin slice, at a thickness of 0.1 to 0.2 $\mu$m. The thus prepared ultra-thin slice is supported on a copper mesh, and is placed onto a carbon membrane, which has been made to be hydrophilic by means of a glow discharge. Then, while cooling the resulting slice to not more than −130° C., the image in a bright visual field is observed at a magnification of 5,000 to 40,000 employing a transmission electron microscope (hereinafter referred to as TEM), and then images are quickly recorded employing an image plate, a CCD camera, etc. In such a case, it is recommended to suitably select a portion of said slice, which has neither been torn nor distorted in the visual field for observation.

The carbon membrane, which is supported by an organic film such as an extremely thin collodion, Formvar, etc., is preferably employed, and a film composed of only carbon, which is obtained by forming the film on a rock salt substrate and then dissolving away the substrate or by removing the foregoing organic film, employing an organic solvent or ion etching, is more preferably employed. The acceleration voltage of said TEM is preferably 80 to 400 kV, and is most preferably 80 to 200 kV.

Details of other means such as electron microscopic technology and sample preparation techniques can be referred to in "Igaku•Seibutsugaku Denshikenbikyo Kansatsuho (Medical and Biological Electron Microscopy", edited by Nippon Denshikenbikyo Gakkai, Kanto Shibu, (Maruzen), and "Denshikenbikyo Seibutsu Shiryo Sakuseiho (Preparation Method of Biological Samples for Electron Microscopy)", edited by Nippon Denshikenbikyo Gakkai, Kanto Shibu, (Maruzen).

The TEM image, recorded in an appropriate medium, is decomposed to at least 1024×1024 pixels or preferably at least 2048×2048 pixels, and is then subjected to image processing employing a computer. In order to carry out image processing, an analogue image recorded on a film strip is converted into a digital image employing a scanner etc., and the resulting image is preferably subjected to shading correction, contrast-edge enhancement, etc., based on specific requirements. Thereafter, a histogram is prepared and the portions corresponding to organic silver are extracted employing binary processing. At least 300 grains of the organic silver salt were manually measured with respect to the thus extracted thickness employing appropriate software.

The average of the needle ratio of the tabular organic silver salt grains is determined according to the procedures described below.

First, a light sensitive layer, comprising tabular organic silver salt grains, is allowed to swell by employing an organic solvent which is capable of dissolving the binder of said light sensitive layer, and said layer is then peeled from the support. The operation is repeated five times, in which the peeled layer is subjected to ultrasonic cleaning with the above-mentioned solvent, and centrifugal separation, and the supernatant is removed. Further, the above-mentioned process is carried out under a photographic safelight.

Subsequently, dilution is carried out employing MEK (methyl ethyl ketone) so that the concentration of the organic silver solid portion becomes 0.01 percent. After carrying out ultrasonic dispersion, the resulting is dropped onto a polyethylene terephthalate film which has been made to be hydrophilic employing a glow discharge, and is subsequently dried.

The film, on which said grains are placed, is subjected to oblique evaporation of 3 nm thickness Pt—C by an electron beam from a 30° angle to the film surface employing a vacuum evaporation unit, and thereafter, is preferably employed for observation.

Details of other means such as electron microscopic technology and sample preparation techniques can be referred to in "Igaku•Seibutsugaku Denshikenbikyo Kansatsuho (Medical and Biological Electron Microscopy", edited by Nippon Denshikenbikyo Gakkai, Kanto Shibu, (Maruzen), and "Denshikenbikyo Seibutsu Shiryo Sakuseiho (Preparation Method of Biological Samples for Electron Microscopy)", edited by Nippon Denshikenbikyo Gakkai, Kanto Shibu, (Maruzen).

The prepared sample is observed through a secondary electron image, obtained by employing a field emission scanning electron microscope (hereinafter referred to as FE-SEM) under a magnification of 5,000 to 20,000 at an acceleration voltage of 2 to 4 kV, and the resulting image is stored on suitable recording media.

For the above-mentioned processing, it is convenient to use a device which is capable of directly recording the memory data as digital information, which is obtained by AD converting image signals from the electron microscope body. However, analogue images recorded onto Polaroid film etc. can be converted to digital images employing a scanner etc., and the resulting images may be employed upon carrying out shading correction, contrast enhancement as well as edge enhancement, etc. if desired.

One image recorded in a suitable medium is decomposed to at least 1024×1024 pixels and is preferably decomposed to 2048×2048 pixels. Said decomposed image is preferably subjected to image processing employing a computer.

Procedures of the above-mentioned image processing are as follows. First, a histogram is prepared and portions corresponding to tabular organic silver salt grains having an aspect ratio of 3 or more are extracted employing binary processing. Inevitable coagulated grains are cut employing a suitable algorithm or a manual operation and are subjected to boarder extract. Thereafter, both maximum length (MX LNG) and minimum width (WIDTH) between two parallel lines are measured for at least 1000 grains, and the needle ratio of each grain is obtained employing the formula described below. The maximum length (MX LNG) is the maximum value of the straight length between two points within a grain. The minimum width between two parallel lines is the minimum distance of two parallel lines drawn circumscribing the grain.

$$\text{Needle ratio}=(MX\ LNG)/(\text{WIDTH})$$

Thereafter, the number average of the needle ratio is calculated for all measured particles. When measurements are carried out employing the above-mentioned procedures, it is desirable that in advance, employing a standard sample, the length correction (scale correction) per pixel as well as two-dimensional distortion correction of the measurement system is adequately carried out. As the standard sample, Uniform Latex Particles (DULP) marketed by Dow Chemical Co. in the USA are suitable. Polystyrene particles having a variation coefficient of less than 10 percent for a diameter of 0.1 to 0.3 μm are preferred. Specifically, a type having a particle diameter of 0.212 μm as well as a standard deviation of 0.0029 μm is commercially available.

Details of image processing technology may be had by referring to "Gazo-shori Oyogijutsu (Application of Image Processing Technology)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

Methods to prepare organic silver salt grains having the above-mentioned shape are not particularly restricted. The optimization of various conditions such as maintaining the mixing state during the formation of an organic acid alkali metal salt soap and/or the mixing state during the addition of silver nitrate to said soap.

Dispersion

After tabular organic silver salt grains employed in the present invention are preliminarily dispersed together with binders, surface active agents, etc., if desired, the resulting mixture is preferably dispersed and pulverized by a media homogenizer, a high pressure homogenizer, or the like During said preliminary dispersion, ordinary stirrers such as an anchor type, a propeller type, etc., a high speed rotation centrifugal radial type stirrer (Dissolver), as a high speed shearing stirrer (homomixer) may be employed.

Furthermore, employed as said media homogenizers may be rolling mills such as a ball mill, a satellite ball mill, a vibrating ball mill, medium agitation mills such as a bead mill, atriter, and others such as a basket mill. Employed as high pressure homogenizers may be various types such as a type in which collision occurs against a wall or a plug, a type in which liquid is divided into a plurality of portions and said portions are subjected to collision with each other, a type in which liquid is forced to pass through a narrow orifice, etc. Examples of ceramics employed as the ceramic beads include $Al_2O_3$, $BaTiO_3$, $SrTiO_3$, MgO, ZrO, BeO, $Cr_2O_3$, $SiO_3$, $SiO_2$—$Al_2O_3$, $Cr_2O_3$—MgO, MgO—CaO, MoO—C, MgO—$Al_2O_3$ (spinel), SiC, $TiO_2$, $K_2O$, $Na_2O$, BaO, PbO, $B_2O_3$, $BeAl_2O_4$, $Y_3Al_5O_{12}$, $ZrO_2$—$Y_2O_3$ (cubic zirconia), 3BeO—$Al_2O_3$—$6SiO_2$ (artificial emerald), C (artificial diamond), $SiO_2$—$nH_2O$, silicone nitride, yttrium-stabilized-zirconia, zirconia-reinforced-alumina. Yttrium-stabilized-zirconia and zirconia-reinforced-alumina are preferably employed in view that little impurity is generated by friction among the beads or the classifier during classifying them. The ceramics containing zirconia are called zirconia as an abbreviation.

In devices employed for dispersing the tabular organic silver salt grains employed in the present invention, preferably employed as the members which are in contact with the organic silver salt grains are ceramics such as zirconia, alumina, silicone nitride, boron nitride, or diamond. Of these, zirconia is the one most preferably employed.

While carrying out of the above-mentioned dispersion, the binder is preferably added so as to achieve a concentration of 0.1 to 10 wt % with reference to the weight of the organic silver salt, and the temperature is preferably maintained at no less than 45° C. from the preliminary dispersion to the main dispersion process. An example of the preferable operation conditions of a homogenizer, when employing high-pressure homogenizer as the dispersing machine, is twice or more operations at 300 to 1,000 kgf/cm$^2$. In the case when a media-dispersing machine is employed, a circumferential speed of 6 to 13 m/sec. is preferable. In the case when zirconia is employed as a part of the beads or of the machine, it is ground and mixed into the dispersion during the mixing process. This is specifically advantageous in view of photographic characteristics. Fragments of zirconia may be supplementally added to the dispersion or preliminarily added during preliminary dispersing. A high concentration zirconia liquid can be obtained, for example, by circulating methylethylketone in a bead mill filled with zirconia beads. The obtained zirconia liquid may be added in the adequate amount at adequate stages. The content of the zirconia in a light sensitive emulsion containing light sensitive silver halide and an organic silver salt is preferably 0.01 to 0.5 mg, and more preferably 0.01 to 0.3 mg per g of silver. The zirconia is preferably in the form of fine particles having a diameter of not more than 0.02 μm.

When the cross section, vertical to the support of the photothermographic material is observed through an electron microscope, organic silver salt particles exhibiting a grain projected area of less than 0.025 μm$^2$ account for at least 70% of the total grain projected area and organic silver salt particles exhibiting a grain projected area of not less than 0.2 μm$^2$ account for not more than 10% of the total grain projected area. In such a case, coagulation of the organic silver salt grains is minimized in the light sensitive emulsion, resulting in a homogeneous distribution thereof.

The conditions for preparing the light sensitive emulsion having such a feature are not specifically limited but include, for example, mixing at the time of forming an alkali metal soap of an organic acid and/or mixing at the time of adding silver nitrate to the soap being maintained in a favorable state, optimization of the ratio of the soap to the silver nitrate, the use of a media dispersing machine or a high pressure homogenizer for dispersing pulverization, wherein dispersion is conducted preferably in a binder content of 0.1 to 10% by weight, based on the organic silver salt, the dispersion including the preliminary dispersion is carried out preferably at a temperature of not higher than 45° C., and a dissolver, as a stirrer is preferably operated at a circumferential speed of at least 2.0 m/sec.

The projected area of organic silver salts grain having a specified projection area and the desired proportion thereof, based on the total grain projection area can be determined by the method using a transmission type electron microscope (TEM) in a similar manner, as described in the determination of the average thickness of tabular grains having an aspect ratio of 3 or more. In this case, coagulated grains are regarded as a single grain when determining the grain area (AREA). At least 1000 grains, and preferably at least 2000 grains are measured to determine the area and classified into three groups, i.e., A: less than 0.025 $\mu m^2$, B: not less than 0.025 $\mu m^2$ and less than 0.2 $\mu m^2$ and C: more than 0.2 $\mu m^2$. In this invention, it is preferable that the total projected area of grains falling within the range of "A" accounts for at least 70% of the projected area of the total grains and the total projected area of grains falling within the range of "C" accounts for not more than 10% of the projected area of total grain. As mentioned earlier, details of image processing technology may be had by referring to "Gazoshori Oyogijutsu (Applied Technology in Image Processing)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

The organic silver salt grains used in this invention are preferably monodisperse. The degree of monodispersion is preferably 1 to 30% and monodisperse particles in this range lead to the desired high density images. The degree of monodispersion is defined as below:

Degree of grain dispersity=(standard deviation of particle size)/(average particle size)×100 (%).

The average particle size of organic silver salt is preferably 0.01 to 0.8 $\mu$m, and more preferably 0.05 to 0.5 $\mu$m. The particle size refers to the diameter of a circle having an area equivalent to the projected area of the particle (i.e., circular equivalent diameter).

To prevent hazing of the photothermographic material, the total amount of silver halide and organic silver salt is preferably 0.5 to 2.2 g in equivalent converted to silver per $m^2$, thereby leading to high contrast images.

Silver Halide

Next, light-sensitive silver halide grains used in the invention will be described. Light-sensitive silver halide grains are prepared so that the silver halide grains are capable of absorbing visible or infrared light as inherent property of silver halide crystal or by an artificial means or a physico-chemical method, thereby causing a physico-chemical change in the interior and/or on the surface of the crystal upon absorbing the visible or infrared light.

Silver halide grains used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide.

The grain forming process is usually classified into two stages of formation of silver halide seed crystal grains (nucleation) and grain growth. These stages may continuously be conducted, or the nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains. After completing the grain formation, the resulting silver halide grain emulsion is subjected to desalting to remove soluble salts by commonly known washing methods such as a noodle washing method, a flocculation method, a ultrafiltration method, or electrodialysis to obtain desired emulsion grains.

In order to minimize cloudiness after image formation and to obtain excellent image quality, the less the average grain size, the more preferred, and the average grain size is preferably not more than 0.2 $\mu$m, more preferably between 0.01 and 0.17 $\mu$m, and still more preferably between 0.02 and 0.14 $\mu$m. The average grain size as described herein is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces. Furthermore, silver halide grains are preferably monodisperse grains. The monodisperse grains as described herein refer to grains having a coefficient of variation of grain size obtained by the formula described below of not more than 7%; more preferably not more than 5%, still more preferably not more than 3%, and most preferably not more than 1%.

Coefficient of variation of grain size=standard deviation of grain diameter/average grain diameter×100(%)

The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. Nos. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography. The low molecular gelatin can be obtained by subjecting an aqueous gelatin conventionally used and having an average molecular weight of ca. 100,000 to enzymatic hydrolysis, acid or alkali hydrolysis, thermal degradation at atmospheric pressure or under high pressure, or ultrasonic degradation.

The concentration of dispersion medium used in the nucleation stage is preferably not more than 5% by weight, and more preferably 0.05 to 3.0% by weight.

In the preparation of silver halide grains, it is preferred to use a compound represent by the following formula, specifically in the nucleation stage:

$$AO(CH_2CH_2O)_m(C(CH_3)CH_2O)_p(CH_2CH_2O)_nA$$

where Y is a hydrogen atom, —$SO_3M$ or —CO—B—COOM, in which M is a hydrogen atom, alkali metal atom, ammonium group or ammonium group substituted by an alkyl group having carbon atoms of not more than 5, and B is a chained or cyclic group forming an organic dibasic acid; m and n each are 0 to 50; and p is 1 to 100.

Polyethylene oxide compounds represented by foregoing formula have been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the process of preparing silver halide photographic light sensitive materials. A technique of using these compounds as a defoaming agent is described in JP-A No. 44-9497. The polyethylene oxide compound represented by the foregoing formula also functions as a defoaming agent during nucleation. The compound represented by the foregoing formula is used preferably in an amount of not more than 1%, and more preferably 0.01 to 0.1% by weight, based on silver.

The compound is to be present at the stage of nucleation, and may be added to a dispersing medium prior to or during nucleation. Alternatively, the compound may be added to an aqueous silver salt solution or halide solution used for nucleation. It is preferred to add it to a halide solution or both silver salt and halide solutions in an amount of 0.01 to 2.0% by weight. It is also preferred to make the compound represented by formula [5] present over a period of at least 50% (more preferably, at least 70%) of the nucleation stage.

The temperature during the stage of nucleation is preferably 5 to 60° C., and more preferably 15 to 50° C. Even when nucleation is conducted at a constant temperature, in a temperature-increasing pattern (e.g., in such a manner that nucleation starts at 25° C. and the temperature is gradually increased to reach 40° C. at the time of completion of nucleation) or its reverse pattern, it is preferred to control the temperature within the range described above.

Silver salt and halide salt solutions used for nucleation are preferably in a concentration of not more than 3.5N, and more preferably 0.01 to 2.5N. The flow rate of aqueous silver salt solution is preferably $1.5\times10^{-3}$ to $3.0\times10^{-1}$ mol/min per lit. of the solution, and more preferably $3.0\times10^{-3}$ to $8.0\times10^{-2}$ mol/min. per lit. of the solution. The pH during nucleation is within a range of 1.7 to 10, and since the pH at the alkaline side broadens the grain size distribution, the pH is preferably 2 to 6. The pBr during nucleation is 0.05 to 3.0, preferably 1.0 to 2.5, and more preferably 1.5 to 2.0.

Silver halide may be incorporated into an image forming layer by any means, in which silver halide is arranged so as to be as close to reducible silver source as possible. It is general that silver halide, which has been prepared in advance, added to a solution used for preparing an organic silver salt. In this case, preparation of silver halide and that of an organic silver salt are separately performed, making it easier to control the preparation thereof. Alternatively, as described in British Patent 1,447,454, silver halide and an organic silver salt can be simultaneously formed by allowing a halide component to be present together with an organic silver salt-forming component and by introducing silver ions thereto.

Silver halide can also be prepared by reacting a halogen containing compound with an organic silver salt through conversion of the organic silver salt. Thus, a silver halide-forming component is allowed to act onto a pre-formed organic silver salt solution or dispersion or a sheet material containing an organic silver salt to convert a part of the organic silver salt to photosensitive silver halide. The silver halide-forming components include inorganic halide compounds, onium halides, halogenated hydrocarbons, N-halogeno compounds and other halogen containing compounds. These compounds are detailed in U.S. Pat. Nos. 4,009,039, 3,457,075 and 4,003,749, British Patent 1,498,956 and JP-A 53-27027 and 53-25420. Exemplary examples thereof include inorganic halide compound such as a metal halide and ammonium halide; onium halides, such as trimethylphenylammonium bromide, cetylethyldimethylammonium bromide, and trimethylbenzylammonium bromide; halogenated hydrocarbons, such as iodoform, bromoform, carbon tetrachloride and 2-brom-2-methylpropane; N-halogenated compounds, such as N-bromosucciimde, N-bromophthalimide, and N-bromoacetoamide; and other halogen containing compounds, such as triphenylmethyl chloride, triphenylmethyl bromide, 2-bromoacetic acid, 2-bromoethanol and dichlorobenzophenone. As described above, silver halide can be formed by converting a part or all of an organic silver salt to silver halide through reaction of the organic silver salt and a halide ion. The silver halide separately prepared may be used in combination with silver halide prepared by conversion of at least apart of an organic silver salt. The silver halide which is separately prepared or prepared through conversion of an organic silver salt is used preferably in an amount of 0.001 to 0.7 mol, and more preferably 0.03 to 0.5 mol per mol of organic silver salt.

Silver halide used in the invention preferably occludes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex. In the present invention, regarding the transition metal complexes, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

Exemplary examples of transition metal-coordinated complexes are shown below:

1: $[RhCl_6]^{3-}$
2: $[RUCl_6]^{3-}$
3: $[ReCl_6]^{3-}$
4: $[RuBr_6]^{3-}$
5: $[OsCl_6]^{3-}$
6: $[CrCl_6]^{4-}$
7: $[IrCl_6]^{4-}$
8: $[IrCl_6]^{3-}$
9: $[Ru(NO)Cl_5]^{2-}$
10: $[RuBr_4(H_2O)]^{2-}$
11: $[Ru(NO)(H_2O)Cl_4]^{-}$
12: $[RhCl_5(H_2O)]^{2-}$
13: $[Re(NO)Cl_5]^{2-}$
14: $[Re(NO)(CN)_5]^{2-}$
15: $[Re(NO)Cl(CN)_4]^{2-}$
16: $[Rh(NO)_2Cl_4]^{-}$
17: $[Rh(NO)(H_2O)Cl_4]^{-}$
18: $[Ru(NO)(CN)_5]^{2-}$
19: $[Fe(CN)_6]^{3-}$
20: $[Rh(NS)Cl_5]^{2-}$
21: $[Os(NO)Cl_5]^{2-}$
22: $[Cr(NO)Cl_5]^{2-}$
23: $[Re(NO)Cl_5]^{-}$
24: $[Os(NS)Cl_4(TeCN)]^{2-}$
25: $[Ru(NS)Cl_5]^{2-}$
26: $[Re(NS)Cl_4(SeCN)]^{2-}$
27: $[Os(NS)Cl(SCN)_4]^{2-}$
28: $[Ir(NO)Cl_5]^{2-}$;

and with regard to cobalt or iron compounds, hexacyano cobalt or iron complexes are preferably used and exemplary examples thereof are shown below:

29: $[Fe(CN)_6]^{4-}$
30: $[Fe(CN)_6]^{3-}$
31: $[Co(CN)_6]^{3-}$.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (e.g., alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

Antifoggants and Print-Out Preventing Agent

Antifoggants may be incorporated into the photothermographic material relating to the invention. Mercury compounds known as an effective antifoggant, described in U.S. Pat. No. 3,589,903 are not preferable in terms of environmental protection. There have been studied antifoggants replacable therefor and antifoggants described in U.S. Pat. Nos. 4,546,075 and 4,452,885, and JP-A No. 59-57234. Specifically, a preferred antifoggant is a heterocyclic compound having a substituent group represented by —C(X1)(X2)(X3), in which X1 and X2 are each a halogen atom and X3 is a hydrogen or halogen atom, as described in U.S. Pat. Nos. 3,874,946 and 4,756,999. Examples of such a preferred antifoggant include compounds described in JP-A No. 9-288328, col. [0030] through [0036]; and JP-A No. 9-90550, col. [0062] through [0063]. In addition thereto, suitable antifoggants are also described in U.S. Pat. No. 5,028,523 and European Patent No. 600,587, 605,981 and 631,176.

Chemical Sensitization

Silver halide grains used in the invention can be subjected to chemical sensitization. In accordance with methods described in Japanese Patent Application Nos. 2000-57004 and 2000-61942, for example, a chemical sensitization center (chemical sensitization speck) can be formed using compounds capable of releasing chalcogen such as sulfur or noble metal compounds capable of releasing a noble metal ion such as a gold ion. In the invention, it is preferred to conduct chemical sensitization with an organic sensitizer containing a chalcogen atom, as described below. Such a chalcogen atom-containing organic sensitizer is preferably a compound containing a group capable of being adsorbed onto silver halide and a labile chalcogen atom site. These organic sensitizers include, for example, those having various structures, as described in JP-A Nos. 60-150046, 4-109240 and 11-218874. Specifically preferred of these is at least a compound having a structure in which a chalcogen atom is attacked to a carbon or phosphorus atom through a double bond.

The amount of a chalcogen compound added as an organic sensitizer is variable, depending on the chalcogen compound to be used, silver halide grains and a reaction environment when subjected to chemical sensitization and is preferably $10^{-8}$ to $10^{-2}$ mol, and more preferably $10^{-7}$ to $10^{-3}$ mol per mol of silver halide. In the invention, the chemical sensitization environment is not specifically limited but it is preferred to conduct chemical sensitization in the presence of a compound capable of eliminating a silver chalcogenide or silver specks formed on the silver halide grain or reducing the size thereof, or specifically in the presence of an oxidizing agent capable of oxidizing the silver specks, using a chalcogen atom-containing organic sensitizer. To conduct chemical sensitization under preferred conditions, the pAg is preferably 6 to 11, and more preferably 7 to 10, the pH is preferably 4 to 10 and more preferably 5 to 8, and the temperature is preferably not more than 30°

C. In photothermographic imaging materials used in the invention, it is preferred to use a light sensitive emulsion, in which light sensitive silver halide has been subjected to chemical sensitization using a chalcogen atom-containing organic sensitizer at a temperature of 30° C. or higher, concurrently in the presence of an oxidizing agent capable of oxidizing silver specks formed on the silver halide grains, then, mixed with an organic silver salt, dehydrated and dried.

Chemical sensitization using the foregoing organic sensitizer is also preferably conducted in the presence of a spectral sensitizing dye or a heteroatom containing compound capable of being adsorbed onto silver halide grains. Thus, chemical sensitization in the present of such a silver halide-adsorptive compound results in prevention of dispersion of chemical sensitization center specks, thereby achieving enhanced sensitivity and minimized fogging. Although there will be described spectral sensitizing dyes used in the invention, preferred examples of the silver halide-adsorptive, heteroatom-containing compound include nitrogen containing heterocyclic compounds described in JP-A No. 3-24537. In the heteroatom-containing compound, examples of the heterocyclic ring include a pyrazolo ring, pyrimidine ring, 1,2,4-triazole ring, 1,2,3-triazole ring, 1,3,4-thiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocycic hetero-ring and an aromatic ring include, for example, a phthalazine ring, benzimidazole ring indazole ring, and benzthiazole ring. Of these, an azaindene ring is preferred and hydroxy-substituted azaindene compounds, such as hydroxytriazaindene, tetrahydroxyazaindene and hydroxypentazaundene compound are more preferred. The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group. The amount of the heterocyclic ring containing compound to be added, which is broadly variable with the size or composition of silver halide grains, is within the range of $10^{-6}$ to 1 mol, and preferably $10^{-4}$ to $10^{-1}$ mol per mol silver halide.

As described earlier, silver halide grains can be subjected to noble metal sensitization using compounds capable of releasing noble metal ions such as a gold ion. Examples of usable gold sensitizers include chloroaurates and organic gold compounds. In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can also conducted by ripening the emulsion while maintaining the pH at not less than 7 or the pAg at not more than 8.3. Silver halide to be subjected to chemical sensitization may be one which has been prepared in the presence of an organic silver salt, one which has been formed under the condition in the absence of the organic silver salt, or a mixture thereof.

Spectral Sensitization

Light-sensitive silver halide grains used in the invention are preferably subjected to spectral sensitization by allowing a spectral sensitizing dye to adsorb to the grains. Examples of the spectral sensitizing dye include cyanine, merocyanine, complex cyanine, complex merocyanine, holo-polar cyanine, styryl, hemicyanine, oxonol and hemioxonol dyes, as described in JP-A NOs. 63-159841, 60-140335, 63-231437, 63-259651, 63-304242, 63-15245; U.S. Pat. Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydatoin, rhodanine, oxazolidine-dione, thiazolinedione, barbituric acid, thiazolinone, malononitrile and pyrazolone nuclei. In the invention, there are also preferably used sensitizing dyes having spectral sensitivity within the infrared region. Examples of the preferred infrared sensitizing dye include those described in U.S. Pat. Nos. 4,536,478, 4,515,888 and 4,959,294.

Specifically, preferred sensitizing dyes are dyes represented by the following formulas (D1) through (D4):

Formula (D1)

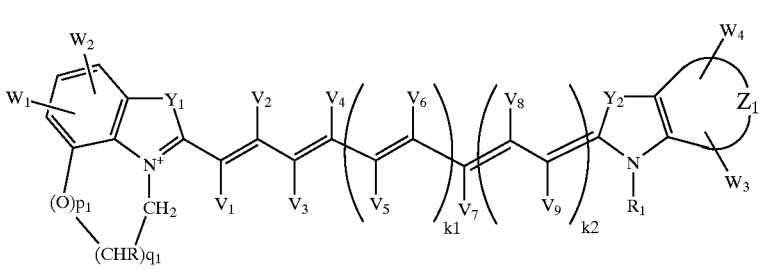

$(X_1)_{l1}$

-continued

Formula (D2)

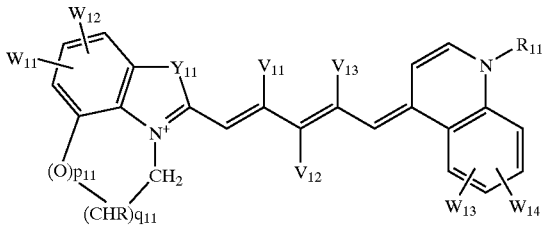

$(X_{11})_{l11}$

Formula (D3)

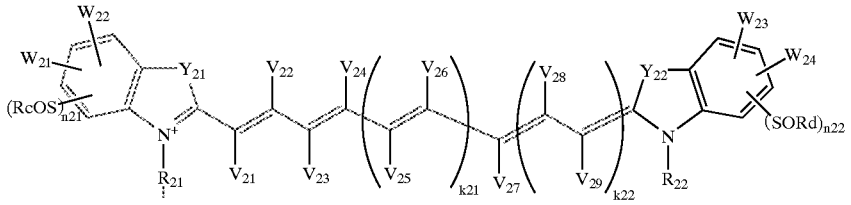

$(X_{21})_{l21}$

Formula (D4)

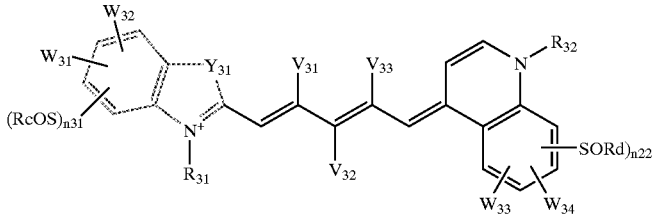

$(X_{11})_{l31}$

In formulas (D1) through (D4), $Y_1$, $Y_2$, $Y_{11}$, $Y_{21}$, $Y_{22}$ and $Y_{31}$ each are independently an oxygen atom, a sulfur atom, a selenium atom, —C(Ra)(Rb)— group or —CH═CH— group, in which Ra and Rb each are a hydrogen atom, an alkyl group (preferably having 1 to 5 carbon atoms) or a non-metallic atom group necessary to form an aliphatic spiro ring; $Z_1$ is a non-metallic atom group necessary to form a 5- or 6-membered ring; $R_1$, $R_{11}$, $R_{21}$, $R_{22}$, $R_{31}$ and $R_{32}$ each are an aliphatic group or a non-metallic atom group necessary to form a condensed ring between $R_1$ and $W_3$ or between $R_{11}$ and $W_{14}$; Rc and Rd each are independently an unsubstituted lower alkyl group, a cycloalkyl group, an aralkyl group, an aryl group or a heterocyclic group; $W_1$, $W_2$, $W_3$, $W_4$, $W_{11}$, $W_{12}$, $W_{13}$, $W_{14}$, $W_{21}$, $W_{22}$, $W_{23}$, $W_{24}$, $W_{31}$, $W_{32}$, $W_{33}$ and $W_{34}$ each are independently a hydrogen atom, a substituent or a non-metallic atom group necessary to form a condensed ring by bonding between $W_1$ and $W_2$, $W_{11}$ and $W_{12}$, $W_{21}$ and $W_{22}$, $W_{23}$ and $W_{24}$, $W_{31}$ and $W_{32}$, or $W_{33}$ and $W_{34}$; $V_1$ to $V_9$, $V_{11}$ to $V_{13}$, $V_{21}$ to $V_{29}$, and $V_{31}$ to $V_{33}$ each are independently a hydrogen atom, a halogen atom, an amino group, an alkylthio group, an arylthio group, a lower alkyl group, a lower alkoxyl group, an aryl group, an aryloxyl group, a heterocyclic group or a non-metallic atom group necessary to form a 5- to 7-membered ring by bonding between $V_1$ and $V_3$, $V_2$ and $V_4$, $V_3$ and $V_5$, $V_2$ and $V_6$, $V_5$ and $V_7$, $V_6$ and $V_8$, $V_7$ and $V_9$, $V_{11}$ and $V_{13}$, $V_{21}$ and $V_{23}$, $V_{22}$ and $V_{24}$, $V_{23}$ and $V_{25}$, $V_{24}$ and $V_{26}$, $V_{25}$ and $V_{27}$, $V_{26}$ and $V_{28}$, $V_{27}$ and $V_{29}$, or $V_{31}$ and $V_{33}$; $X_{21}$ and $X_{31}$, provided that at least one of $V_1$ to $V_9$ and at least one of $V_{11}$ to $V_{13}$ are a group other than a hydrogen atom; $X_1$, $X_{11}$, $X_{21}$ and $X_{31}$ each are an ion necessary to compensate for an intramolecular charge; l1, l11, l21 and l31 each an ion necessary to compensate for an intramolecular charge; k1, k2, k31 and k32 each are 0 or 1; n21, n22, n31 and n32 each are 0, 1 or 2;, provided that n1 and n22, and n31 and n32 are not 0 at the same time; p1 and p11 are each 0 or 1; q1 and q11 each are 1 or 2, provided that the sum of p1 and q1 and the sum of p11 and q11 each are respectively not more than 2.

Of formulas (D1) and (D2), a compound represented by the following formula (1—1) or (2-1) is more preferred:

Formula (1-1)

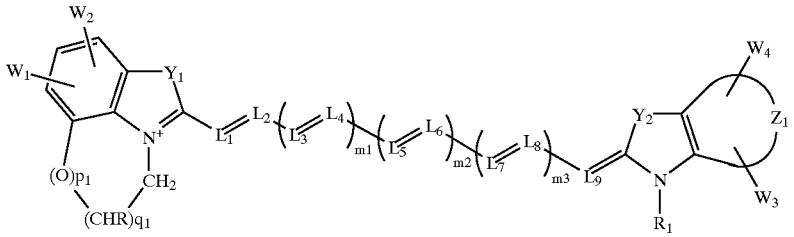

$(X_1)_{l1}$

Formula (2-1)

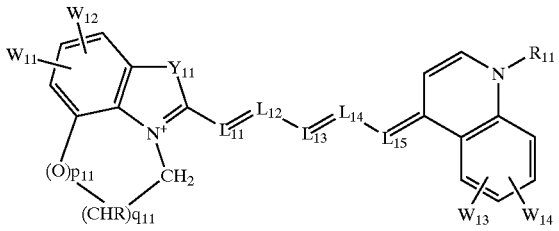

$(X_{11})_{l11}$ wherein $Y_1$, $Y_2$ and $Y_{11}$ each are independently an oxygen atom, a sulfur atom, a selenium atom, —C(Ra)(Rb)— group or —CH═CH— group, in which Ra and Rb each are a hydrogen atom, a lower alkyl group or an atomic group necessary to form an aliphatic spiro ring when Ra and Rb are linked with each other; $Z_1$ is an atomic group necessary to form a 5- or 6-membered ring; R is a hydrogen atom, a lower alkyl, a cycloalkyl group, an aralkyl group, a lower alkoxy group, an aryl group, a hydroxy group or a halogen atom; $W_1$, $W_2$, $W_3$, $W_4$, $W_{11}$, $W_{12}$, $W_{13}$ and $W_{14}$ each are independently a hydrogen atom, a substituent or a non-metallic atom group necessary to form a condensed ring by bonding between $W_1$ and $W_2$ or $W_{11}$ and $W_{12}$; $R_1$ and $R_{11}$ are each an aliphatic group or a non-metallic atom group necessary to form a condensed ring by bonding between $R_1$ and $W_3$ or $R_{11}$ and $W_{14}$; $L_1$ to $L_9$, and $L_{11}$ to $L_{15}$ each are independently a methine group; $X_1$ and $X_{11}$ each are an ion necessary to compensate for an intramolecular charge; l1 and l11 each an ion necessary to compensate for an intramolecular charge; m1 to m3 each are 0 or 1; p1 and p11 are each 0 or 1; q1 and q11 each are 1 or 2, provided that the sum of p1 and q1 and the sum of p11 and q11 are respectively not more than 2.

Substituents will be further described. Thus, substituents of the compounds represented by formulas (D1), (D2), (1—1), (2-1), (D3), and (D4) will be explained below.

The 5- or 6-membered condensed rings completed by an atomic group represented by $Z_1$ include a condensed cyclohexene ring, a condensed benzene ring, a condensed thiophene ring, a condensed pyridine ring, and a condensed naphthalene ring. Exemplary examples thereof include a benzoxazole ring, tetrahydrobenzoxazole ring, naphthooxazole ring, benzonephthooxazole ring, benzothiazole ring, tetrahydrobenzothiazole ring, naphthothiazole ring, benzonaphthothiazole ring; thienothiazole ring, thianaphthenothiazole ring, pyridothiazole ring, benzoselenazole ring, tetrahydrobenzoselenazole ring, naphthoselenazole ring, benzonaphthoselenazole ring, quinoline ring, 3,3-dialkylindolenine and 3,3-dialkylpyridopyrroline. Any substituent such as one represented by $W_1$ to $W_4$ described later can be substituted on the ring described above.

Examples of the aliphatic group represented by $R_1$, $R_{11}$, $R_{21}$, $R_{22}$, $R_{31}$, and $R_{32}$ include a branched or straight-chained alkyl group having 1 to 10 carbon atoms (e.g., methyl, ethyl, propyl, butyl, pentyl, i-pentyl, 2-ethyl-hexyl, octyl, decyl), an alkenyl group having 3 to 10 carbon atoms (e.g., 2-propenyl, 3-butenyl, 1-methyl-3-propenyl, 3-pentenyl, 1-methyl-3-butenyl, 4-hexenyl), and an aralkyl group having 7 to 10 carbon atoms (e.g., benzyl, phenethyl). These groups may further be substituted with a substituent, including groups such as a lower alkyl group (preferably having 1 to 5 carbon atoms, e.g., methyl, ethyl, propyl), a halogen atom (e.g., fluorine atom, chlorine atom, or bromine atom), a vinyl group, an aryl group (e.g., phenyl, p-tolyl, p-bromophenyl), trifluoromethyl, an alkoxyl group (e.g., methoxy, ethoxy, methoxyethoxy), an aryloxyl group (e.g., phenoxy, p-tolyloxy), cyano, a sulfonyl group (e.g., methanesulfonyl, trifluoromethansulfonyl), p-toluenesulfonyl), an alkoxycarbonyl group (e.g., ethoxycarbonyl, butoxycarbonyl), an amino group (e.g., amino, biscarboxymethylamino), an aryl group (e.g., phenyl, carboxyphenyl), a heterocyclic group (e.g., tetrahydrofurfuryl, 2-pyrrolidinone-1-yl), an acyl group (e.g., acetyl, benzoyl), an ureido group (e.g., ureido, 3-methylureido, 3-phenylureido), a thioureido group (e.g., thioureido, 3-methylthioureido), an alkylthio group (e.g., methylthio, ethylthio), an arylthio group (e.g., phenylthio), a heterocyclic-thio group (e.g., 2-thienythio, 3-thienylthio, 2-imidazolylthio), a carbonyloxy group (e.g., acetyloxy, propanoyloxy, benzoyloxy), an acylamino group (e.g., acetylamino, benzoylamino); and hydrophilic groups, such as a sulfo group, a carboxy group, a phosphono group, a sulfate group, hydroxy, mercapto, sulfino group, a carbamoyl group (e.g., carbamoyl, n-methylcarbamoyl, N,N-tetramethylene-carbamoyl), a sulfamoyl group (e.g., sulfamoyl, N,N-3-oxapentamethylenaminosulfonyl), a sulfonamido group (e.g., methanesulfonamido, butanesulfoneamido), a sulfonylamino-carbonyl group (e.g., methanesulfonylamino-carbonyl, ethanesulfonylaminocarbonyl), an acylaminosulfonyl group (e.g., acetoamidosulfonyl, methoxyacetoamidosulfonyl), an acylaminocarbonyl group (e.g., acetoamidocarbonyl, methoxyacetoamidocarbonyl), and a sulfinylaminocarbonyl group (e.g., methasulfinylaminocarbonyl, ethanesulfinylaminocarbonyl). Examples of aliphatic groups substituted by a hydrophilic group include carboxymethyl, carboxypentyl, 3-sulfatobutyl, 3-sulfopropyl, 2-hydroxy-3-sulfopropyl, 4-sulfobutyl, 5-sulfopentyl, 3-sulfopentyl, 3-sulfinobutyl, 3-phosphonopropyl, hydroxyethyl, N-methanesulfonylcarbamoylmethyl, 2-carboxy-2-propenyl, o-sulfobenzyl, p-sulfobenzyl and p-carboxybenzyl.

The lower alkyl group represented by R include a straight-chained or branched one having 1 to 5 carbon atoms, such as methyl, ethyl, propyl, pentyl and isopropyl. The cycloalkyl group includes, e.g., cyclopropyl, cyclobutyl and cyclopentyl. The aralkyl group includes, e.g., benzyl, phenethyl, p-methoxyphenylmethyl and o-acetylaminophenylethyl; the lower alkoxyl group includes one having 1 to 4 carbon atoms, including methoxy, ethoxy, propoxy and i-propoxy; the aryl group includes substituted or unsubstituted one, such as phenyl, 2-naphthyl, 1-naphthyl, o-tolyl, o-methoxyphenyl, m-chlorophenyl, m-bromophenyl, p-tolyl and p-ethoxyphenyl. These groups may be substituted by a substituent group, such as a phenyl group, a halogen atom (e.g., fluorine atom, chlorine atom, bromine atom, iodine atom), an alkoxy group or hydroxy.

The lower alkyl group represented by Ra or Rb are the same as defined in R.

The lower alkyl group represented by Rc, and Rd includes a straight-chained or branched one having 1 to 5 carbon atoms, such as methyl, ethyl, propyl, pentyl and isopropyl. The cycloalkyl group includes, e.g., cyclopropyl, cyclobutyl and cyclopentyl. The aralkyl group includes, e.g., benzyl, phenethyl, p-methoxyphenylmethyl and o-acetylaminophenyl-ethyl; the aryl group includes substituted or unsubstituted one, such as phenyl, 2-naphthyl, 1-naphthyl, o-tolyl, o-methoxyphenyl, m-chlorophenyl, m-bromophenyl, p-tolyl and p-ethoxyphenyl; and the heterocyclic group includes substituted or unsubstituted one, such as 2-furyl, 5-methyl-2-furyl, 2-thienyl, 2-imidazolyl, 2-methyl-1-imidazolyl, 4-phenyl-2-thiazolyl, 5-hydroxy-2-benzothiazolyl, 2-pyridyl and 1-pyrrolyl. These groups, as described above, may be substituted by a substituent group, such as a phenyl group, a halogen atom, an alkoxy group or hydroxy.

Examples of the substituents represented by $W_1$ to $W_4$, $W_{11}$ to $W_{14}$, $W_{21}$ to $W_{24}$, $W_{31}$ to $W_{34}$, $W_{41}$ to $W_{44}$ and $W_{51}$ to $W_{54}$ include an alkyl group (e.g., methyl, ethyl, butyl, I-butyl), an aryl group (including monocyclic and polycyclic ones such as phenyl and naphthyl), a heterocyclic group (e.g., thienyl, furyl, pyridyl, carbazolyl, pyrrolyl, indolyl), a halogen atom (e.g., fluorine atom, chlorine atom, bromine atom, iodine atom), a vinyl group, trifluoromethyl, an alkoxyl group (e.g., methoxy, ethoxy, methoxyethoxy), an aryloxyl group (e.g., phenoxy, p-tolyloxy), a sulfonyl group (e.g., methanesulfonyl, p-toluenesulfonyl), an alkoxycarbonyl group (e.g., ethoxycarbonyl, ethoxycarbonyl), an amino group (e.g., amino, biscarboxymethylamino), an acyl group (e.g., acetyl, benzoyl), an ureido group (e.g., ureido, 3-methylureido), a thioureido group (e.g., thioureido, 3-methylthioureido), an alkylthio group (e.g., methylthio, ethylthio), an alkenyl thio group, an arylthio group (e.g., phenylthio), hydroxy and styryl.

These groups may be substituted by the same substituents as described in the aliphatic group represented by $R_1$. Examples of substituted alkyl group include 2-methoxyethyl, 2-hydroxyethyl, 3-ethoxycarbonylpropyl, 2-carbamoylethyl, 2-methanesulfonylethyl, 3-methanesulfonylaminopropyl, benzyl, phenethyl, carboxymethyl, carboxymethyl, allyl, and 2-furylethyl. Examples of substituted aryl groups include p-carboxyphenyl, p-N,N-dimethylaminophenyl, p-morpholinophenyl, p-methoxyphenyl, 3,4-dimethoxyphenyl, 3,4-methylene-dioxyphenyl, 3-chlorophenyl, and p-nitrophenyl. Further, examples of substituted heterocyclic group include 5-chloro-2-pyridyl, 2-ethoxycarbonyl-2-pyridyl and 5-carbamoyl-2-pyridyl. $W_1$ and $W_2$, $W_3$ and $W_4$, $W_{11}$ and $W_{12}$, $W_{13}$ and $W_{14}$, $W_{21}$ and $W_{22}$, $W_{23}$ and $W_{24}$, $W_{31}$ and $W_{32}$, $W_{33}$ and $W_{34}$ each pair may combine to form a condensed ring, such as 5- or 6-membered saturated or unsaturated condensed carbon rings, which are further substituted by substituents as described in the aliphatic group.

Among the groups represented by $V_1$ to $V_9$, $V_{11}$ to $V_{13}$, $V_{21}$ to $V_{29}$, and $V_{31}$ to $V_{33}$, the halogen atom includes, e.g., a fluorine atom, chlorine atom, bromine atom and iodine atom; the amino group includes, e.g., amino, dimethylamino, diphenylamino, and methylphenylamino; the alkylthio group includes substituted and substituted ones, such as phenylthio or m-fluorophenylthio; the lower alkyl group includes straight-chained or branched one having five or less carbon atoms, such as methyl, ethyl, propyl, butyl, pentyl or isopropyl; the lower alkoxyl group includes one having four or less carbon atoms, such as methoxy, ethoxy, propoxy, or iso-propoxy; the aryl group includes substituted and unsubstituted ones, such as phenyl, 2-naphthyl, 1-naphthyl, o-tolyl, o-methoxyphenyl, m-chlorophenyl, m-bromophenyl, p-tolyl, and p-ethoxy phenyl; the aryloxyl group includes substituted and unsubstituted ones, such as phenoxy, p-tolyloxy, and m-carboxyphenyloxy; and the heterocyclic group includes substituted or unsubstituted ones, such as 2-furyl, 5-methyl-2-furyl2-thienyl, 2-imidazolyl, 2-methyl-1-imidazolyl, 4-phenyl-2-thiazolyl, 5-hydroxy-2-benzothiazolyl, 2-pyridyl, and 1-pyrrolyl. These groups may further be substituted by a substituent group, such as a phenyl group, a halogen atom, alkoxyl group, or hydroxy. $V_1$ and $V_3$, $V_2$ and $V_4$, $V_3$ and $V_5$, $V_4$ and $V_6$, $V_5$ and $V_7$, $V_6$ and $V_8$, $V_7$ and $V_9$, $V_{11}$ and $V_{13}$, $V_{21}$ and $V_{23}$, $V_{22}$ and $V_{24}$, $V_{23}$ and $V_{25}$, $V_{24}$ and $V_{26}$, $V_{25}$ and $V_{27}$, $V_{26}$ and $V_{28}$, $V_{27}$ and $V_{29}$, and $V_{31}$ and $V_{33}$ each pair may combine to form a 5- to 7-membered ring, such as a cyclopentene ring, cyclohexene ring, cycloheptene ring, and decalin ring, each of which may further be substituted by a lower alkyl group, lower alkoxyl group or aryl group, as described in R.

The methylene group represented by $L_1$ to $L_9$, $L_{11}$ to $L_{15}$ each are a substituted or unsubstituted methylene group. Examples of the substituent thereof include fluorine and chlorine atoms, a substituted or unsubstituted lower alkyl group(e.g., methyl, ethyl, I-propyl, benzyl), and a substituted or unsubstituted alkoxyl group (e.g., methoxy, ethoxy), a substituted or unsubstituted aryloxyl group (e.g., phenoxy, naphthoxy), a substituted or unsubstituted aryl group (e.g., phenyl, naphthyl, p-tolyl, o-carboxyphenyl), $N(U_1)(U_2)$, —SRg, a substituted or unsubstituted heterocyclic group [e.g., 2-thienyl, 2-furyl, N,N'-bis(methoxyethyl)-barbituric acid], in which Rg is a lower alkyl group (preferably having 1 to 5 carbon atoms), an aryl group or a heterocyclic group and examples of —SRg include methylthio, ethylthio, benzylthio, phenylthio and tolylthio groups; $U_1$ and $U_2$ are each a substituted or unsubstituted lower alkyl group or aryl group, provided that $V_1$ and $V_2$ may combine to form a 5- or 6-membered nitrogen containing heterocyclic ring (e.g., pyrazole ring, pyrrol ring, pyrrolidine ring, morpholine ring, piperidine ring, pyridine, pyrimidine ring, etc.). Methylene groups which are adjacent or distant by one may combine to form a 5- or 6-membered ring.

In cases where the compound represented by the foregoing formula (D1), (1—1), (2-1), (D3) or (D4) is substituted with a cationic- or anionic-charged group, a counter ion is formed by an anionic or cationic equivalent to compensate an intramolecular charge. As an ion necessary to compensate the intramolecular charge, which is represented by $X_1$, $X_{11}$, $X_{21}$, or $X_{31}$, examples of cations include a proton, an organic ammonium ion (e.g., triethylammonium, triethanolammonium) and inorganic cations (e.g., cations of lithium, sodium and potassium); and examples of acid anions include halide ions (e.g., chloride ion, bromide ion, iodide ion), p-toluenesulfonate ion, perchlorate ion, tetrafluoroborate ion, sulfate ion, methylsulfate ion, ethylsulfate ion, methanesulfonate ion, trifluoromethanesulfonate ion).

The infrared sensitizing dye according to the invention is preferably a dye characterized in that a three ring-condensed heterocyclic nucleus is formed by bonding between a nitrogen atom contained in a benzothiazole ring and a carbon atom at a peri-position; or that the dye is a long chain polymethine dye, in which a sulfonyl group is substituted on the benzene ring of the benzothiazole ring.

The infrared sensitizing dyes and spectral sensitizing dyes described above can be readily synthesized according to the methods described in F. M. Hammer, The Chemistry of Heterocyclic Compounds vol. 18, "The cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom containing compound having adsorbability onto silver halide, after adding the dye prior to chemical sensitization and allowing it to be adsorbed to silver halide grains, chemical sensitization is conducted, thereby preventing dispersion of chemical sensitization center specks and achieving enhanced sensitivity and minimized fogging.

These sensitizing dyes may be used alone or in combination thereof. The combined use of sensitizing dyes is often employed for the purpose of supersensitization. A supersensitizing compound, such as a dye which does not exhibit spectral sensitization or substance which does not substantially absorb visible light may be incorporated, in combination with a sensitizing dye, into the emulsion containing silver halide grains and organic silver salt grains used in photothermographic imaging materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula (6) is preferred as a supersensitizer:

Ar—SM formula (6)

wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

Ar—S—S—Ar formula (7)

wherein Ar is the same as defined in the mercapto compound represented by the formula described earlier.

The aromatic heterocyclic rings described above may be substituted with a halogen atom (e.g., Cl, Br, I), a hydroxy group, an amino group, a carboxy group, an alkyl group (having one or more carbon atoms, and preferably 1 to 4 carbon atoms) or an alkoxy group (having one or more carbon atoms, and preferably 1 to 4 carbon atoms).

Thiuronium Compound

In addition to the foregoing supersensitizers, a compound described in Japanese Patent Application No. 2000-70296, represented by the following formula (TU) and a macrocyclic compound can also employed as a supersensitizer in the invention:

formula (1)

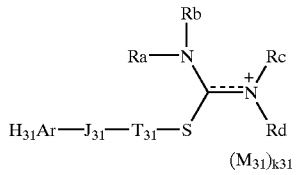

The bivalent, aliphatic hydrocarbon linkage group represented by $T_{31}$ include a straight-chain, branched cyclic alkylene group (preferably having 1 to 20 carbon atoms, more preferably 1 to 16 carbon atoms, and still more preferably 1 to 12 carbon atoms), an alkenylene group (preferably having 2 to 20 carbon atoms, more preferably 2 to 16 carbon atoms, and still more preferably 2 to 12 carbon atoms), an alkynylene group (preferably having 2 to 20 carbon atoms, more preferably 2 to 16 carbon atoms, and still more preferably 2 to 12 carbon atoms), each of which may be substituted by substituent group(s). The aliphatic hydrocarbon group represented by Ra, Rb, Rc, Rd, Re and Rf include, for example, an alkyl group (preferably having 1 to 20 carbon atoms, more preferably 1 to 16 carbon atoms and still more preferably 1 to 12 carbon atoms), an alkenyl group (preferably having 2 to 20 carbon atoms, more preferably 2 to 16 carbon atoms, and still more preferably 2 to 12 carbon atoms), an alkynyl (preferably having 2 to 20 carbon atoms, more preferably 2 to 16 carbon atoms, and still more preferably 2 to 12 carbon atoms) an aryl group (preferably having 6 to 30 carbon atoms, more preferably 6 to 20 carbon atoms, and still more preferably 6 to 12 carbon atoms, e.g., phenyl, naphthyl), and a heterocyclic group (e.g., 2-thiazolyl, 1-piperadynyl, 2-pyridyl, 3-pyridyl, 2-thienyl, 2-benzimidazolyl, carbazolyl, etc.). The heterocyclic group may be a monocyclic ring or a ring condensed with other ring. These groups each may be substituted at any position. Examples of such substituent groups include an alkyl group (including a cycloalkyl group and an aralkyl group, and preferably having 1 to 20 carbon atoms, more preferably 1 to 12 carbon atoms and still more preferably 1 to 8 carbon atoms, such as methyl, ethyl, n-propyl, isopropyl, n-butyl, tert-butyl, n-heptyl, n-octyl, n-decyl, n-undecyl, n-hexadecyl, cyclopropyl, cyclopentyl, cyclohexyl, benzyl, phenethyl), an alkenyl group (preferably having 2 to 20 carbon atoms, more preferably 2 to 12 carbon atoms, and still more preferably 2 to 8 carbon atoms, e.g., vinyl, allyl, 2-butenyl, 3-pentenyl, etc.), an alkynyl (preferably having 2 to 20 carbon atoms, more preferably 2 to 12 carbon atoms, and still more preferably 2 to 8 carbon atoms, e.g., propargyl, 3-pentynyl, etc.), aryl group (preferably having 6 to 30 carbon atoms, more preferably 6 to 20 carbon atoms, and still more preferably 6 to 12 carbon atoms, e.g., phenyl, p-tolyl, o-aminophenyl, naphthyl), an amino group (preferably having 0 to 20 carbon atoms, more preferably 0 10 carbon atoms, and still more preferably 0 to 6 carbon atoms, e.g., amino, methylamino, ethylamino, dimethylamino, diethylamino, diphenylamino, dibenzylamino, etc.), an imino group (preferably having 1 to 20 carbon atoms, more preferably 1 to 18 carbon atoms, and still more preferably 1 to 12 carbon atoms, e.g., methylimono, ethylimono, propylimino, phenylimino), an alkoxy group (preferably having 1 to 20 carbon atoms, more preferably 1 to 12 carbon atoms, and still more preferably 1 to 8 carbon atoms, e.g., methoxy, ethoxy, butoxy, etc.), an aryloxy group (preferably having 6 to 20 carbon atoms, more preferably 6 to 16 carbon atoms and still more preferably 6 to 12 carbon atoms, e.g., phenyloxy, 2-naphthyloxy, etc.), an acyl group (preferably having 1 to 20 carbon atoms, more preferably 1 to 16 carbon atoms, and still more preferably 1 to 12 carbon atoms, e.g., acetyl, formyl, pivaloyl, benzoyl, etc.), an alkoxycarbonyl group (preferably having 2 to 20 carbon atoms, more preferably 2 to 16 carbon atoms, and still more preferably 2 to 12 carbon atoms, e.g., methoxycarbonyl, ethoxycarbonyl, etc.), an aryloxycarbonyl group (preferably having 7 to 20 carbon atoms, more preferably 7 to 16 carbon atoms, and still more preferably 7 to 10 carbon atoms, e.g., phenyloxycarbonyl, etc.), an acyloxy group (preferably having 1 to 20 carbon atoms, more preferably 1 to 16 carbon atoms and still more preferably 1 to 10 carbon atoms, e.g., acetoxy, benzoyloxy, etc.), an acylamino group (preferably having 1 to 20 carbon atoms, more preferably 1 to 16 carbon atoms, and still more preferably 1 to 10 carbon atoms, e.g., acetylamino, benzoylamino, etc.), an alkoxycarbonylamino group (preferably having 2 to 20 carbon atoms, more preferably 2 to 16 carbon atoms, and still more preferably 2 to 12 carbon atoms, e.g., methoxycarbonylamino, etc.), an aryloxycarbonylamino group (preferably having 7 to 20 carbon atoms, more preferably 7 to 16 carbon atoms, and still more preferably 7 to 12 carbon atoms, e.g., phenyloxycarbonylamino, etc.), a sulfonylamino group (preferably having 1 to 20 carbon atoms, more preferably 1 to 16 carbon atoms, and still more preferably 1 to 12 carbon atoms, e.g., methanesulfonylamino, benzenesulfonylamino, etc.), a sulfamoyl group (preferably having 0 to 20 carbon atoms, more preferably 0 to 16 carbon atoms, and still more preferably 0 to 12 carbon atoms, e.g., sulfamoyl, methylsulfamoyl, dimethylsulfamoyl, phenylsulfamoyl, etc.), a carbamoyl group (preferably having 1 to 20 carbon atoms, more preferably 1 to 16 carbon atoms, and still more preferably 1 to 12 carbon atoms, e.g., carbamoyl, methylcarbamoyl, diethylcarbamoyl, phenylcarbamoyl, etc.), an alkylthio group (preferably having 1 to 20 carbon atoms, more preferably 1 to 16 carbon atoms, and still more preferably 1 to 12 carbon atoms, e.g., methylthio, ethylthio, etc.), arylthio group (preferably having 6–20 carbon atoms, more preferably 6 to 16 carbon atoms and still more preferably 6 to 12 carbon atoms, e.g., phenylthio), an alkylsulfonyl or arylsulfonyl group (preferably having 1 to 20 carbon atom, more preferably 1 to 16 carbon atoms, and still more preferably 1 to 12 carbon atoms, e.g., methanesulfonyl, tosyl) an alkylsulfonyl or arylsulfinyl group (preferably having 1 to 20 carbon atoms, more preferably 1 to 16 carbon atoms, and still more preferably 1 to 12 carbon atoms, e.g., methanesulfinyl, benzenesulfinyl, etc.), an ureido group (preferably having 1 to 20 carbon atoms, more preferably 1 to 16 carbon atoms and still more preferably 1 to 12 carbon atoms, e.g., ureido, methylureido, phenylureido ,etc.), a phosphoric acid amido group (preferably having 1 to 20 carbon atoms, more preferably 1 to 16 carbon atoms, and still more preferably 1 to 12 carbon atoms, e.g., diethylphosphoric acid amido, phenylphosphoric acid amido, etc.), hydroxy group, mercapto group, a halogen atom (e.g., fluorine atom, chlorine atom, bromine atom, iodine atom), cyano group, sulfo group, sulfino group, carboxy group, phosphono group, phosphono group, nitro group, hydroxamic acid group, hydrazino group, and a heterocyclic group (e.g., imidazolyl, benzimidazolyl, thiazolyl, benzothiazolyl, carbazolyl, pyridyl, furyl, piperidyl, morphoryl. etc.).

Of these substituent groups described above, hydroxy group, mercapto group, sulfa group, sulfino group, carboxy group, phosphono group, and phosphino group include their salts. The substituent group may be further substituted. In this case, plural substituent may be the same or different. The preferred substituent groups include an alkyl group, aralkyl group, alkoxy group, aryl group, alkylthio group, acyl group, acylamino group, imino group, sulfamoyl group, sulfonyl group, sulfonylamino group, ureido group, amino group, halogen atom, nitro group, heterocyclic group, alkoxycarbonyl group, hydroxy group, sulfa group, carbamoyl group, and carboxy group. Specifically, an alkyl group, alkoxy group, aryl group, alkylthio group, acyl group, acylamino group, imino group, sulfonylamino group, ureido group, amino group, halogen atom nitro group, heterocyclic group, alkoxycarbonyl group, hydroxy group, sulfa group, carbamoyl group and carboxy group are more preferred; and an alkyl group, alkoxy group, aryl group, alkylthio group, acylamino group, imino group, ureido group, amino group, heterocyclic group, alkoxycarbonyl group, hydroxy group, sulfo group, carbamoyl group and carboxy group are still more preferred. The amidino group include a substituted one and examples of the substituent group include an alkyl group (e.g., methyl, ethyl, pyridylmethyl, benzyl, phenethyl, carboxybenzyl, aminophenylmethyl, etc.), an aryl group (e.g., phenyl, p-tolyl, naphthyl, o-aminophenyl, o-methoxyphenyl, etc.), and a heterocyclic group (e.g., 2-thiazolyl, 2-pyridyl, 3-pyridyl, 2-furyl, 3-furyl, 2-thieno, 2-imidazolyl, benzothiazolyl, carbazolyl, etc.).

Examples of a bivalent linking group containing at least one of an oxygen atom, sulfur atom and nitrogen atom, represented by $J_{31}$ include the following groups, which may be combined:

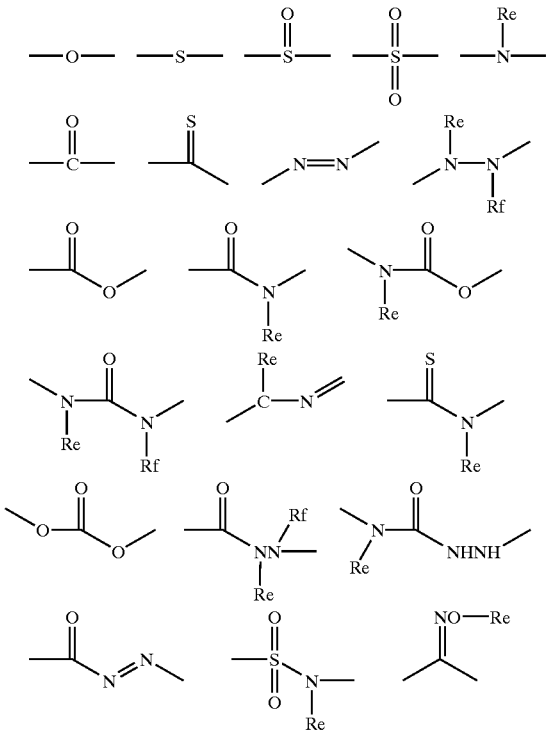

wherein Re and Rf are the same as defined in Ra through Rd.

The aromatic hydrocarbon group represented by $ArH_{31}$ is a monocyclic or condensed aryl group (preferably having 6 to 30 carbon atoms, and more preferably 6 to 20 carbon atoms). Examples thereof include phenyl and naphthyl, and phenyl is preferred. The aromatic heterocyclic group represented by $ArH_{31}$ is a 5- to 10-membered unsaturated heterocyclic group containing at least one of N, O and S, which may be monocyclic or condensed with other ring. A heterocyclic ring of the heterocyclic group is preferably a 5- or 6-membered aromatic heterocyclic ring or its benzo-condensed ring, more preferably a nitrogen-containing, 5- or 6-membered aromatic heterocyclic ring or its benzo-condensed ring, and still more preferably one or two nitrogen-containing, 5- or 6-membered aromatic heterocyclic ring or its benzo-condensed ring.

Examples of the aromatic heterocyclic group include groups derived from thiophene, furan, pyrrole, imidazole, pyrazolo, pyridine, pyrazine, pyridazine, triazole, triazine, indole, indazole, purine, thiadiazole, oxadiazole, quinoline, phthalazine, naphthylizine, quinoxaline, quinazolone, cinnoline, pteridine, acrydine, phenathroline, phenazine, tetrazole, thiazole, oxazole, benzimidazole, benzoxazole, benzthiazole, benzothiazoline, benzotriazole, tetrazaindene, and carbazole. Of these, groups derived from imidazole, pyrazolo, pyridine, pyrazine, indole, indazole, thiadiazole, oxadiazole, quinoline, phenazine, tetrazole, thiazole, oxazole, benzimidazole, benzoxazole, benzthiazole, benzothiazoline, benzotriazole, tetrazaindene, and carbazole are preferred; and groups derived from imidazole, pyridine, pyrazine, quinoline, phenazine, tetrazole, thiazole, benzoxazole, benzoimidazole, benzthiazole, benzothiazoline, benzotriazole, and carbazole are more preferred.

The aromatic hydrocarbon group and aromatic heterocyclic group represented by $ArH_{31}$ may be substituted. The substituent group is the same as the substituent groups defined in $T_{31}$. The substituent group may be further substituted, and plural substituting group may be the same or different. Further, the group represented by $ArH_{31}$ is preferably an aromatic heterocyclic group.

The aliphatic hydrocarbon group represented by Ra, Rb, Rc, Rd, Re and Rf include, for example, an alkyl group (preferably having 1 to 20 carbon atoms, more preferably 1 to 16 carbon atoms and still more preferably 1 to 12 carbon atoms), an alkenyl group (preferably having 2 to 20 carbon atoms, more preferably 2 to 16 carbon atoms, and still more preferably 2 to 12 carbon atoms), an alkynyl (preferably having 2 to 20 carbon atoms, more preferably 2 to 16 carbon atoms, and still more preferably 2 to 12 carbon atoms) an aryl group (preferably having 6 to 30 carbon atoms, more preferably 6 to 20 carbon atoms, and still more preferably 6 to 12 carbon atoms, e.g., phenyl, naphthyl), and a heterocyclic group (e.g., 2-thiazolyl, 1-piperadynyl, 2-pyridyl, 3-pyridyl, 2-thienyl, 2-benzimidazolyl, carbazolyl, etc.). The heterocyclic group may be a monocyclic ring or a ring condensed with other ring. The acyl group represented by Ra, Rb, Rc, Rd, Re and Rf includes an aliphatic or aromatic one, such as acetyl, benzoyl, formyl, and pivaloyl. The nitrogen containing heterocyclic group formed by combination of Ra and Rb, Rc and Rd, Ra and Rc, or Rb and Rd includes a 3- to 10-membered, saturated or unsaturated heterocyclic ring (e.g., ring groups such as piperidine ring, piperazine ring, acridine ring, pyrrolidine ring, pyrrol ring and morpholine ring).

Examples of acid anions used as the ion necessary to neutralize an intramolecular charge, represented by $M_{31}$ include a halide ion (e.g., chloride ion, bromide ion, iodide ion, etc.), p-toluenesulfonate ion, perchlorate ion, tetrafluorobarate ion, sulfate ion, methylsulfate ion, ethylsulfate ion, methansufonic acid ion and trifluoromethanesulfonic acid ion.

The supersensitizer is incorporated into the emulsion layer containing an organic silver salt and silver halide grains, preferably in an amount of 0.001 to 1.0 mol, and more preferably 0.01 to 0.5 mol per mol of silver.

Binder

Binders suitable for photothermographic materials are transparent or translucent and generally colorless, including natural polymers, synthetic polymers or copolymers and film forming mediums. Exemplary examples thereof include gelatin, gum Arabic, polyvinyl alcohol, hydroxyethyl cellulose, cellulose acetate, cellulose acetate butyrate, polyvinyl pyrrolidine, casein, starch, polyacrylic acid, poly (methyl methacrylate), poly(methylmethacrylic acid), polyvinyl chloride, polymethacrylic acid, copoly(styrene-anhydrous maleic acid), copoly(styrene-acrylonitrile), copoly(styrene-butadiene9, polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides, these of which may be hydrophilic or hydrophobic.

Of these, polyvinyl acetals are preferred as a binder used for the light sensitive layer, and polyvinyl acetal is specifically preferred binder. Further, for a light insensitive layer such as an over-coating layer or a sublayer, specifically, a protective layer or a back coating layer are preferred cellulose esters exhibiting a relatively high softening temperature, such as triacetyl cellulose and cellulose acetate-butyrate. The foregoing binders may optionally be used in combination.

The binder is used in an amount within the range effective to function as a binder. The effective range can be readily determined by one skilled in the art. As a measure to hold an organic silver salt in the light sensitive layer, the ratio by weight of a binder to an organic silver salt is preferably 15:1 to 1:2, and more preferably 8:1 to 1:1. Thus, the amount of a binder in the light sensitive layer is preferably 1.5 to 6 $g/m^2$, and more preferably 1.7 to 5 $g/m^2$. The amount of less than 1.5 $g/m^2$ results in an increase in unexposed areas, leading to levels unacceptable in practical use.

Aqueous Coating

In cases where a coating solution to form a light sensitive layer of the photothermographic imaging material contains an aqueous-dispersed polymer latex, at least 50% by weight of a total binder content of the light sensitive layer-coating solution is preferably accounted for by the aqueous-dispersed polymer latex. Alternatively, in cases where the light sensitive layer contains a polymer latex, the polymer latex preferably accounts for at least 50% by weigh, and more preferably at least 70% by weight of a total binder content of the light sensitive layer.

Herein, the polymer latex is a water-insoluble polymeric material which is dispersed in an aqueous dispersing medium in the form of fine particles. The dispersion form thereof may be any one of a form in which a polymer is emulsified in a dispersing medium, a form of being emulsion-polymerized, being dispersed in the form of a micell and a form in which a polymer has a hydrophilic partial structure and its molecular chain is in the form of a molecular dispersion.

The mean particle size of dispersing particles is 1 to 50,000 nm, and preferably 5 to 1,000 nm. The particle size distribution thereof is not specifically limited and may be of broad size distribution or monodisperse.

The polymeric latexes used in the invention may be those having a uniform structure as well as core/shell type latexes. In this case, it is sometimes preferred that the glass transition temperature is different between the core and shell. The minimum film-forming (or tarnishing) temperature (MFT) of the polymeric latexes is preferably −30 to 90° C., and more preferably 0 to 70° C. A tarnishing aid is also called a plasticizer, which is an organic compound (conventionally, an organic solvent) capable of lowering the MFT of a polymeric latex and described in "Chemistry of Synthetic Latex" (S. Muroi, published by KOBUNSHI-KANKOKAI, 1970).

Polymers used for polymeric latexes include acryl resin, vinyl acetate resin, polyester resin, polyurethane resin, rubber type resin, vinyl chloride resin, vinylidene chloride resin, polyolefin resin and their copolymers. Polymers may be a straight-chained polymer or branched polymer, or a cross-linked polymer, including homopolymers and copolymers. The copolymer may be a random copolymer or a block copolymer. The number-averaged molecular weight of the copolymer is preferably 5,000 to 1000,000, and more preferably 10,000 to 100,000. In cases where the molecular weight is excessively small, mechanical strength of an light sensitive layer such as a light-sensitive layer is insufficient, excessively large molecular weight results in deterioration in film forming property.

The polymer latex used in the invention preferably exhibits an equlibrium moisture content at 25° C. and 60% RH (relative humidity) of 0.01 to 2%, and more preferably 0.01 to 1% by weight. The definition and measurement of the equlibrium moisture content are described, for example, in "KOBUNSHIKOGAKU-KOZA 14: KOBUNSHIZAIRYO SHIKENHO" (Polymer Engineering Series 14.: Polymer Material Test Method), edited by Kobunshi Gakkai, published by Chijin Shoin.

Exemplary examples of polymer latexes used as binder include a latex of methylmethacrylate/ethylmethacrylate/methacrylic acid copolymer, a latex of methylmethacrylate/2-ethylhexylacrylate/styrene/acrylic acid copolymer, a latex of styrene/butadiene/acrylic acid copolymer, a latex of styrene/butadiene/divinylbenzene/methacrylic acid copolymer, a latex of methylmethacrylate/vinyl chloride/acrylic acid copolymer, and a latex of vinylidene chloride/ethylacrylate/acrylonitrile/methacrylic acid copolymer. These polymers may be used alone or may be blended.

Polymer latexes used in the invention may be used alone or in combination. The polymer latex preferably contains, as polymer species, 0.1 to 10% by weight of a carboxylic acid component, such as an acrylate or methacrylate component. Further, a hydrophilic polymer such as gelatin, polyvinyl alcohol, methyl cellulose, hydroxypropyl cellulose, carboxymethyl cellulose and hydroxypropylmethyl cellulose may be added within the range of not more than 50% by weight of the total binder. The hydrophilic binder is added preferably in an amount of not more than 30% by weight, based on the total binder of the light sensitive layer.

In preparation of a coating solution to form the light sensitive layer, an organic silver salt and an aqueous-dispersed polymer latex may be added in any order, i.e., either one may be added in advance or both ones may be simultaneously added, but the polymer latex is preferably added later. It is further preferred that the organic silver salt is mixed with a reducing agent prior to addition of the polymer latex. After mixing the organic silver salt and polymer latex, the coating solution is preferably maintained at a temperature of 30 to 65° C., more preferably 35 to 60° C., and still more preferably 35 to 55° C. since there are problems such that an excessively low temperature often vitiates the coat surface and an excessively high temperature results in increased fogging. To maintain such a temperature, a vessel to prepare the coating solution may be maintained a prescribed temperature. In coating a coating solution of the light sensitive layer, after mixing the organic silver salt and aqueous-dispersed polymer latex, a coating solution aged for 30 min to 24 hrs. is preferably used and a coating solution aged for 1 to 12 hrs. is more preferred. Herein, the expression "after mixing" refers to after the organic silver salt and the aqueous-dispersed polymer latex are added and additives are homogeneously dispersed.

Cross-Linking Agent

Although it is commonly known that the use of a cross-linking agent in such a binder as described above improves layer adhesion and lessens unevenness in development, the use of the crosslinking agent is also effective in fog inhibition during storage and prevention of print-out after development.

Crosslinking agents usable in the invention include various commonly known crosslinking agents used for photographic materials, such as aldehyde type, epoxy type, vinylsulfon type, sulfonester type, acryloyl type, carbodiimide type crosslinking agents, as described in JP-A 50-96216. Specifically preferred are an isocyanate type compound, epoxy compound and acid anhydride, as shown below. One of the preferred crosslinking agents is an isocyanate or thioisicyanate compound represented by formula (1) described earlier.

The crosslinking agents of formula (1) are used preferably in an amount of 0.001 to 2 mol, and more preferably 0.005 to 0.5 mol per mol of silver.

Silane Compound

Examples of silane compounds used as a crosslinking agent include the compounds represented by the following formula (1) or (2), as described in Japanese Patent Application No. 12-077904:

$$(R^{11}O)_m—Si—(L_1—R^{12})_n \qquad \text{formula (1)}$$

formula (2)

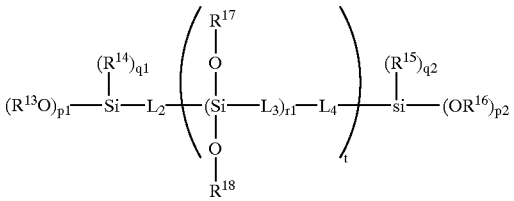

wherein $R^1$, $R^2$, $R^3$, $R^4$, $R^5$, $R^6$, $R^7$ and $R^8$ are each a straight chain, branched or cyclic alkyl group having 1 to 30 carbon atoms (e.g., methyl, ethyl, butyl, octyl, dodecyl, cycloalkyl, alkenyl group (e.g., propenyl, butenyl, nonanyl), an alkynyl group (e.g., acetylene group, bisacetylene group, phenylacetylene group), an aryl group (e.g., phenyl, naphthyl) or a heterocyclic group (e.g., tetrahydropyran, pyridyl group, furyl, thiophenyl, imidazolyl, thiazolyl, thiazolyl, oxadiazolyl). These groups may be substituted and substituent groups include any one of electron-withdrawing and electron-donating groups. Examples of the substituent groups include an alkyl group having 1 to 25 carbon atoms (e.g., methyl, ethyl, propyl, isopropyl, tert-butyl, pentyl, hexyl, cyclohexyl), halogenated alkyl group (e.g., trifluoromethyl, perfluorooctyl), cycloalkyl group (e.g., cyclohexyl, cyclopentyl), alkynyl group (e.g., propargyl group), glycidyl group, acrylate group, methacrylate group, aryl group (e.g., phenyl), heterocyclic group (e.g., pyridyl, thiazolyl, oxazolyl, imidazolyl, furyl, pyrrolyl, pirazinyl, pyrimidinyl, pyridazinyl, selenazolyl, sulforanyl, piperidinyl, pyrazolyl, tetrazolyl), halogen atom (chlorine, brominem iodine , fluorine), alkoxy group (methoxy, ethoxy, propyloxy, pentyloxy, hexyloxy), aryloxy (e.g., phenoxy), alkoxycarbonyl group (e.g., methyloxycarbonyl, ethyloxycarbonyl, butyloxycarbonyl), aryloxycarbonyl (phenyloxycarbonyl), sulfonamido group (methanesulfonamido, ethanesulfonamido, butanesulfoneamido, hexanesulfonamido, cyclohexanesulfonamido, benzenesulfonamido), sulfamoyl group (e.g., aminosulfonyl, methylaminosulfonyl, dimethylaminosulfonyl, butylaminosulfonyl, hexylaminosulfonyl, cyclohexylaminosulfonyl, phenylaminosulfonyl, 2-pyridylaminosulfonyl), urethane group (e.g., methylureido, ethylureido, pentylureido, cyclohexylureido, phenylureido, 2-pyridylureido), acyl group (e.g., acetyl, propionyl, butanoyl, hexanoyl, cyclohexanoyl, benzoyl, pyridinoyl), carbamoyl group (e.g., amiocarbonyl, methylaminocarbonyl, dimethylaminocarbonyl, propylaminocarbonyl, pentylaminocarbonyl, cyclohexylaminocarbonyl, phenylaminocarbonyl, 2-pyridylamonpcarbonyl), amido group (acetoamide, propionamido, butaneamido, hexaneamido, benzamido), sulfonyl group (e.g., methylsulfinyl, ethylsulfinyl, butylsulfonyl, cyclohexylsulfonyl, phenylsulfinyl, 2-pyridylsulfonyl), amino group (e.g., amino, ethylamino, dimethylamino, butylamino, cyclopentylamino, anilino, 2-pyridylamino), cyano group, nitro group, sulfo group, carboxy group, hydroxy group and oxamoyl group. These substituent groups may be further substituted with the foregoing substituent groups. $L_1$, $L_2$, $L_3$ and $L_4$ are each a bivalent linkage group, including an alkylene group (e.g., ethylene, propylene, butylenes, hexamethylene), oxyalkylene group (e.g., oxyethylene, oxypropylene, oxybutylene, oxyhexamethylene, or group comprised of plural these repeating units), aminoalkylene group (e.g., aminoethylene, aminopropylene, aminohexamethylene, or a group comprised of plural these repeating units), and carboxyalkylene group (e.g., carboxyethylene, carboxypropylene, carboxybutylene), thioether group, oxyether group, sulfonamido group and carbamoyl group. At least one of $R^1$ and $R^2$ in formula (1), or at least one of $R^3$, $R^4$, $R^5$, $R^6$, $R^7$ and $R^8$ in formula (2) preferably is a ballast group (or a diffusion-proof group) or an adsorption-promoting group, and more preferably, $R^2$ is a ballast group or an adsorption-promoting group. The ballast group is preferably an aliphatic group having 6 or more carbon atoms or an aryl group substituted with an alkyl group having 3 or more carbon atoms. Introduction of the ballast group, depending on the amount of a binder or crosslinking agent, restrains diffusion at room temperature, preventing reaction during storage.

Epoxy Compound

The epoxy compound usable in the invention may be any one containing at least one epoxy group and is not limited with respect to the number of the epoxy group, molecular weight and other parameters. The epoxy group is preferably contained in the form of a glycidyl group through an ether bond or an imino bond in the molecule. The epoxy compound may be any one of a monomer, oligomer and polymer, in which the number of the epoxy group in the molecule is preferably 1 to 10 and more preferably 2 to 4. In cases where the epoxy compound is a polymer, it may be either one of a homopolymer and a copolymer. The number-averaged molecular weight (Mn) thereof is preferably 2,000 to 20,000.

The epoxy compounds may be used alone or combination thereof. The amount to be added is not specifically limited, but preferably $1\times10^{-6}$ to $1\times10^{-2}$ mol/m$^2$, and more preferably $1\times10^{-5}$ to $1\times10^{-3}$ mol/m$^2$. The epoxy compound may be added to any layer of a photosensitive layer, surface protective layer, interlayer, antihalation layer and subbing layer provided on the photosensitive layer-side of the support and may be added to one or plurality of these layers. Further, it may be added to a layer provided on the opposite side of the support, in combination with the photosensitive layer-side. In the case of a photothermographic material having photosensitive layers on both sides of the support, it may be added to any one of the layers.

Acid Anhydride

Acid anhydride used in the invention is preferably a compound containing at least an acid anhydride group represented as below:

—CO—O—CO—

The acid anhydride usable in the invention may be any compound containing one or more acid anhydride group, the number of the acid anhydride group, molecular weight or other parameters are not specifically limited.

The acid anhydride compound may be used alone or combination thereof. The amount to be added is not specifically limited, but preferably $1\times10^{-6}$ to $1\times10^{-1}$ mol/m$^2$, and more preferably $1\times10^{-4}$ to $1\times10^{-2}$ mol/m$^2$. The acid anhydride compound may be added to any layer of a photosensitive layer, surface protective layer, interlayer, antihalation layer and subbing layer provided on the photosensitive layer-side of the support and may be added to one or plurality of these layers. Further, it may be added to a layer containing the foregoing epoxy compound.

Toning Agent

Exemplary preferred toning agents are described in RD17029, U.S. Pat. Nos. 4,123,282, 3,994,732, 3,846,136 and, 4,021,249. Examples thereof include imides (succinimide, phthalimide, naphthalimide, N-hydroxy-1,8-naphthalimide, etc.); mercaptanes (e.g., 3-mercapto-1,2,4-triazole, etc.); phthalazinone derivatives and their metal salt [e.g., phthalazinone, 4-(1-naphthyl)phthalazinone, 6-chlorophthalazinone, 5,7-dimethyloxyphthalazinone, 2,3-dihydroxy-1,4-phthalzinedione, etc.]; combinations of phthalazine and phthalic acids (e.g., phthalic acid, 4-methylphthalic acid, 4-nitrophthalic acid, tetrachlorophthalic acid, etc.); and combinations of phthalazine and at least one selected from maleic acid anhydride, phthalic acid, 2,3,-naphthalenedicarboxylic acid, and o-phenyleneacid derivatives and their anhydrides (e.g., phthalic acid, 4-methyphthalic acid, 4-nitrophthalic acid, tetrachlorophthalic acid, etc.). Specifically preferred toning agents include phthalazinone, a combination of phthalazine, and phthalic acids or phthalic acid anhydrides.

Matting Agent

In the present invention, a matting agent is preferably incorporated into the surface layer of the photothermographic imaging material (on the light sensitive layer side or even in cases where a light insensitive layer is provided on the opposite side of the support to the light sensitive layer). In order to minimize the image abrasion after thermal development, the matting agent is provided on the surface of a photosensitive material and the matting agent is preferably incorporated in an amount of 1 to 30% by weight of the binder.

Materials of the matting agent employed in the invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The matting agent used in the invention preferably has an average particle diameter of 0.5 to 10 $\mu$m, and more preferably of 1.0 to 8.0 $\mu$m. Furthermore, the variation coefficient of the size distribution is preferably not more than 50%, is more preferably not more than 40%, and is still more preferably not more than 30%. The variation coefficient of the grain size distribution as described herein is is a value represented by the following formula:

(standard deviation of particle size/average particle size)×100.

Addition methods of the matting agent include those in which a matting agent is previously dispersed into a coating composition and is then coated, and prior to the completion of drying, a matting agent is sprayed. When plural matting agents are added, both methods may be employed in combination.

Support

Suitable supports used in the photothermographic imaging materials of the invention include various polymeric materials, glass, wool cloth, cotton cloth, paper, and metals (such as aluminum). Flexible sheets or roll-convertible one are preferred. Examples of preferred support used in the invention include plastic resin films such as cellulose acetate film, polyester film, polyethylene terephthalate film, polyethylene naphthalate film, polyamide film, polyimide film, cellulose triacetate film and polycarbonate film, and biaxially stretched polyethylene terephthalate (PET) film is specifically preferred. The support thickness is 50 to 300 $\mu$m, and preferably 70 to 180 $\mu$m.

To improve electrification properties of photothermographic imaging materials, metal oxides and/or conductive compounds such as conductive polymers may be incorporated into the constituent layer. These compounds may be incorporated into any layer and preferably into a sublayer, a backing layer, interlayer between the light sensitive layer and the sublayer. Conductive compounds described in U.S. Pat. No. 5,244,773, col. 14-20.

Dye

It is preferred to form a filter layer on the same side as or on the opposite side to the light sensitive layer or to allow a dye or pigment to be contained in the light sensitive layer to control the amount of wavelength distribution of light transmitted through the light sensitive layer of photothermographic imaging materials relating to the invention. Commonly known compounds having absorptions in various wavelength regions can used as a dye, in response to spectral sensitivity of the photothermographic material. In cases where the photothermographic imaging material relating to the invention are applied as a image recording material using infrared light is preferred the use of squarilium dye containing a thiopyrylium nucleus (also called as thiopyrylium squarilium dye), squarilium dye containing a pyrylium nucleus (also called as pyrylium squarilium dye), thiopyrylium chroconium dye similar to squarilium dye or pyrylium chroconium. The compound containing a squarilium nucleus is a compound having a 1-cyclobutene-2-hydroxy-4one in the molecular structure and the compound containing chroconium nucleus is a compound having a 1-cyclopentene-2-hydroxy, 4,5-dione in the molecular structure, in which the hydroxy group may be dissociated. Hereinafter, these dyes are collectively called a squarilium dye.

In the invention, compounds represented by the following formula (1) are preferably employed:

formula (1)

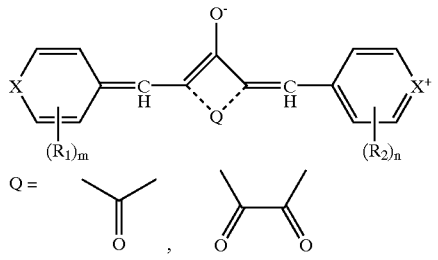

wherein $R_1$ and $R_2$ are each a univalent substituent group. The substituent groups are not limited, and prferably an alkyl group (e.g., methyl, ethyl, isopropyl, tert-butyl, methoxyethyl, methoxyethoxyethyl, 2-ethylhexyl, 2-hexyldecyl, benzyl, etc.) and an aryl groyp (e.g., phenyl, 4-chlorophenyl, 2,6-dimethylphenyl, etc.), more preferably an alkyl group, and still more preferably tert-butyl. $R_1$ and $R_2$ may combine with each other to form a ring; m and n are each an integer of 0 to 4, and preferably 0, 1 or 2. Compounds described in JP-A 8-201959 are also preferably usable as a dye.

Coating Technique

Materials used in respective constituent layers are dissolved or dispersed in solvents to prepare coating solutions, which were coated on the support and further subjected to a heating treatment to form a photothermographic material. In one preferred embodiment of the invention, plural coating solutions are simultaneously coated to form multi-layers and then subjected to a heating treatment. Thus, coating solutions for respective constituent layers (for example, light-sensitive layer, protective layer) and coating and drying are not repeated for respective layers but plural layers are simultaneously coated and dried to form respective constituent layers. The upper layer is provided before the remaining amount of total solvents in the lower layer reaches 70% or less.

Methods for simultaneously coating plural constituent layers are not specifically limited and commonly known methods, such as a bar coating method, curtain coating method, air-knife method, hopper coating method and extrusion coating method are applicable. Of these, extrusion coating, that is, pre-measuring type coating is preferred. The extrusion coating is suitable for accurate coating or organic solvent coating since no evaporation occur on the slide surface, as in a slide coating system. This coating method is applicable not only to the light-sensitive layer side but also to the case when simultaneously coating a backing layer with the sublayer.

Development Condition

The developing conditions for photographic materials are variable, depending on the instruments or apparatuses used, or the applied means and typically accompany heating the imagewise exposed photothermographic imaging material at an optimal high temperature. Latent images formed upon exposure are developed by heating the photothermographic material at an intermediate high temperature (ca. 80 to 200° C., and preferably 100 to 200° C.) over a period of ample time (generally, ca. 1 sec. to ca. 2 min.). Sufficiently high image densities cannot be obtained at a temperature lower than 80° C. and at a temperature higher than 200° C., the binder melts and is transferred onto the rollers, adversely affecting not only images but also transportability or the thermal processor. An oxidation reduction reaction between an organic silver salt (functioning as an oxidant) and a reducing agent is caused upon heating to form silver images. The reaction process proceeds without supplying any processing solution such as water from the exterior. Heating instruments, apparatuses and means include typical heating means such as a hot plate, hot iron, hot roller or a heat generator employing carbon or white titanium. In the case of a photothermographic imaging material provided with a protective layer, it is preferred to thermally process while bringing the protective layer side into contact with a heating means, in terms of homogeneous-heating, heat efficiency and working property. It is also preferred to conduct thermal processing while transporting, while bringing the protective layer side into contact with a heated roller.

Exposure Condition

Exposure of photothermographic imaging materials desirably uses a light source suitable to the spectral sensitivity of the photothermographic materials. An infrared-sensitive photothermographic material, for example, is applicable to any light source in the infrared light region but the use of an infrared semiconductor laser (780 nm, 820 nm) is preferred in terms of being relatively high power and transparent to the photothermographic material.

In the invention, exposure is preferably conducted by laser scanning exposure and various methods are applicable to its exposure. One of the preferred embodiments is the use of a laser scanning exposure apparatus, in which scanning laser light is not exposed at an angle substantially vertical to the exposed surface of the photothermographic material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photothermographic material is scanned with laser light, the beam spot diameter on the surface of the photosensitive material is preferably not more than 200 μm, and more preferably not more than 100 μm. Thus, the smaller spot diameter preferably reduces the angle displaced from verticality of the laser incident angle. The lower limit of the beam spot diameter is 10 μm. The thus configured laser scanning exposure can reduce deterioration in image quality due to reflected light, such as occurrence of interference fringe-like unevenness.

In the second preferred embodiment of the invention, exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

In the third preferred embodiment of the invention, it is preferred to form images by scanning exposure using at least two laser beams. The image recording method using such plural laser beams is a technique used in image-writing means of a laser printer or a digital copying machine for writing images with plural lines in a single scanning to meet requirements for higher definition and higher speed, as described in JP-A 60-166916. This is a method in which laser light emitted from a light source unit is deflection-scanned with a polygon mirror and an image is formed on the photoreceptor through an fθ lens, and a laser scanning optical apparatus similar in principle to an laser imager.

In the image-writing means of laser printers and digital copying machines, image formation with laser light on the photoreceptor is conducted in such a manner that displacing one line from the image forming position of the first laser light, the second laser light forms an image from the desire of writing images with plural lines in a single scanning. Concretely, two laser light beams are close to each other at a spacing of an order of some ten μm in the sub-scanning direction on the image surface; and the pitch of the two beams in the sub-scanning direction is 63.5 μm at a printing density of 400 dpi and 42.3 μm at 600 dpi (in which the printing density is represented by "dpi", i.e., the number of dots per inch). As is distinct from such a method of displacing one resolution in the sub-scanning direction, one feature of the invention is that at least two laser beams are converged on the exposed surface at different incident angles to form images. In this case, when exposed with N laser beams, the following requirement is preferably met: when the exposure energy of a single laser beam (of a wavelength of λ nm) is represented by E, writing with N laser beam preferably meets the following requirement:

$$0.9\times E \leqq En\times N \leqq 1.1\times E$$

in which E is the exposure energy of a laser beam of a wavelength of λ nm on the exposed surface when the laser beam is singly exposed, and N laser beams each are assumed to have an identical wavelength and an identical exposure energy (En). Thereby, the exposure energy on the exposed surface can be obtained and reflection of each laser light onto the image forming layer is reduced, minimizing occurrence of an interference fringe.

In the foregoing, plural laser beams having a single wavelength are employed but lasers having different wavelengths may also be employed. In such a case, the wavelengths preferably fall within the following range:

$$(\lambda-30)<\lambda_1, \lambda_2, \ldots \lambda_n<(\lambda+30).$$

In the first, second and third preferred embodiments of the image recording method of the invention, lasers for scanning exposure used in the invention include, for example, solid-state lasers such as ruby laser, YAG laser, and glass laser; gas lasers such as He—Ne laser, Ar laser, Kr ion laser, $CO_2$ laser, Co laser, He—Cd laser, $N_2$ laser and eximer laser; semiconductor lasers such as InGa laser, AlGaAs laser, GaAsP laser, InGaAs laser, InAsP laser, $CdSnP_2$ laser, and GSb laser; chemical lasers; and dye lasers. Of these, semiconductor lasers of wavelengths of 600 to 1200 nm are preferred in terms of maintenance and the size of the light source. When exposed onto the photothermographic imaging material in the laser imager or laser image-setter, the beam spot diameter on the exposed surface is 5 to 75 μm as a minor axis diameter and 5 to 100 μm as a major axis diameter. The laser scanning speed is set optimally for each photothermographic material, according to its sensitivity at the laser oscillation wavelength and the laser power.

EXAMPLES

Embodiments of the present invention will be further described based on examples but the invention is by no means limited to these.

Example 1

Preparation of a Subbed PET Photographic Support

Both surfaces of a biaxially stretched thermally fixed, blue-tinted 175 μm PET film, which exhibited an optical density of 0.170 and was commercially available, was subjected to corona discharging at 8 w/m$^2$·min. Onto one side thereof, the subbing coating composition a-1 descried below was applied so as to form a dried layer thickness of 0.8 μm, which was then dried. The resulting coating was designated Subbing Layer A-1. Onto the opposite side, the subbing coating composition b-1 described below was applied to form a dried layer thickness of 0.8 μm. The resulting coating was designated Subbing Layer B-1.

| Subbing Coating Composition a-1 | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1,6-bis (ethyleneurea) | 0.8 g |
| Water to make | 1 liter |
| **Subbing Coating Composition b-1** | |
| Latex liquid (solid portion of 30%) of a copolymer consisting of butyl acrylate (40 weight %) styrene (20 weight %) glycidyl acrylate (25 weight %) | 270 g |
| (C-1) | 0.6 g |

-continued

| | |
|---|---|
| Hexamethylene-1,6-bis (ethyleneurea) | 0.8 g |
| Water to make | 1 liter |

Subsequently, the surfaces of Subbing Layers A-1 and B-1 were subjected to corona discharging with 8 w/m$^2$·minute. Onto the Subbing Layer A-1, the upper subbing layer coating composition a-2 described below was applied so as to form a dried layer thickness of 0.8 $\mu$m, which was designated Subbing Layer A-2, while onto the Subbing Layer B-1, the upper subbing layer coating composition b-2 was applied so at to form a dried layer thickness of 0.8 $\mu$m, having a static preventing function, which was designated Subbing Upper Layer B-2.

| Upper Subbing Layer Coating Composition a-2 | |
|---|---|
| Gelatin in an amount (weight) to make 0.4 g/m$^2$ | |
| (C-1) | 0.2 g |
| (C-2) | 0.2 g |
| (C-3) | 0.1 g |
| Silica particles (av. size 3 $\mu$m) | 0.1 g |
| Water to make | 1 liter |
| **Upper Subbing Layer Coating Composition b-2** | |
| (C-4) | 60 g |
| Latex solution (solid 20% comprising) (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

C-1

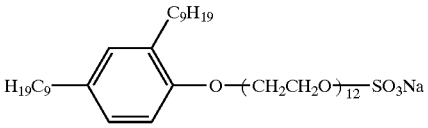

C-2

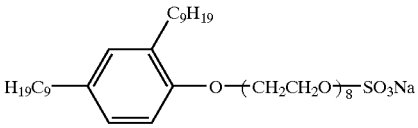

C-3

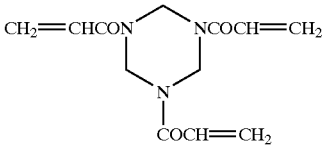

C-4

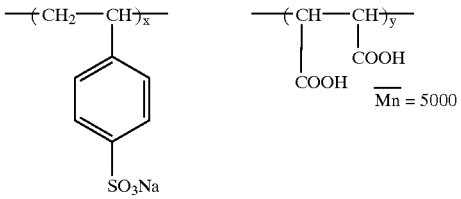

(Mn is a number average molecular weight)
x:y = 75:25 (weight ratio)

-continued

C-5

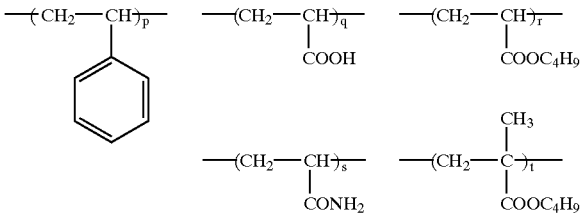

p:q:r:s:t = 40:5:10:5:40
(weight ratio)

C-6

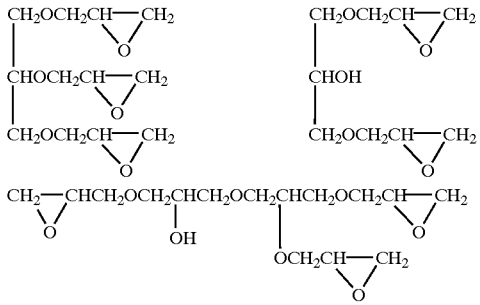

Mixture consisting of the three compounds illustrated above

Preparation of Backing Layer Coating Solution

To 830 g of methyl ethyl ketone (MEK), 84.2 g of cellulose acetate-butyrate (CAB381-20, available from Eastman Chemical Co.) and 4.5 g of polyester resin (Vitel PE2200B, available from Bostic Corp.) were added with stirring and dissolved therein. To the resulting solution was added 0.30 g of infrared dye 1, then, 4.5 g fluorinated surfactant (Surflon KH40, available from ASAHI Glass Co. Ltd.) and 2.3 g fluorinated surfactant (Megafag F120K, available from DAINIPPON INK Co. Ltd.) which were dissolved in 43.2 g methanol, were added thereto and stirred until being dissolved. Then, 75 g of silica (Siloid 64×6000, available from W. R. Grace Corp.), which was dispersed in methyl ethyl ketone in a concentration of 1 wt % using a dissolver type homogenizer, was further added thereto with stirring to obtain a coating solution for the backing layer.

| Preparation of Light-sensitive Silver Halide Emulsion 1A | |
|---|---|
| **Solution A1** | |
| Phenylcarbamoyl gelatin | 88.3 g |
| Compound (A) (10% methanol solution) | 10 ml |
| Potassium bromide | 0.32 g |
| Water to make | 5429 ml |
| **Solution B1** | |
| 0.67 mol/l Aqueous silver nitrate solution | 2635 ml |
| **Solution C1** | |
| Potassium bromide | 51.55 g |
| Potassium iodide | 1.47 g |
| Water to make | 660 ml |
| **Solution D1** | |
| Potassium bromide | 154.9 g |
| Potassium iodide | 4.41 g |
| Iridium chloride (1% solution) | 0.93 ml |
| Water to make | 1982 ml |

-continued

| Preparation of Light-sensitive Silver Halide Emulsion 1A | |
|---|---|
| Solution E1 | |
| 0.4 mol/l aqueous potassium bromide solution | Amount necessary to adjust silver potential |
| Solution F1 | |
| Potassium hydroxide | 0.71 g |
| Water to make | 20 ml |
| Solution G1 | |
| Aqueous 56% acetic acid solution | 18 ml |
| Solution H1 | |
| Anhydrous sodium carbonate | 1.72 g |
| Water to make | 151 ml |
| compound (A) | |
| $HO(CH_2CH_2O)_n—(CH(CH_3)CH_2O)_{17}—(CH_2CH_2O)_mH$ | |

(m + n = 5 to 7)

Using a stirring mixer described in JP-B 58-58288 and 58-58289, ¼ of solution B1, the total amount of solution C1 were added to solution A1 by the double jet addition for 4 min 45 sec. to form nucleus grain, while maintaining a temperature of 45° C. and a pAg of 8.09. After 1 min., the total amount of solution F1 was added thereto. After 6 min, ¾ of solution B1 and the total amount of solution D1 were further added by the double jet addition for 14 min 15 sec., while mainlining a temperature of 45° C. and a pAg of 8.09. After stirring for 5 min., the reaction mixture was lowered to 40° C. and solution G1 was added thereto to coagulate the resulting silver halide emulsion. Remaining 2000 ml of precipitates, the supernatant was removed and after adding 10 lit. water with stirring, the silver halide emulsion was again coagulated. Remaining 1500 ml of precipitates, the supernatant was removed and after adding 10 lit. water with stirring, the silver halide emulsion was again coagulated. Remaining 1500 ml of precipitates, the supernatant was removed and solution H1 was added. The temperature was raised to 60° c. and stirring continued for 120 min. Finally, the pH was adjusted to 5.8 and water was added there to so that the weight per mol of silver was 1161 g, and light-sensitive silver halide emulsion A was thus obtained.

It was proved that the resulting emulsion was comprised of monodisperse silver iodobromide cubic grains having an average grain size of 0.058 μm, a coefficient of variation of grain size of 12% and a [100] face ratio of 92%.

Preparation of Powdery Organic Silver Salt 1A

Behenic acid of 130.8 g, arachidic acid of 67.7 g, stearic acid of 43.6 g and palmitic acid of 2.3 g were dissolved in 4720 ml of water at 90° C. Then, 540.2 ml of aqueous 1.4 mol/l NaOH was added, and after further adding 6.9 ml of concentrated nitric acid, the mixture was cooled to 55° C. to obtain a fatty acid sodium salt solution. To the thus obtained fatty acid sodium salt solution, 45.3 g of light-sensitive silver halide emulsion B-3 obtained above and 450 ml of water were added and stirred for 5 min., while being maintained at 55° C. Subsequently, 760 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm. Using a flush jet dryer (produced by Seishin Kigyo Co., Ltd.), the thus obtained cake-like organic silver salt was dried under an atmosphere of inert gas (i.e., nitrogen gas) having a volume ratio shown in Table 1, according to the operation condition of a hot air temperature at the inlet of the dryer until reached a moisture content of 0.1%. The moisture content was measured by an infrared ray aquameter.

Preparation of Pre-Dispersion 1A

In 1457 g MEK was dissolved 14.57 g of polyvinyl butyral powder (B-79, available from Monsanto Co.) and further thereto was gradually added 500 g of powdery organic silver salt 1A to obtain pre-dispersion, while stirring by a dissolver type homogenizer (DISPERMAT Type CA-40, available from VMA-GETZMANN).

Preparation of Light-Sensitive Emulsion 1A

Thereafter, using a pump, the thus prepared pre-dispersion was transferred to a media type dispersion machine (DISPERMAT Type SL-C12 EX, available from VMA-GETZMANN), which was packed 1 mm Zirconia beads (TORESELAM, available from Toray Co. Ltd.) by 80%, and dispersed at a circumferential speed of 8 m/s and for 1.5 min. of a retention time with a mill to obtain light-sensitive emulsion 1A.

Preparation of Stabilizer Solution 1A

In 10.1 g of methanol were dissolved 0.9 g of Stabilizer 1 and 0.28 g of potassium acetate to obtain stabilizer solution.

Preparation of Infrared Sensitizing Dye Solution 1A

In 110 g of MEK were dissolved 45.3 mg of infrared sensitizing dye No. S-43, 2.50 g of 2-chlorobenzoic acid, 18.6 g of Stabilizer 2 and 1.07 g of 5-methyl-2-mercaptobenzimidazole in a dark room to obtain an infrared sensitizing dye solution 1A.

Preparation of Additive Solution 1a

In 110 g MEK were dissolved developer 1,1-bis(2-hydroxy-3,5-dimethylphenyl)-2-methylpropane [compound of formula (2)] in an amount shown in Tables 1 and 2, 6.72 g of 4-methylphthalic acid and 0.45 g of the infrared dye 1, and the total amount was made 450 g to obtain additive solution 1a.

Preparation of Additive Solution 1b

Compounds (1) through (6) in an amount shown in Table 1 and 2, and 10.0 g of phthalazinone were dissolved in MEK to to make 300 g to obtain additive solution 1b.

Preparation of Light-Sensitive Layer Coating Solution

Under inert gas atmosphere (97% nitrogen), 50 g of the light-sensitive emulsion 1 and 15.11 g MEK were maintained at 21° C. with stirring, 1000 μl of chemical sensitizer S-5 (0.5% methanol solution) was added thereto and after 2 min., 390 μm of antifoggant-2 (10% methanol solution) was added and stirred for 1 hr. Further thereto, 423 μl of calcium bromide (10% methanol solution) was added and after stirring for 10 min., gold sensitizer Au-5 of 1/20 equimolar amount of the chemical sensitizer was added and stirred for 20 min. Subsequently, 342 ml of the stabilizer solution was added and after stirring for 10 min., 4.0 g of the infrared sensitizing dye solution was added and stirred for 1 hr. Then, the mixture was cooled to 13° C. and stirred for 30 min. Further thereto, 13.0 g of polyvinyl butyral (Butvar B-79, available from Monsanto Co.) was added and stirred for 30 min, while maintaining the temperature at 13° C., and 1.62 g of tetrachlorophthalic acid (9.4% MEK solution) and stirred for 15 min. Then, 13.64 g of additive solution la, 5.0 ml of 10% MEK solution of compound of formula (1), Desmodur N3300 (aliphatic isocyanate, product by Movey Co.) and 9.09 g of additive solution 1b were successively added with stirring to obtain coating solution of the light-sensitive layer.

Preparation of Matting Agent Dispersion

In 42.5 g methyl ethyl ketone was dissolved 7.5 g of cellulose acetate-butyrate (CAB171-15, available from Eastman Chemical Co.) and then 5 g of calcium carbonate (Super-Pflex 200, available from Speciality Mineral Corp.) was added thereto and dispersed using a dissolver type homogenizer at a speed of 800 rpm over a period of 30 min. to obtain calcium carbonate dispersion.

Preparation of Coating Solution for Protective Layer

To 865 g of methyl ethyl ketone were added with stirring 96 g of cellulose acetate-butyrate (CAB171-15, available from Eastman Chemical Co.) and 4.5 g of polymethyl methacrylate (Paraloid A-21, available from Rohm & Haas Corp.). Further thereto were added and dissolved 1.5 g of vinylsulfon compound HD-1, 1.0 g of benzotriazole and 1.0 g of fluorinated surfactant (Surflon KH40, available from ASAHI Glass Co. Ltd.). Finally, 30 g of the foregoing matting agent dispersion was added and stirred to obtain a coating composition for the surface protective layer.

Vinylsulfone Compound (VSC)

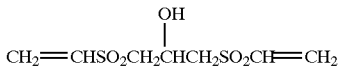

Coating of Light-Sensitive Layer Side

The foregoing light-sensitive layer coating composition and protective layer coating composition were simultaneously coated by using an extrusion coater so that the silver coverage of the light-sensitive layer was 1.9 g/m$^2$ and dry thickness of the protective layer was 2.5 $\mu$m. Thereafter, drying was conducted using hot-air at a dry-bulb temperature of 75° C. and a dew point of 10° C. over a period of 10 min.

Variation in Density

The thus prepared samples were cut to a size of 17 in×14 in, exposed to 810 nm diode laser using a laser sensitometer, and thermally processed using DRYPRO-722, available from Konica Corp. to obtain solid image samples having a density of 3.0. Development was conducted at 126° C. for a contact time of 13.6 sec. The thus obtained solid image samples were allowed to stand in a dark room maintained at 50° C. and 50% RH for 120 hr. Thereafter, the solid density was measured for each sample and variation in density (denoted as ΔD) was determined as a difference from a density of 3.0. Densitometry was carried out using a densitometer, PDA-65 (available from Konica Corp.).

Further, the processed samples were also visually evaluated with respect to unevenness in development, based on the following ranks. A level of no unevenness observed was ranked as 5, a level of marked unevenness and being unacceptable to practical use was ranked as 1 and the lowest level acceptable to practical use was ranked as 3. Results thereof are shown in Tables 1 and 2.

Evaluation of Silver Image Tone

Photothermographic material samples were cut to a size of 17 in×14 in, exposed through an optical stepped wedge to 810 nm diode laser using a laser sensitometer, and thermally processed using DRYPRO-722, available from Konica Corp. Development was conducted at 126° C. for a contact time of 13.6 sec. The thus processed samples were visually evaluated with respect to image tone at densities of 0.5 to 1.0, based on the following criteria. Thus, the a level of blue black tone and being most preferred was ranked as 5, a level of warm black tone and unacceptable to practical use was ranked as 1, and the lowest level of being acceptable to practical use was ranked as 3. Results are shown in Tables 1 and 2.

TABLE 1

| Sample No. | ΔD (D = 3.0) 120 hr/50° C. 50% RH | Compound of Formula (2) Mol %*1 | Compound of Formula (2) Molar Ratio*2 | Compound of Formula (3) (mol/m$^2$) |
|---|---|---|---|---|
| 1 | −0.3 | 30 | 35.8 | 3-29 (0.0006) |
| 2 | −0.15 | 35 | 41.7 | 3-29 (0.0006) |
| 3 | 0.13 | 40 | 41.7 | 3-29 (0.0006) |
| 4 | 0.26 | 50 | 59.6 | 3-29 (0.0006) |
| 5 | −0.28 | 30 | 35.8 | 3-29 (0.0006) |
| 6 | −0.1 | 35 | 41.7 | 3-29 (0.0006) |
| 7 | 0.07 | 40 | 47.7 | 3-29 (0.0006) |
| 8 | 0.23 | 50 | 59.6 | 3-29 (0.0006) |
| 9 | −0.27 | 30 | 35.8 | — |
| 10 | −0.13 | 35 | 41.7 | — |
| 11 | 0.09 | 40 | 47.7 | — |
| 12 | 0.24 | 50 | 59.6 | — |
| 13 | −0.11 | 35 | 41.7 | 3-29 (0.0006) |
| 14 | 0.08 | 40 | 47.7 | 3-29 (0.0006) |
| 15 | −0.13 | 35 | 41.7 | — |
| 16 | 0.1 | 40 | 47.7 | — |

*1: Mol %, based on the total amount of organic silver salt
*2: Molar ratio of compound of formula (2) to compound of formula (1)

TABLE 2

| Sample No. | Compound (4) (mol/m$^2$) | Compound (5) (mol/m$^2$) | Compound (6) (mol/m$^2$) | Unevenness in Development | Image Tone | Remark |
|---|---|---|---|---|---|---|
| 1 | — | — | — | 2.5 | 2 | Comp. |
| 2 | — | — | — | 4 | 5 | Inv. |
| 3 | — | — | — | 4 | 5 | Inv. |
| 4 | — | — | — | 2 | 2.5 | Comp. |
| 5 | 4-2 (0.0002) | — | — | 2.5 | 1.5 | Comp. |
| 6 | 4-2 (0.0002) | — | — | 5 | 4.5 | Inv. |
| 7 | 4-2 (0.0002) | — | — | 5 | 4.5 | Inv. |
| 8 | 4-2 (0.0002) | — | — | 2 | 2 | Comp. |
| 9 | — | 5-51 (0.0006) | 6-37 (0.0002) | 2.5 | 1.5 | Comp. |
| 10 | — | 5-61 (0.0006) | 6-37 (0.0002) | 5 | 4 | Inv. |
| 11 | — | 5-61 (0.0006) | 6-37 (0.0002) | 5 | 4 | Inv. |
| 12 | — | 5-61 (0.0006) | 6-37 (0.0002) | 2 | 2 | Comp. |
| 13 | 4-19 (0.0002) | — | — | 4.5 | 4.5 | Inv. |
| 14 | 4-19 (0.0002) | — | — | 4.5 | 4.5 | Inv. |
| 15 | — | 5-51 (0.0006) | 6-47 (0.0002) | 4.5 | 4.5 | Inv. |
| 16 | — | 5-61 (0.0006) | 6-47 (0.0002) | 4.5 | 4.5 | Inv. |

Example 2

Photothermographic material samples were prepared in the same manner as Example 1, except for additive solution 2c, and light-sensitive layer solutions 2A and 2B. As shown in Tables 3, 4 and 5, additives for each sample were varied.

Preparation of Light-Sensitive Emulsion 2

Thereafter, using a pump, the thus prepared pre-dispersion was transferred to a media type dispersion machine (DISPERMAT Type SL-C12 EX, available from VMA-GETZMANN), which was packed 1 mm Zirconia beads (TORESELAM, available from Toray Co. Ltd.) by 80%, and dispersed at a circumferential speed of 8 m/s and for 1.5 min. of a retention time with a mill to obtain light-sensitive emulsion 2.

Preparation of Stabilizer Solution

In 10.1 g of methanol were dissolved 0.9 g of Stabilizer 1 and 0.28 g of potassium acetate to obtain stabilizer solution.

Preparation of Infrared Sensitizing Dye Solution 2A

In 110 g of MEK were dissolved 45.3 mg of infrared sensitizing dye No. S-43, 2.50 g of 2-chlorobenzoic acid, 18.6 g of Stabilizer 2 and 1.07 g of 5-methyl-2-mercaptobenzimidazole in a dark room to obtain an infrared sensitizing dye solution 1A.

Preparation of Additive Solution 2a

In 110 g MEK were dissolved developer 1,1-bis(2-hydroxy-3,5-dimethylphenyl)-2-methylpropane [compound of formula (2)] in an amount shown in Tables 3, 4, 5 and 6, 0.72 g of 4-methylphthalic acid and 0.45 g of the infrared dye 1, and the total amount was made 450 g to obtain additive solution 2a.

Preparation of Additive Solution 2b

Compounds (3) through (6) in an amount shown in Tables 3, 4, 5 and 6, and 10.0 g of phthalazinone were dissolved in MEK to make the total amount of 300 g to obtain additive solution 2b.

Preparation of Additive Solution 2c

As shown in Tables 3, 4, 5 and 6, 0.035 mol of a silver-saving agent was dissolved in 45.0 g of MEK to obtain additive solution 2c.

Preparation of Light-Sensitive Layer Coating Solution 2A, 3A

Under inert gas atmosphere (97% nitrogen), 50 g of the light-sensitive emulsion 1 and 15.11 g MEK were maintained at 21° C. with stirring, 1000 μl of chemical sensitizer S-5 (0.5% methanol solution) was added thereto and after 2 min., 390 μm of antifoggant-2 (10% methanol solution) was added and stirred for 1 hr. Further thereto, 423 μl of calcium bromide (10% methanol solution) was added and after stirring for 10 min., gold sensitizer Au-5 of 1/20 equimolar amount of the chemical sensitizer was added and stirred for 20 min. Subsequently, 342 ml of the stabilizer solution was added and after stirring for 10 min., 4.0 g of the infrared sensitizing dye solution was added and stirred for 1 hr. Then, the mixture was cooled to 13° C. and stirred for 30 min. Further thereto, 13.0 g of polyvinyl butyral (Butvar B-79, available from Monsanto Co.) was added and stirred for 30 min, while maintaining the temperature at 13° C., and 1.62 g of tetrachlorophthalic acid (9.4% MEK solution) and stirred for 15 min. Then, 13.64 g of additive solution la, 5.0 ml of 10% MEK solution of compound of formula (1), Desmodur N3300 (aliphatic isocyanate, product by Movey Co.) and 9.09 g of additive solution 2b were successively added with stirring to obtain a coating solution of the light-sensitive layer, 2A. A coating solution of the light-sensitive layer, 3A was also similarly obtained.

Preparation of Light-Sensitive Layer Coating Solution 2B, 3B

Under inert gas atmosphere (97% nitrogen), 50 g of the light-sensitive emulsion 1 and 15.11 g MEK were maintained at 21° C. with stirring, 1000 μl of chemical sensitizer S-5 (0.5% methanol solution) was added thereto and after 2 min., 390 μm of antifoggant-2 (10% methanol solution) was added and stirred for 1 hr. Further thereto, 423 μl of calcium bromide (10% methanol solution) was added and after stirring for 10 min., gold sensitizer Au-5 of 1/20 equimolar amount of the chemical sensitizer was added and stirred for 20 min. Subsequently, 342 ml of the stabilizer solution was added and after stirring for 10 min., 4.0 g of the infrared sensitizing dye solution was added and stirred for 1 hr. Then, the mixture was cooled to 13° C. and stirred for 30 min. Further thereto, 13.0 g of polyvinyl butyral (Butvar B-79, available from Monsanto Co.) was added and stirred for 30 min, while maintaining the temperature at 13° C., and 1.62 g of tetrachlorophthalic acid (9.4% MEK solution) and stirred for 15 min. Then, 13.64 g of additive solution la, 5.0 ml of 10% MEK solution of compound of formula (1), Desmodur N3300 (aliphatic isocyanate, product by Movey Co.) and 9.09 g of additive solution 2b were successively added with stirring to obtain a coating solution of the light-sensitive layer, 2B. A coating solution of the light-sensitive layer, 3B was also similarly obtained.

Preparation of Matting Agent Dispersion

In 42.5 g methyl ethyl ketone was dissolved 7.5 g of cellulose acetate-butyrate (CAB171-15, available from Eastman Chemical Co.) and then 5 g of calcium carbonate (Super-Pflex 200, available from Speciality Mineral Corp.) was added thereto and dispersed using a dissolver type homogenizer at a speed of 800 rpm over a period of 30 min. to obtain calcium carbonate dispersion.

Preparation of Coating Solution for Protective Layer

To 865 g of methyl ethyl ketone were added with stirring 96 g of cellulose acetate-butyrate (CAB171-15, available from Eastman Chemical Co.) and 4.5 g of polymethyl methacrylate (Paraloid A-21, available from Rohm & Haas Corp.). Further thereto were added and dissolved 1.5 g of vinylsulfon compound HD-1, 1.0 g of benzotriazole and 1.0 g of fluorinated surfactant (Surflon KH40, available from ASAHI Glass Co. Ltd.). Finally, 30 g of the foregoing matting agent dispersion was added and stirred to obtain a coating composition for the surface protective layer.

Vinylsulfon Compound (VSC)

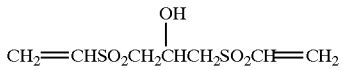

Infrared Dye 1

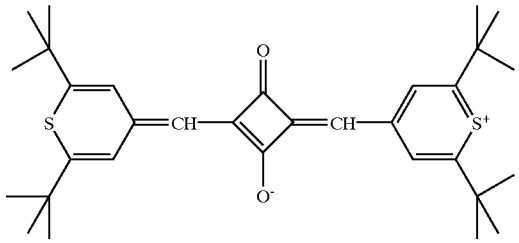

Stabilizer 1

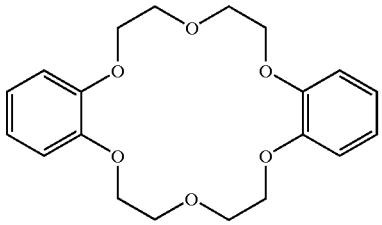

Infrared-Sensitizing Dye No. S-43

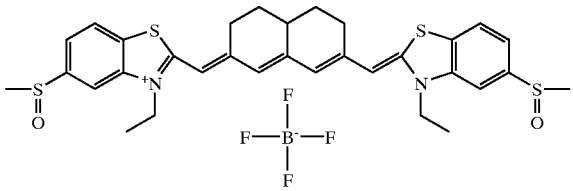

Stabilizer 2

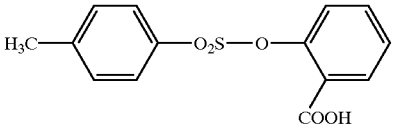

Antifoggant 1

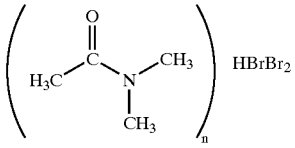

Coating of Light-Sensitive Layer Side, 2

The light-sensitive layer coating solutions and the protective layer coating solution described above were simultaneously coated by using an extrusion coater. Thus, two light-sensitive layers and one protective layer were simultaneously coated to obtain photographic material A so that the silver coverage of light-sensitive layer 2A and 2B were 0.7 and 0.3 g/m$^2$, respectively, and the dry thickness of the protective layer was 2.5 $\mu$m. Thereafter, drying was conducted using hot-air at a dry-bulb temperature of 50° C. and a dew point of 10° C. over a period of 10 min.

Coating of Light-Sensitive Layer Side, 3

The light-sensitive layer coating solution and the protective layer coating solution described above were simultaneously coated by using an extrusion coater. Thus, two layers of light-sensitive layer 3A and a protective layer were simultaneously coated on one side of a support, and two layers of light-sensitive layer 3B and a protective layer were simultaneously coated on one the other side of the support to obtain photographic material B so that the silver coverage of light-sensitive layer 2A and 2B were 0.7 and 0.3 g/m$^2$, respectively, and the dry thickness of the protective layer was 2.5 $\mu$m. Thereafter, drying was conducted using hot-air at a dry-bulb temperature of 50° C. and a dew point of 10° C. over a period of 10 min.

The thus prepared samples were evaluated, similarly to Example 1, with respect to unevenness in density and image tome. Results of the samples obtained by coating of light-sensitive layer side, 2 are shown in Tables 3 and 4; and results of the samples obtained by coating of light-sensitive layer side, 3 are also shown in Tables 5 and 6.

TABLE 3

| Sample No. | ΔD (D = 3.0) 120 hr/50° C. 50% RH | Compound of Formula (2) Mol %*1 | Compound of Formula (2) Molar Ratio*2 | Compound of Formula (3) (mol/m$^2$) |
|---|---|---|---|---|
| 1 (2A) | | 30 | 35.8 | 3-29 (0.00042) |
| (2B) | | 30 | 35.8 | 3-29 (0.00017) |
| Av. | −0.4 | 30 | 35.8 | 3-29 (0.0006) |
| 2 (2A) | | 35 | 41.7 | 3-29 (0.00042) |
| (2B) | | 35 | 41.7 | 3-29 (0.00017) |
| Av. | −0.18 | 35 | 41.7 | 3-29 (0.0006) |
| 3 (2A) | | 30 | 35.8 | 3-29 (0.00042) |
| (2B) | | 40 | 47.7 | 3-29 (0.00017) |
| Av. | −0.26 | 33 | 39.37 | 3-29 (0.0006) |
| 4 (2A) | | 40 | 47.7 | 3-29 (0.00042) |
| (2B) | | 30 | 35.8 | 3-29 (0.00017) |
| Av. | −0.15 | 37 | 44.13 | 3-29 (0.0006) |
| 5 (2A) | | 40 | 47.7 | 3-29 (0.00042) |
| (2B) | | 25 | 29.81 | 3-29 (0.00017) |
| Av. | −0.16 | 35.5 | 42.333 | 3-29 (0.0006) |
| 6 (2A) | | 40 | 47.7 | 3-29 (0.00042) |
| (2B) | | 40 | 47.7 | 3-29 (0.00017) |
| Av. | 0.17 | 40 | 47.7 | 3-29 (0.0006) |
| 7 (2A) | | 40 | 47.7 | 3-29 (0.00042) |
| (2B) | | 25 | 29.81 | 3-29 (0.00017) |
| Av. | −0.07 | 35.5 | 42.333 | 3-29 (0.0006) |
| 8 (2A) | | 40 | 47.7 | 3-29 (0.00042) |
| (2B) | | 25 | 29.81 | 3-29 (0.00017) |
| Av. | −0.06 | 35.5 | 42.333 | 3-29 (0.0006) |
| 9 (2A) | | 40 | 47.7 | — |
| (2B) | | 25 | 29.81 | — |
| Av. | −0.08 | 35.5 | 42.333 | — |
| 10 (2A) | | 40 | 47.7 | — |
| (2B) | | 25 | 29.81 | — |
| Av. | −0.06 | 35.5 | 42.333 | — |

*1: Mol %, based on organic silver salt

*2: Molar ratio of compound of formula (2) to compound of formula (1)

TABLE 4

| Sample No. | Compound (4) (mol/m$^2$) | Compound (5) (mol/m$^2$) | Compound (6) (mol/m$^2$) | Silver-saving Agent | Unevenness in Development | Image Tone | Remark |
|---|---|---|---|---|---|---|---|
| 1 (2A) | — | — | — | — | | | |
| (2B) | — | — | — | H-40 | | | |
| Av. | — | — | — | | 2.5 | 1.5 | Comp. |
| 2 (2A) | — | — | — | — | | | |
| (2B) | — | — | — | H-40 | | | |
| Av. | — | — | — | | 4 | 5 | Inv. |
| 3 (2A) | — | — | — | — | | | |
| (2B) | — | — | — | H-40 | | | |
| Av. | — | — | — | | 2.5 | 1.5 | Comp. |
| 4 (2A) | — | — | — | — | | | |
| (2B) | — | — | — | H-40 | | | |

TABLE 4-continued

| Sample No. | Compound (4) (mol/m$^2$) | Compound (5) (mol/m$^2$) | Compound (6) (mol/m$^2$) | Silver-saving Agent | Unevenness in Development | Image Tone | Re-mark |
|---|---|---|---|---|---|---|---|
| Av. | — | — | — | | 5 | 4 | Inv. |
| 5 (2A) | — | — | — | — | | | |
| (2B) | — | — | — | H-40 | | | |
| Av. | — | — | — | | 4.5 | 4.5 | Inv. |
| 6 (2A) | — | — | — | — | | | |
| (2B) | — | — | — | H-40 | | | |
| Av. | — | — | — | | 4 | 4.5 | Inv. |
| 7 (2A) | 4-11 (0.00014) | — | — | — | | | |
| (2B) | 4-11 (0.0007) | — | — | H-40 | | | |
| Av. | 4-11 (0.0002) | — | — | | 5 | 5 | Inv. |
| 8 (2A) | 4-53 (0.00014) | — | — | — | | | |
| (2B) | 4-53 (0.0007) | — | — | H-40 | | | |
| Av. | 4-53 (0.0002) | — | — | | 5 | 5 | Inv. |
| 9 (2A) | — | 5-61 (0.00042) | 6-1 (0.00014) | — | | | |
| (2B) | — | 5-61 (0.00017) | 6-1 (0.0007) | H-40 | | | |
| Av. | — | 5-61 (0.0006) | 6-1 (0.0002) | | 5 | 4.5 | Inv. |
| 10 (2A) | — | 5-61 (0.00042) | 6-11 (0.00014) | — | | | |
| (2) | — | 5-61 (0.00017) | 6-11 (0.0007) | H-40 | | | |
| Av. | — | 5-61 (0.0006) | 6-11 (0.0002) | | 5 | 4.5 | Inv. |

TABLE 5

| Sample No. | ΔD (D = 3.0) 120 hr/50° C. 50% RH | Compound of Formula (2) Mol %*1 | Compound of Formula (2) Molar Ratio*2 | Compound of Formula (3) (mol/m$^2$) |
|---|---|---|---|---|
| 1 (3A) | | 30 | 35.8 | 3-29 (0.00042) |
| (3B) | | 30 | 35.8 | 3-29 (0.00017) |
| Av. | −0.42 | 30 | 35.8 | 3-29 (0.0006) |
| 2 (3A) | | 35 | 41.7 | 3-29 (0.00042) |
| (3B) | | 35 | 41.7 | 3-29 (0.00017) |
| Av. | −0.19 | 35 | 41.7 | 3-29 (0.0006) |
| 3 (3A) | | 30 | 35.8 | 3-29 (0.00042) |
| (3B) | | 40 | 47.7 | 3-29 (0.00017) |
| Av. | −0.28 | 33 | 39.37 | 3-29 (0.0006) |
| 4 (3A) | | 40 | 47.7 | 3-29 (0.00042) |
| (3B) | | 30 | 35.8 | 3-29 (0.00017) |
| Av. | −0.16 | 37 | 44.13 | 3-29 (0.0006) |
| 5 (3A) | | 40 | 47.7 | 3-29 (0.00042) |
| (3B) | | 25 | 29.81 | 3-29 (0.00017) |
| Av. | −0.18 | 35.5 | 42.333 | 3-29 (0.0006) |
| 6 (3A) | | 40 | 47.7 | 3-29 (0.00042) |

TABLE 5-continued

| Sample No. | ΔD (D = 3.0) 120 hr/50° C. 50% RH | Compound of Formula (2) Mol %*1 | Compound of Formula (2) Molar Ratio*2 | Compound of Formula (3) (mol/m$^2$) |
|---|---|---|---|---|
| (3B) | | 40 | 47.7 | 3-29 (0.00017) |
| Av. | 0.18 | 40 | 47.7 | 3-29 (0.0006) |
| 7 (3A) | | 40 | 47.7 | 3-29 (0.00042) |
| (3B) | | 25 | 29.81 | 3-29 (0.00017) |
| Av. | −0.09 | 35.5 | 42.333 | 3-29 (0.0006) |
| 8 (3A) | | 40 | 47.7 | 3-29 (0.00042) |
| (3B) | | 25 | 29.81 | 3-29 (0.00017) |
| Av. | −0.07 | 35.5 | 42.333 | 3-29 (0.0006) |
| 9 (3A) | | 40 | 47.7 | — |
| (3B) | | 25 | 29.81 | — |
| Av. | −0.09 | 35.5 | 42.333 | — |
| 10 (3A) | | 40 | 47.7 | — |
| (3B) | | 25 | 29.81 | — |
| Av. | −0.08 | 35.5 | 42.333 | — |

TABLE 6

| Sample No. | Compound (4) (mol/m$^2$) | Compound (5) (mol/m$^2$) | Compound (6) (mol/m$^2$) | Silver-saving Agent | Unevenness in Development | Image Tone | Re-mark |
|---|---|---|---|---|---|---|---|
| 1 (3A) | — | — | — | — | | | |
| (3B) | — | — | — | H-38 | | | |
| Av. | — | — | — | | 2 | 1.5 | Comp. |
| 2 (3A) | — | — | — | — | | | |
| (3B) | — | — | — | H-38 | | | |
| Av. | — | — | — | | 4 | 4.5 | Inv. |
| 3 (3A) | — | — | — | — | | | |
| (3B) | — | — | — | H-38 | | | |
| Av. | | — | — | | 2 | 1.5 | Comp. |
| 4 (3A) | — | — | — | — | | | |
| (3B) | — | — | — | H-38 | | | |
| Av. | — | — | — | | 5 | 4 | Inv. |
| 5 (3A) | — | — | — | — | | | |
| (3B) | — | — | — | H-38 | | | |
| Av. | — | — | — | | 4.5 | 4.5 | Inv. |
| 6 (3A) | — | — | — | — | | | |
| (3B) | — | — | — | H-38 | | | |
| Av. | — | — | — | | 4.5 | 4.5 | Inv. |
| 7 (3A) | 4-10 (0.00014) | — | — | — | | | |

TABLE 6-continued

| Sample No. | Compound (4) (mol/m$^2$) | Compound (5) (mol/m$^2$) | Compound (6) (mol/m$^2$) | Silver-saving Agent | Unevenness in Development | Image Tone | Remark |
|---|---|---|---|---|---|---|---|
| (3B) | 4-10 (0.0007) | — | — | H-38 | | | |
| Av. | 4-10 (0.0002) | — | — | | 5 | 4 | Inv. |
| 8 (3A) | 4-33 (0.00014) | — | — | — | | | |
| (3B) | 4-33 (0.0007) | — | — | H-38 | | | |
| Av. | 4-33 (0.0002) | — | — | | 5 | 4 | Inv. |
| 9 (3A) | — | 5-61 (0.00042) | 6-34 (0.00014) | — | | | |
| (3B) | — | 5-61 (0.00017) | 6-34 (0.0007) | H-38 | | | |
| Av. | — | 5-61 (0.0006) | 6-34 (0.0002) | | 5 | 4 | Inv. |
| 10 (3A) | — | 5-61 (0.00042) | 6-43 (0.00014) | — | | | |
| (2) | — | 5-61 (0.00017) | 6-43 (0.0007) | H-38 | | | |
| Av. | — | 5-61 (0.0006) | 6-43 (0.0002) | | 5 | 4 | Inv. |

Example 3

Samples No. 1 through 4, prepared in Example 1; Samples No. 1 through 6, obtained by coating of light-sensitive layer side, 2; and Samples No. 1 through 6, obtained by coating of light-sensitive layer side, 3 were each aged under different conditions and evaluated. Thus, fresh samples immediately after coated, samples kept at 20° C. for 300 days, and samples kept at 30° C. for 150 days were each evaluated with respect to unevenness in development and image tone, based on the foregoing criteria. Results thereof are shown in Table 7.

TABLE 7

| | | Unevenness in Development | | | Image Tone | | | |
|---|---|---|---|---|---|---|---|---|
| Sample No. | | Fresh | 20° C./ 300 days | 30° C./ 150 days | Fresh | 20° C./ 300 days | 30° C./ 150 days | Remark |
| Example 1 | 1 | 2.5 | 1 | 1 | 2 | 2 | 1 | Comp. |
| | 2 | 4 | 4 | 4 | 5 | 5 | 4.5 | Inv. |
| | 3 | 4 | 4 | 4 | 5 | 5 | 4.5 | Inv. |
| | 4 | 2 | 1 | 1 | 2.5 | 1 | 1 | Comp. |
| Example 2 | 1 | 2.5 | 1 | 1 | 1.5 | 1.5 | 1 | Comp. |
| (Light- | 2 | 4 | 4 | 4 | 5 | 5 | 5 | Inv. |
| sensitive | 3 | 2.5 | 1 | 1 | 1.5 | 1.5 | 1 | Comp. |
| layer side | 4 | 5 | 5 | 5 | 4 | 4 | 4 | Inv. |
| coating 2) | 5 | 4.5 | 4.5 | 4.5 | 4.5 | 4.5 | 4.5 | Inv. |
| | 6 | 4 | 4 | 4 | 4.5 | 4.5 | 4.5 | Inv. |
| Example 2 | 1 | 2 | 1 | 1 | 1.5 | 1.5 | 1 | Comp. |
| (Light- | 2 | 4 | 4 | 4 | 4.5 | 4.5 | 4.5 | Inv. |
| sensitive | 3 | 2 | 1 | 1 | 1.5 | 1.5 | 1 | Comp. |
| layer side | 4 | 5 | 5 | 5 | 4 | 4 | 4 | Inv. |
| coating 3) | 5 | 4.5 | 4.5 | 4.5 | 4.5 | 4.5 | 4 | Inv. |
| | 6 | 4.5 | 4.5 | 4.5 | 4.5 | 4.5 | 4 | Inv. |

What is claimed is:

1. A photothermographic material comprising on a support a light-insensitive organic silver salt, light-sensitive silver halide and a reducing agent, wherein when the photothermographic material having been exposed to light at an exposure so as to give an optical density of 3.0 and after having been thermally processed, the photothermographic material exhibits a variation of density from 3.0 being within the range of −0.2 to +0.2 after being kept at 50° C. and 50% RH for 120 hours; and wherein the photothermographic material further comprises a compound represented by formula (1); the reducing agent is represented by the formula (2) and contained in an amount of 35 to 100 mol %, based on the organic silver salt; and a molar ratio of said reducing agent represented by formula (2) to said compound represented by formula (1) being 10 to 50:

$$X{=}C{=}N{-}L{-}(N{=}C{=}X)_v \qquad \text{formula (1)}$$

wherein v is 1 or 2; L is a bivalent linkage group having an alkylene group, an alkenylene group, arylene group or an alkylarylene group; and X is an oxygen atom or a sulfur atom;

formula (2)

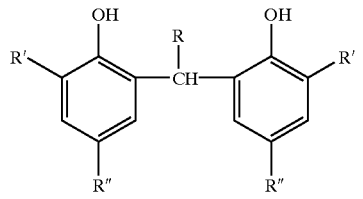

wherein R is a hydrogen atom or an alkyl group having 1 to 10 carbon atoms; R' and R" are each an alkyl group having 1 to 5 carbon atoms.

2. The photothermographic material of claim 1, wherein the reducing agent is represented by the formula (2) and contained in an amount of 40 to 60 mol %, based on the organic silver salt.

3. The photothermographic material of claim 1, wherein the photothermographic material comprises a compound represented by formula (3) and a compound represented by formula (4):

$$Q\text{-}(Y)_n{-}C(X1)(X2)(X3) \qquad \text{formula (3)}$$

wherein Q is an aryl group or a heterocyclic group; Y is a bivalent linkage group having —SO—, —$SO_2$— or —CO—; n is 0 or 1; X1, X2 and X3 are each a halogen atom;

$$Q'\text{-}(Y')_n{-}C(X'1)(X'2)(X'3) \qquad \text{formula (4)}$$

wherein Q' is an aryl group or a heterocyclic group; Y' is a bivalent linkage group having —SO—, —$SO_2$—, or —CO—; n is 0 or 1; X'1, X'2 and X'3 are each a hydrogen atom, a halogen atom, a haloalkyl group, an acyl group, an alkoxycarbonyl group, an aryloxycarbonyl group, a carbamoyl group, a sulfamoyl group, a sulfonyl group, or a heterocyclic group, provided that at least one of X'1, X'2 and X'3 is a halogen atom but all of them are not halogen atoms at the time.

4. The photothermographic material of claim 3, wherein the compound represented by formula (3) and the compound by formula (4) are each contained in an amount of 0.001 to 0.1 mol per mol of light-insensitive organic silver salt.

5. The photothermographic material of claim 1, wherein the photothermographic material further comprises a compound represented by formula (3) and a compound represented by formula (6):

$$Q''\text{-}(Y'')_n\text{—}C(X''1)(X''2)(X''3) \qquad \text{formula (5)}$$

wherein Q" is an aryl group or a heterocyclic group; Y" is a bivalent linkage group having —SO—, —$SO_2$—, or —CO—; n is 0 or 1; X"1, X"2 and X"3 are each a hydrogen atom, a bromine atom, a haloalkyl group, an acyl group, an alkoxycarbonyl group, an aryloxycarbonyl group, a carbamoyl group, a sulfamoyl group, a sulfonyl group, or a heterocyclic group, provided that at least one of X"1, X"2 and X"3 is a bromine atom;

$$Q'''\text{-}(Y''')_n\text{—}C(X'''1)(X'''2)(X'''3) \qquad \text{formula (6)}$$

wherein Q"' is an aryl group or a heterocyclic group; Y"' is a bivalent linkage group having —SO—, —$SO_2$—, or —CO—; n is 0 or 1; X"'1, X"'2 and X"'3 are each a chlorine atom, a haloalkyl group, an acyl group, an alkoxycarbonyl group, an aryloxycarbonyl group, a carbamoyl group, a sulfamoyl group, a sulfonyl group, or a heterocyclic group, provided that at least one of X"'1, X"'2 and X"'3 is a chlorine atom.

6. The photothermographic material of claim 5, wherein the compound represented by formula (5) and the compound by formula (6) are each contained in an amount of 0.001 to 0.1 mol per mol of light-insensitive organic silver salt.

7. The photothermographic material of claim 1, wherein the photothermographic material comprises a silver-saving agent.

8. The photothermographic material of claim 7, wherein the silver-saving agent is a compound represented by the following formula (H):

formula (H)

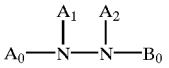

wherein $A_0$ is an aliphatic group, aromatic group, heterocyclic group, or -$G_0$-$D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=$NG_1D_1$)—, —SO—, —$SO_2$— or —P(O)($G_1D_1$)— group, in which $G_1$ is a bond, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is a hydrogen atom, an aliphatic group, aromatic group, heterocyclic group, amino group, alkoxy group, aryloxy group, alkylthio group or arylthio group.

9. The photothermographic material of claim 7, wherein the silver-saving agent is a compound represented by the following formula (G):

formula (G)

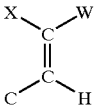

wherein X is an electron-with drawing group; W is a hydrogen atom, an alkyl group, alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfamoyl group, a thiosulfamoyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group; R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group, an amino group, a cyclic amino group, an acylamino group, an oxycarbonylamino group, a heterocyclic group, a ureido group, or a sulfonamido group, provided that X and W, or X and R may combine with each other to form a ring.

10. The photothermographic material of claim 7, wherein the silver-saving agent is a compound represented by the following formula (P):

formula (P)

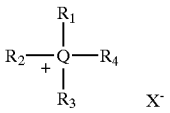

wherein Q is a nitrogen atom or a phosphorus atom; $R_1$, $R_2$, $R_3$ and $R_4$ each are a hydrogen atom, an alkyl group, an alkenyl group, an alkynyl group, an aryl group, a heterocyclic group or an amino group, provided that $R_1$, $R_2$, $R_3$ and $R_4$ may combine together with each other to form a ring; and $X^-$ is an anion.

11. The photothermographic material of claim 7, wherein the silver saving agent is contained in an amount of $1\times10^{-5}$ to 1 mol per mol of light-insensitive organic silver salt.

12. The photothermographic material of claim 1, wherein the photothermographic material comprises on the support a light-sensitive layer containing the light-insensitive organic silver salt, light-sensitive silver halide and reducing agent.

13. The photothermographic material of claim 12, wherein the light-sensitive layer comprises at least a first and second light-sensitive layers.

14. The photothermographic material of claim 13, wherein the first and second light-sensitive layers are provided on one side of the support.

15. The photothermographic material of claim 13, wherein the first light-sensitive layer is provided on one side of the support and the second light-sensitive layer is provided on the other side of the support.

* * * * *